US009634373B2

(12) United States Patent
Lee et al.

(10) Patent No.: US 9,634,373 B2
(45) Date of Patent: Apr. 25, 2017

(54) ANTENNA ISOLATION SHROUDS AND REFLECTORS

(71) Applicant: Ubiquiti Networks, Inc., San Jose, CA (US)

(72) Inventors: Jude Lee, San Jose, CA (US); John R. Sanford, Escondido, CA (US); Robert J. Pera, San Jose, CA (US)

(73) Assignee: Ubiquiti Networks, Inc., San Jose, CA (US)

( * ) Notice: Subject to any disclaimer, the term of this patent is extended or adjusted under 35 U.S.C. 154(b) by 0 days.

(21) Appl. No.: 14/862,470

(22) Filed: Sep. 23, 2015

(65) Prior Publication Data

US 2016/0104941 A1 Apr. 14, 2016

Related U.S. Application Data

(60) Provisional application No. 62/063,911, filed on Oct. 14, 2014, provisional application No. 62/202,742, filed on Aug. 7, 2015.

(51) Int. Cl.
*H01Q 1/52* (2006.01)
*H01Q 1/12* (2006.01)
*H01Q 19/02* (2006.01)

(52) U.S. Cl.
CPC ..... *H01Q 1/1228* (2013.01); *H01Q 1/125* (2013.01); *H01Q 1/523* (2013.01); *H01Q 19/022* (2013.01)

(58) Field of Classification Search
CPC H01Q 1/42; H01Q 1/421; H01Q 1/52; H01Q 1/521; H01Q 1/525; H01Q 1/526;
(Continued)

(56) References Cited

U.S. PATENT DOCUMENTS 2,455,888 A 12/1948 Brown
3,599,219 A * 8/1971 Holtum, Jr. ..... H01Q 19/022 343/840

(Continued)

FOREIGN PATENT DOCUMENTS

JP 2002299940 A 10/2002
JP 2007259001 10/2007

(Continued)

OTHER PUBLICATIONS

Sanford , John; U.S. Appl. No. 14/170,507 entitled "Coaxial RF Dual-Polarized Waveguide Filter and Method," filed Jan. 31, 2014.

*Primary Examiner* — Dameon E Levi
*Assistant Examiner* — Patrick Holecek
(74) *Attorney, Agent, or Firm* — Shay Glenn LLP

(57) ABSTRACT

Shroud isolation, including choke shroud isolation, apparatuses for wireless antennas for point-to-point or point-to-multipoint transmission/communication of high bandwidth signals, and integrated reflectors including a shroud or choke shroud. A choke shroud systems may include a cylindrical body with an isolation choke boundary at the distal opening to attenuate electromagnetic signals to, from, or within the antenna. The isolation choke boundary region may have ridges that may be tuned to a band of interest. The isolation choke boundary may provide RF isolation when used near other antennas.

25 Claims, 39 Drawing Sheets

(58) Field of Classification Search
CPC .... H01Q 15/16; H01Q 19/022; H01Q 19/026; H01Q 19/10; H01Q 19/134; H01Q 19/19; H01Q 19/193; H01Q 3/02; H01Q 3/04; H01Q 3/06; H01Q 3/08; H01Q 3/10; H01Q 1/12; H01Q 1/1207; H01Q 1/1221; H01Q 1/125; H01Q 1/1257; H01Q 1/1264
See application file for complete search history.

(56) References Cited

U.S. PATENT DOCUMENTS 3,739,392 A 6/1973 Ross et al.
4,578,638 A 3/1986 Takano et al.
4,626,863 A * 12/1986 Knop ..... H01Q 17/001 343/781 P
4,788,554 A * 11/1988 Smith ..... H01Q 13/0291 343/786
4,918,459 A 4/1990 De Teso
5,131,006 A 7/1992 Kamerman et al.
5,151,920 A 9/1992 Haagh et al.
5,295,154 A 3/1994 Meier et al.
5,406,260 A 4/1995 Cummings et al.
5,422,887 A 6/1995 Diepstraten et al.
5,428,636 A 6/1995 Meier
5,504,746 A 4/1996 Meier
5,546,397 A 8/1996 Mahany
5,625,365 A 4/1997 Tom et al.
5,706,428 A 1/1998 Boer et al.
5,740,366 A 4/1998 Mahany et al.
5,844,893 A 12/1998 Gollnick et al.
5,907,310 A 5/1999 Seewig et al.
5,936,542 A 8/1999 Kleinrock et al.
5,940,771 A 8/1999 Gollnick et al.
6,130,892 A 10/2000 Short et al.
6,137,449 A * 10/2000 Kildal ..... H01Q 1/42 343/781 CA
6,169,522 B1 1/2001 Ma et al.
6,194,992 B1 2/2001 Short et al.
6,337,990 B1 1/2002 Koshino
6,374,311 B1 4/2002 Mahany et al.
6,437,757 B1 8/2002 Butler
6,563,786 B1 5/2003 Van Nee
6,636,894 B1 10/2003 Short et al.
6,665,536 B1 12/2003 Mahany
6,697,415 B1 2/2004 Mahany
6,714,559 B1 3/2004 Meier
6,789,110 B1 9/2004 Short et al.
6,795,852 B1 9/2004 Kleinrock et al.
6,810,426 B2 10/2004 Mysore et al.
6,857,009 B1 2/2005 Ferreria et al.
6,868,399 B1 3/2005 Short et al.
6,970,680 B1 11/2005 Tomoe
7,020,082 B2 3/2006 Bhagavath et al.
7,088,727 B1 8/2006 Short et al.
7,117,526 B1 10/2006 Short
7,155,196 B1 12/2006 Beard
7,194,554 B1 3/2007 Short et al.
7,197,556 B1 3/2007 Short et al.
7,254,191 B2 8/2007 Sugar et al.
7,295,812 B2 11/2007 Haapoja et al.
7,386,002 B2 6/2008 Meier
7,457,646 B2 11/2008 Mahany et al.
7,656,363 B2 * 2/2010 Devicque ..... H01Q 1/421 343/840
7,715,800 B2 5/2010 Sinha
7,739,383 B1 6/2010 Short et al.
7,752,334 B2 7/2010 Paunikar et al.
7,826,426 B1 11/2010 Bharghavan et al.
8,077,113 B2 12/2011 Syed et al.
8,190,708 B1 5/2012 Short et al.
8,335,272 B2 12/2012 Roberts
8,385,869 B2 2/2013 Feenaghty et al.
8,466,847 B2 * 6/2013 Pera ..... H01Q 19/19 343/833
8,483,188 B2 7/2013 Walton et al.
8,493,279 B2 7/2013 Pera et al.
8,581,795 B2 * 11/2013 Simms ..... H01Q 1/42 343/781 CA
8,804,622 B1 8/2014 Thai et al.
8,836,601 B2 9/2014 Sanford et al.
9,083,083 B2 * 7/2015 Hills ..... H01Q 1/42
9,191,037 B2 11/2015 Lascari et al.
2002/0098805 A1 7/2002 King
2003/0032398 A1 2/2003 Harris
2003/0038753 A1 2/2003 Mahon
2003/0207669 A1 11/2003 Kroeger
2003/0221304 A1 12/2003 Janssen et al.
2003/0224801 A1 12/2003 Lovberg et al.
2004/0108966 A1 6/2004 McKivergan et al.
2005/0245254 A1 11/2005 Hall
2006/0001589 A1 * 1/2006 Nicolae ..... H01Q 19/13 343/840
2006/0007044 A1 1/2006 Crouch et al.
2007/0057860 A1 3/2007 Jaffer et al.
2007/0132651 A1 6/2007 Nilsson
2007/0157482 A1 7/2007 Wallace
2008/0224938 A1 9/2008 Udagawa et al.
2008/0297425 A1 12/2008 Axton et al.
2009/0174622 A1 7/2009 Kanou
2009/0310721 A1 12/2009 Redfern et al.
2010/0013729 A1 1/2010 Harel et al.
2010/0053022 A1 3/2010 Mak et al.
2010/0245187 A1 9/2010 Omuro et al.
2011/0012801 A1 1/2011 Monte et al.
2011/0068988 A1 3/2011 Monte
2011/0258678 A1 10/2011 Cowling et al.
2012/0013516 A1 1/2012 Ahn et al.
2012/0176608 A1 * 7/2012 McCown ..... H01Q 15/16 356/138
2012/0213086 A1 8/2012 Matsuura
2013/0012134 A1 1/2013 Jin et al.
2013/0017794 A1 1/2013 Kloper et al.
2013/0028150 A1 1/2013 Ma et al.
2013/0135146 A1 5/2013 Ransom et al.
2013/0154894 A1 6/2013 Caimi et al.
2013/0249754 A1 9/2013 Rice
2013/0271337 A1 10/2013 Lee et al.
2014/0118220 A1 5/2014 Ley
2014/0218248 A1 8/2014 Schulz et al.
2014/0219142 A1 8/2014 Schulz et al.
2014/0220903 A1 8/2014 Schulz et al.
2014/0274177 A1 9/2014 Carbajal
2014/0315599 A1 10/2014 Teichmann et al.
2015/0002357 A1 1/2015 Sanford et al.
2015/0280328 A1 10/2015 Sanford et al.
2015/0280329 A1 10/2015 Sanford et al.
2015/0292948 A1 10/2015 Goldring et al.
2015/0381293 A1 12/2015 Hardy et al.
2016/0112074 A1 4/2016 Lascari et al.

FOREIGN PATENT DOCUMENTS

JP 2010192992 A 9/2010
JP 2012227863 A 11/2012
KR 10-2008-0079357 9/2008
KR 20-0450128 Y1 8/2010
KR 10-1023789 B1 3/2011
KR 10-1068766 B1 9/2011
WO WO98/40990 A1 9/1998
WO WO01/31855 A2 5/2001
WO WO01/31886 A2 5/2001
WO WO01/86877 A2 11/2001
WO WO2008/042804 A2 4/2008
WO WO2008/154514 A2 12/2008
WO WO2009/131219 A1 10/2009
WO WO2011/005710 A2 1/2011

* cited by examiner

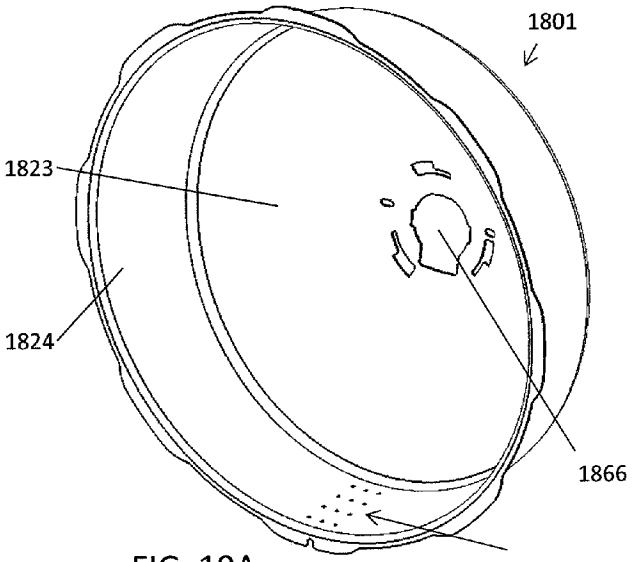
FIG. 19A
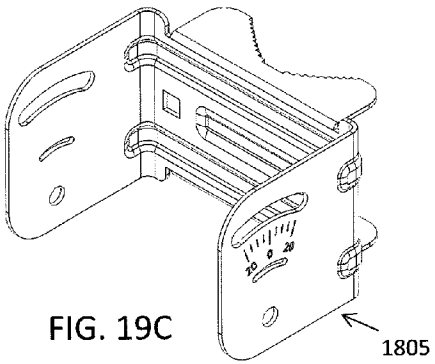
FIG. 19C
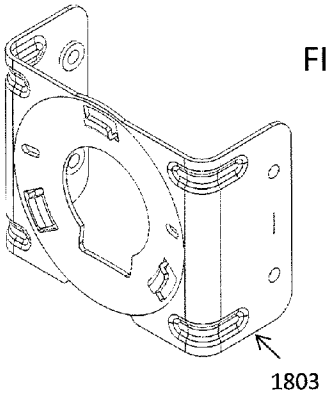
FIG. 19B
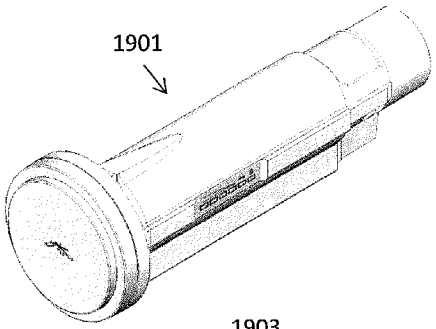
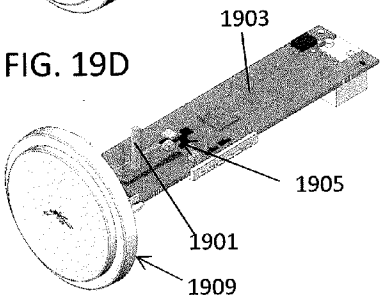
FIG. 19D
FIG. 19E
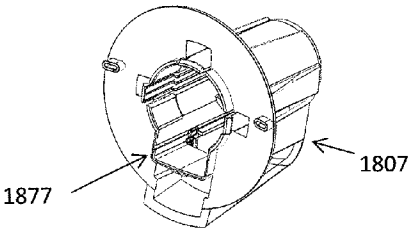
FIG. 19F

INTEGRATED RF ISOLATOR

METAL-PLATED REAR HOUSING

ANTENNA ISOLATION SHROUDS AND REFLECTORS

CROSS REFERENCE TO RELATED APPLICATIONS

This patent application claims priority to U.S. Provisional Patent Application No. 62/063,911, filed Oct. 14, 2014, titled "SIGNAL ISOLATION SHROUD FOR ANTENNA," and U.S. Provisional Patent Application No. 62/202,742, filed Aug. 7, 2015, titled "SIGNAL ISOLATION SHROUDS AND REFLECTORS INCLUDING SIGNAL ISOLATION SHROUDS FOR ANTENNA," each of which is herein incorporated by reference in its entirety.

This patent application may be related to U.S. patent application Ser. No. 14/486,992, filed Sep. 15, 2014, titled "DUAL RECEIVER/TRANSMITTER RADIO DEVICES WITH CHOKE," now Publication No. US-2015-0002357-A1, which claimed priority as a continuation of U.S. patent application Ser. No. 14/170,441, filed Jan. 31, 2014, titled "DUAL RECEIVER/TRANSMITTER RADIO DEVICES WITH CHOKE," now U.S. Pat. No. 8,836,601, which claimed priority as a continuation-in-part to U.S. patent application Ser. No. 13/843,205, filed Mar. 15, 2013, titled "RADIO SYSTEM FOR LONG-RANGE HIGH-SPEED WIRELESS COMMUNICATION," now Publication No. US-2014-0218248-A1 and also to U.S. Provisional Patent Application No. 61/760,387, filed Feb. 4, 2013, titled "DUAL POLARIZED WAVEGUIDE FILTER," U.S. Provisional Patent Application No. 61/760,381, filed Feb. 4, 2013, titled "FULL DUPLEX ANTENNA," U.S. Provisional Patent Application No. 61/762,814, filed Feb. 8, 2013, titled "RADIO SYSTEM FOR LONG-RANGE HIGH-SPEED WIRELESS COMMUNICATION," U.S. Provisional Patent Application No. 61/891,877, filed Oct. 16, 2013, titled "RADIO SYSTEM FOR LONG-RANGE HIGH-SPEED WIRELESS COMMUNICATION," U.S. Provisional Patent Application No. 61/922,741, filed Dec. 31, 2013, titled "RADIO SYSTEM FOR LONG-RANGE HIGH-SPEED WIRELESS COMMUNICATION," and to U.S. patent application Ser. No. 14/720,902, filed May 25, 2015, titled "ANTENNA FEED SYSTEM," now Publication No. US 2015-0255879-A1, which is a continuation of U.S. patent application Ser. No. 13/783,274, filed Mar. 2, 2013, titled "ANTENNA FEED SYSTEM," now Publication No. US-2013-0199033-A1 and is a continuation of U.S. patent application Ser. No. 12/477,986, filed Jun. 4, 2009, titled "ANTENNA FEED SYSTEM," now U.S. Pat. No. 8,493,279. The entire contents of each of these applications are herein incorporated by reference in their entirety

INCORPORATION BY REFERENCE

All publications and patent applications mentioned in this specification are herein incorporated by reference in their entirety to the same extent as if each individual publication or patent application was specifically and individually indicated to be incorporated by reference.

FIELD

This disclosure relates generally to wireless communication apparatuses. More specifically, this disclosure relates to systems including RF (e.g., microwave) antennas for high-speed, long-range wireless communication and particularly to devices including components for selectively attenuating electromagnetic signals from the wireless communication systems to improve signal quality. This disclosure also relates to devices to protect a wireless communication system from damage.

BACKGROUND

The rapid development of optical fibers, which permit transmission over long distances and at high bandwidths, has revolutionized the telecommunications industry and has played a major role in the advent of the information age. However, there are limitations to the application of optical fibers. Because laying optical fibers in the field can require a large initial investment of time and material, it is not cost effective to extend the reach of optical fibers to sparsely populated areas, such as rural regions or other remote, hard-to-reach areas. Moreover, in many scenarios in which a business may want to establish point-to-point links among multiple locations, it may not be economically feasible to lay new fibers.

On the other hand, wireless radio communication devices and systems provide high-speed data transmission over an air interface, making it an attractive technology for providing network connections to areas that are not yet reached by fibers or cables. Wireless communications are rapidly carried through the air and space by electromagnetic signals, generally from one antenna to another antenna. However, currently available wireless technologies for long-range, point-to-point (or point-to-multipoint) connections of electromagnetic signals encounter many problems, such as limited range and poor signal quality.

An antenna is responsible for transmitting or receiving signals that carry information, specifically electromagnetic signals such as microwave, radio or satellite signals, across air and space from one place to another place. An antenna is generally used with other components as part of an antenna system to accomplish its tasks. An antenna functions by changing the form of the signals, making them accessible for human use. Electromagnetic signals in the form of electromagnetic waves are transmitted (delivered or sent) from one antenna and are received (picked up) by another antenna. Electromagnetic waves are complex and have both an electric component and a magnetic component. One antenna transmits signals by converting an electrical current into electromagnetic waves (such as radio waves) that proceed out from the antenna into air and space. Some of the electromagnetic waves (such as the radio waves) are received by another antenna which converts them back into an electrical current. There are many types of electromagnetic waves, and a particular antenna system is designed to work with a particular type of waves. Radio frequency (RF) and microwave antennas represent a class of electronic antennas designed to operate on wireless electromagnetic signals in particular ranges, the megahertz to gigahertz frequency ranges. Conventionally these frequency ranges are used by most broadcast radio, television, and other wireless communication (cell phones, Wi-Fi, etc.) systems with higher frequencies often employing specialized antennas, called parabolic antennas. (Although certain wavelengths of electromagnetic radiation are referred to as "radio waves" they carry, in addition to signals for AM or FM radio, signals for cell phones, televisions, etc.). The suitability of a particular antenna system for a given purpose is determined by the antenna's frequency, gain, and beam width. In some cases, an antenna may transmit and/or receive signals such as microwave, radio or satellite signals from a second antenna. Although any given antenna is generally capable of both delivering and receiving a particular type of electromagnetic signals, in some cases, an antenna system may be configured so that an antenna is only responsible for delivering or receiving electromagnetic signals, but does not do both.

An antenna system may use a reflector to direct electromagnetic radiation from the air or space to an antenna. One familiar type of reflector is a parabolic reflector. A parabolic antenna is an antenna that uses a parabolic reflector which is a curved surface with the cross-sectional shape of a parabola, to direct electromagnetic signals (e.g., radio waves) in a particular direction so they are better able to be picked up by the antenna. A parabola is a symmetric curve and a parabolic reflector is a surface that describes a curve throughout a 360° rotation, a shape referred to as paraboloid. Conventionally, a parabolic antenna has a portion shaped like a dish and so is often referred to as a "dish antenna" or simply "a dish". A parabolic reflector is very effective at directing waves into a narrow beam. In particular, and as indicated above, a parabolic reflector is very effective at reflecting waves into collimated plane wave beam along the axis of the reflector. Parabolic antennas systems are generally used for long distance communication between buildings or over large geographic areas.

Parabolic antennas provide for high directivity of the radio signal because they have very high gain in a single direction. In other words, the signal can be sent in a desired direction, such as radiating outwards towards other antennas rather than being sent upward into space where there are no antennas. Beam width is a measurement of the area over which the antenna receives signal and is important in determining how well an antenna functions. To achieve narrow beam-widths, a parabolic reflector must typically be much larger than the wavelength of the radio waves used, so parabolic antennas are typically used in the high frequency part of the radio spectrum, at ultra-high (UHF) and super high (SHF; e.g., microwave) frequencies, where the wavelengths are small enough to allow for manageable antenna sizes. Parabolic antennas may be used in point-to-point communications, such as microwave relay links, WAN/LAN links and spacecraft communication antennas.

The operating principle of a parabolic antenna is that a point source of radio waves at the focal point in front of a parabolic reflector of conductive material will be reflected into a collimated plane wave beam along the axis of the reflector. Conversely, an incoming plane wave parallel to the axis will be focused to a point at the focal point.

Conventional radio devices, including radio devices having parabolic reflectors, suffer from a variety of limitations and problems. For example although a wireless signal of interest has to be received by an antenna to be useful, an antenna does not just receive a specific signal of interest, but it receives any signal that comes its way (provided that the signal meets certain criteria regarding wavelength, etc.). Other difficulties and limitations include aligning with an appropriate receiver, monitoring and switching between transmitting and receiving functions, avoiding interference (including reflections and spillover from adjacent radios/antennas), loss of signal, mechanical damage, expense, and complying with regulatory requirements without negatively impacting function. Described herein are devices, methods and systems that may improve wireless communication devices and address issues such as those identified above. In particular, described herein are apparatuses that may provide isolation of an emitted beam by selectively attenuating portion of the emitted signal.

SUMMARY OF THE DISCLOSURE

The present invention relates to devices, methods and systems that may improve wireless communication devices.

For example, described herein are choke shroud apparatuses for antenna systems. In general, such apparatuses may include a shroud body, which may be a cylindrical shape that couples with and may extend the distal opening of parabolic reflector, and a choke boundary region that extends from the shroud body. The choke boundary layer generally includes a plurality of ridges that are concentrically spaced from each other, and may run parallel to the sidewall of the shroud. The choke boundary may be positioned on an outer edge/rim of the shroud (e.g., near the opening of the shroud that extends away from its attachment to the parabolic reflector of the antenna), though it may be recessed relative to the distal end. The choke boundary layer may encircle the distal opening of the shroud, or it may only partially encircle the shroud.

For example, a choke shroud apparatus may include: a cylindrical side wall encircling a central axis extending distally to proximally, the side wall forming a distal end opening and a proximal end opening, wherein the distal and proximal ends allow radio frequency (RF) electromagnetic radiation to pass through while the side wall attenuates, reflects or attenuates and reflects RF electromagnetic radiation, the proximal end adapted to be mounted at a forward open end of an antenna reflector for modifying electromagnetic radiation to and from the antenna reflector; and a choke boundary region mounted to a perimeter of side wall and extending away from the central axis, the choke boundary region comprising a plurality of ridges and channels extending parallel to the side wall and configured to attenuate RF electromagnetic radiation to or from the antenna reflector when the apparatus is mounted on the antenna reflector.

Any of these apparatuses may further comprise a radome covering the distal end opening. For example, the apparatus may further comprise a radome and covering the distal end opening and at least a portion of the choke boundary region.

The choke boundary may extend from the side wall at the distal end opening. In some variations the choke boundary region overlies the side wall (e.g., extends into the distal opening formed by the side wall of the shroud portion). In some variations the choke boundary region does not impinge on the distal end opening.

As mentioned the choke boundary region may completely or only partially encircle the distal end opening. For example, the choke boundary region may encircle less than 180 degrees of the distal end opening.

The choke boundary region may be any appropriate height relative to the distal end opening of the sidewall of the shroud portion. For example, a distal end of the choke boundary region may extend distally beyond a distal edge of the side wall. The distal end of the choke boundary region is adjacent to a distal edge of the side wall. The distal end of the choke boundary region is recessed proximally relative to a distal edge of the side wall.

A proximal end of the side wall may be configured to attach to a rim of the antenna reflector at the forward open end of the reflector. The channels of the choke boundary region may extend proximally to a plurality of different depths. The ridges of the choke boundary region may extend distally to a plurality of different heights. For example, the channels between adjacent ridges may be between 18.8 mm and 9.4 mm deep.

In general, the choke boundary region may provide isolation. For example, the choke boundary region may be configured to provide greater than 10 dB isolation relative to an antenna placed adjacent to the open end of the antenna reflector. The choke boundary region may be configured to suppress propagation of radio waves having a frequency between 9 GHz and 41 GHz.

In general, any of the apparatuses described herein may include a fastener configured to fasten the apparatus to the antenna reflector.

Also described herein are antenna reflectors that include an integrated shroud. These integrated shrouds may include choke boundary regions. In some variations, the integrated reflector and shroud may be specifically configured for use with an integrated radio and antenna feed (e.g., as described in U.S. Pat. No. 8,493,279, herein incorporated by reference in its entirety). For example, the integrated shroud and reflector may have an outwardly-facing mouth forming a plane that is not perpendicular to the elongate axis of the feed (e.g., the integrated radio and antenna feed). Furthermore, the antenna reflector may include a receiver or holder for holding the integrated radio and antenna feed and attaching it in position behind the parabolic reflector (closed end) of the integrated shroud. This receiver/holder may be coated with a layer of material (e.g., metal) such as chromium, that reflects or otherwise prevents the spread of RF energy out of the receiver/holder. The receiver/holder may also be adapted to lock between or into a bracket mount for securing the apparatus to a surface, pole, or mount.

In any of the shroud or integrated parabolic reflectors and shrouds described herein, the apparatus may include a radome (e.g., cover). In particular, the mouth of the shroud or integrated parabolic reflector and shroud may be adapted for removably securing the radome over the apparatus. For example, the mouth of a shroud and/or integrated reflector and shroud may include flattened side regions and one or more flange edges or channels to mate with the radome in a particular orientation so that the radome slides onto and over the mouth. Alternatively, in some variations the mouth is adapted to allow the radome to screw on.

Any of the integrated reflectors and shrouds described herein may include a mount, which may be a drop-in mount that can be first attached to a surface, and then the antenna apparatus can be dropped into the mount and the angle relative to the horizon adjusted and locked into position.

Also described herein are RF antenna devices including reflectors with integrated shrouds. These integrated parabolic reflectors with shrouds may include a choke boundary or may not include a choke boundary.

These apparatuses, which may be systems or devices, may in particular be adapted for use with an integrated radio transceiver and feed, such as those described, for example, in U.S. Pat. No. 8,493,279, and pending U.S. application Ser. No. 13/783,274 (Publication No. US-2013-0199033-A1) and Ser. No. 14/720,902 (Publication No. Publication No. US 2015-0255879-A1). Alternatively, in some variations, the apparatus may be configured for use with a traditional antenna feed connecting to RF transceiver circuitry via a cable or line. An integrated radio frequency (RF) transceiver and feed typically includes a unitary housing enclosing (e.g., a self-contained) RF transceiver, and feed, which may be inserted into the RF antenna reflectors described herein, so that the feed portion of the antenna assembly is includes the RF transceiver circuitry, rather than just a traditional antenna feed. As will be described in greater detail below, an integrated RF transceiver and feed may have a housing enclosing one or more sub-reflectors, transceiver circuitry directly connected to one or more feed pins, and in some variations one or more director pins (passive radiators or parasitic elements); these elements may all be arranged on one or more sides of a substrate (e.g., printed circuit board), and may be arranged in a line).

Thus, a parabolic antenna reflector apparatus may include an integrated RF radio transceiver and feed, or it may be configured for use with an integrated radio transceiver and feed. For example, a parabolic antenna reflector apparatus, the apparatus including: a parabolic reflector section having a central axis of symmetry and a circular opening perpendicular to the central axis of symmetry; a shroud portion extending distally from the circular opening, the shroud portion having a distal opening (which may in any of the variation described herein optionally form a plane, e.g., at an angle of between 0.5 degrees and 15 degrees relative to a plane perpendicular to the central axis of symmetry); a radome covering the distal opening; a central opening through the parabolic reflector section having a diameter configured to receive an integrated radio transceiver and feed (e.g., of greater than 3 cm); and a holder mounted on a proximal side of the central opening so the central opening is continuous with an inner chamber within the holder. The inner chamber may comprise a coating of a radio-frequency (RF) shielding (e.g., reflecting and/or absorbing) material, further wherein the inner chamber is configured to secure an integrated radio transceiver and feed so that the integrated radio transceiver and feed is aligned with the central axis of symmetry.

As mentioned, the apparatus may generally also include an integrated radio transceiver and feed (e.g., integrated RF transceiver and feed), which may include an elongate housing enclosing a substrate, transceiver circuitry on the substrate, an antenna radiator extending from the substrate. The antenna radiator may include an antenna feed pin extending from the substrate and in some variations a director pin extending from the substrate. Also in some variations the antenna radiator may also include a sub-reflector; in some variations the sub-reflector may be considered separate from the antenna radiator connected to the substrate. The integrated radio transceiver and feed is typically held within the holder of the apparatus so that the sub-reflector is positioned along the central axis of symmetry.

The apparatus may also include a rim around the distal opening (of the shroud) having an outer edge comprising two parallel straight regions on opposite sides of the distal opening; wherein the radome is configure to cover the distal opening by sliding over the distal opening and engaging the two parallel straight regions. The radome may have channels, clips or surfaces to mate with the rim, and particularly to mate with these straight, parallel and opposite sides. This variation of the apparatus has a distinct "top" onto which the radome slides down onto first, to engage the parallel sides. The top may be marked, e.g., by an alphanumeric character, symbol, or the like. For example, a notch or arrow may be formed at the top of the apparatus (e.g., on the rim), indicating the location to first apply the radome on so that it may be slid into position (matching the top of the apparatus to the bottom of the radome).

In some variations, the apparatus includes a rim around the distal opening, wherein the rim comprises a scalloped outer edge. In this variation, the radome may include channels, clips or surfaces that mate with the scalloped edges so that the radome may be rotated to engage.

As mentioned above, any of these apparatuses may include a choke boundary region around the distal opening. For example, the choke boundary region may include a plurality of parallel ridges and channels extending at least partially around the distal opening and configured to attenuate RF electromagnetic radiation to or from the antenna reflector. Where a rim is present for mating with the radome, the choke boundary may be radially within the rim (e.g., so that the choke boundary is beneath the radome), or it may be radially outside of the rim (e.g., so that the choke boundary is outside of the radome), or the choke boundary may form part of the rim that is engaged by the radome.

In general, the surface of the distal opening (and when the radome is flat, the plane formed by the radome) across the shroud portion of the apparatus is at an angle relative to the axis of symmetry of the parabolic reflector portion of the apparatus. For example, the plane formed by the distal opening of the shroud portion may be at an angle of between 0.5 degrees and 15 degrees, e.g., between 1 degree and 10 degrees (e.g., between a lower value of 0.5, 1, 1.5, 2, 2.5, 3, 3.5, 4, 4.5, 5 degrees and an upper value of 4, 5, 6, 7, 8, 9, 10, 11, 12, 13, 14, 15, 16, 17, 18, 19, 20, 21, 22, 23, 24, 25, 30 degrees, where the lower value is always less than the upper value). For example, the angle of the plane formed by setting one edge of the rim of the distal opening about ½ of an offset wavelength above the plane perpendicular to the axis of symmetry relative to an opposite side of the rim, where the offset wavelength is a mean, median, or center wavelength of the operational range of the apparatus. In general, the distal opening of the shroud portion is between about 200 mm and 700 mm (e.g., 300 mm, 400 mm, 500 mm, etc.).

Any of these apparatuses may also include a mounting bracket (which may be referred to as a first mounting bracket) having a mounting bracket opening, wherein the mounting bracket is attached to the proximal side of the central opening between the parabolic reflector section and the holder so that a proximal end of an integrated radio transceiver and feed may pass through the central opening and bracket opening and into the holder. The mounting bracket may be configured to connect with a second mounting bracket that may be affixed to a post, pole, wall, or other surface or stand. The mounting bracket (either the first or second mounting bracket) may include an indicator such as a level or tilt indicator for showing the orientation (e.g., angle) of the antenna apparatus relative to level (ground) or between the first mounting bracket and the second mounting bracket.

In general, the shroud portion may comprise an annular wall extending between the circular opening of the parabolic reflector section and the distal opening. The diameter of the annular wall at a top portion of the apparatus may be between 1.1 times and 3 times the diameter of the annular wall at a bottom portion of the apparatus. The change in annual wall diameters as you move around the shroud portion determines the angle of the plane of the distal opening described above. Thus, the maximum wall diameter at one region around the circumference of the shroud may be approximately ½ of an offset wavelength larger than the wall diameter at the opposite side of the distal opening (the minimum wall diameter).

In general, the holder that is mounted to the back (proximal side) of the reflector (parabolic reflector portion) is configured to securely hold the integrated RF (radio) transceiver and feed so that it passes through the central opening in the parabolic reflector portion and extends in the axis of symmetry within the parabolic reflector and shroud. The holder typically includes an internal cavity or housing that prevents passage of RF energy through the holder, which may be particularly helpful when using an integrated radio transceiver and feed. For example, the holder may be shielded to prevent a substantial amount of RF energy (e.g., within the operating range of the apparatus) from passing. For example, the RF shielding material may comprise a copper and nickel plating.

For example, described herein are parabolic antenna reflector apparatuses comprising: a parabolic reflector section having a central axis of symmetry and a circular opening perpendicular to the central axis of symmetry; a shroud portion extending distally from the circular opening, the shroud portion having a distal opening forming a plane at an angle of between 0.5 degrees and 15 degrees relative to a plane perpendicular to the central axis of symmetry; a radome covering the distal opening; a central opening through the parabolic reflector section; a holder mounted on a proximal side of the central opening so the central opening is continuous with an inner chamber within the holder, wherein the inner chamber comprises a coating of a radio-frequency (RF) shielding material; and an integrated radio transceiver and feed comprising an elongate housing enclosing a substrate, transceiver circuitry on the substrate, an antenna feed pin extending from the substrate, and a director pin extending from the substrate, and a sub-reflector, wherein the integrated radio transceiver and feed is held within the holder so that the sub-reflector extends from the holder, through the central opening and into the parabolic reflector section along the central axis of symmetry.

A parabolic antenna reflector apparatus may include: a parabolic reflector section having a central axis of symmetry and a circular opening perpendicular to the central axis of symmetry; a shroud portion extending distally from the circular opening, the shroud portion having a distal opening forming a plane at an angle of between 0.5 degrees and 15 degrees relative to a plane perpendicular to the central axis of symmetry, wherein the parabolic reflector section and shroud section are continuous regions of a single piece of material; a rim around the distal opening having an outer edge comprising two parallel straight regions on opposite sides of the distal opening; a radome covering the distal opening, wherein the radome is configure to slide over the distal opening and engage the two parallel straight regions; a central opening through the parabolic reflector section having a diameter of greater than 3 cm; and a holder mounted on a proximal side of the central opening so the central opening is continuous with an inner chamber within the holder, wherein the inner chamber comprises a coating of a radio-frequency (RF) shielding material, wherein the inner chamber is configured to secure an integrated radio transceiver and feed so that the integrated radio transceiver and feed is aligned with the central axis of symmetry.

As described herein, a parabolic antenna reflector apparatus may include: a parabolic reflector section having a central axis of symmetry and a circular opening perpendicular to the central axis of symmetry; a shroud portion extending distally from the circular opening, the shroud portion having a distal opening forming a plane at an angle of between 0.5 degrees and 15 degrees; a radome covering the distal opening; a central opening through the parabolic reflector section having a diameter of greater than 3 cm.

In some variations, the parabolic antenna reflector apparatus includes: a parabolic reflector section having a central axis of symmetry and a circular opening perpendicular to the central axis of symmetry; a shroud portion extending distally from the circular opening, the shroud portion having a distal opening forming a plane at an angle of between 0.5 degrees and 15 degrees relative to a plane perpendicular to the central axis of symmetry; a radome covering the distal opening; a central opening through the parabolic reflector section; and a holder mounted on a proximal side of the central opening that opens into an inner chamber within the holder, wherein the inner chamber comprises a coating of a radio-frequency (RF) shielding material, further wherein the inner chamber is configured to secure an integrated radio transceiver and feed so that the integrated radio transceiver and feed is aligned with the central axis of symmetry.

A parabolic antenna reflector apparatus may include: a parabolic reflector section having a central axis of symmetry and a circular opening perpendicular to the central axis of symmetry; a shroud portion extending distally from the circular opening, the shroud portion having a distal opening forming a plane at an angle of between 0.5 degrees and 15 degrees relative to a plane perpendicular to the central axis of symmetry; a radome covering the distal opening; a central opening through the parabolic reflector section; a holder mounted on a proximal side of the central opening so the central opening is continuous with an inner chamber within the holder, wherein the inner chamber comprises a coating of a radio-frequency (RF) shielding material; and an integrated radio transceiver and feed comprising an elongate housing enclosing a substrate, transceiver circuitry on the substrate, an antenna feed pin extending from the substrate, and a director pin extending from the substrate, and a sub-reflector, wherein the integrated radio transceiver and feed is held within the holder so that the sub-reflector extends from the holder, through the central opening and into the parabolic reflector section along the central axis of symmetry.

In some variations, a parabolic antenna reflector apparatus includes: a parabolic reflector section having a central axis of symmetry and a circular opening perpendicular to the central axis of symmetry; a shroud portion extending distally from the circular opening, the shroud portion having a distal opening forming a plane at an angle of between 0.5 degrees and 15 degrees relative to a plane perpendicular to the central axis of symmetry, wherein the parabolic reflector section and shroud section are continuous regions of a single piece of material; a rim around the distal opening having an outer edge comprising two parallel straight regions on opposite sides of the distal opening; a radome covering the distal opening, wherein the radome is configure to slide over the distal opening and engage the two parallel straight regions; a central opening through the parabolic reflector section having a diameter of greater than 3 cm; a holder mounted on a proximal side of the central opening so the central opening is a holder mounted on a proximal side of the central opening so the central opening is continuous with an inner chamber within the holder, wherein the inner chamber comprises a coating of a radio-frequency (RF) shielding material; and an integrated radio transceiver and feed comprising an elongate housing enclosing a substrate, transceiver circuitry on the substrate, an antenna feed pin extending from the substrate, and a director pin extending from the substrate, and a sub-reflector, wherein the integrated radio transceiver and feed is held within the holder so that the sub-reflector extends from the holder, through the central opening and into the parabolic reflector section along the central axis of symmetry.

Also described herein are methods of using or operating any of the apparatuses described herein, including methods of assembling such apparatuses. For example, described herein are methods of operating an apparatuses to transmit and receive RF signals by transmitting from an integrated radio transceiver and feed, for example, by generating a signal from the transceiver within the parabolic reflector section of the apparatus, transmitting from one or more feed pins on the same substrate as the transceiver, passively radiating from the one or more director pins on the same substrate as the transceiver and reflecting the signal off of the sub-reflector into the parabolic reflector section of the apparatus, and then reflecting the signal off of the sides of the shroud region and out of the distal opening, through the radome that is at an angle relative to the axis of symmetry, where the integrated radio transceiver and feed is aligned along the axis of symmetry.

A method of operating a parabolic antenna reflector apparatus having an integrated radio transceiver and feed may include: emitting a first radio frequency (RF) energy from a transceiver positioned inside of a feed on a substrate, wherein the first RF energy is emitted by an antenna feed pin extending from the substrate, and passively absorbed and re-radiated by a director pin extending from the substrate; reflecting the first RF energy from a sub-reflector within a housing that also encloses the substrate, wherein the housing extends from an opening through a parabolic reflector section of the parabolic reflector apparatus, the parabolic reflector section having a central axis of symmetry and a circular opening perpendicular to the central axis of symmetry; absorbing or reflecting a third RF energy from a holder mounted on a proximal side of the parabolic reflector opening, wherein the third RF energy is emitted from a portion of the housing extending proximally behind the parabolic reflector portion; passing the first RF energy out of a shroud portion extending distally from the circular opening; receiving a second RF energy into the shroud portion while rejecting RF noise from outside of the shroud portion; and receiving the second RF energy in the transceiver.

Any of these methods may further include absorbing or reflecting a third RF energy from a holder mounted on a proximal side of the parabolic reflector opening, wherein the third RF energy is emitted from a portion of the housing extending proximally behind the parabolic reflector portion.

Receiving a second RF energy into the shroud portion may include rejecting RF noise from a choke boundary region located around a distal opening of the shroud.

As described above, any of these methods may be used with a shroud having a distal opening that forms an angle relative to a plane perpendicular to the central axis of symmetry. The angled distal opening may face down (e.g., when the apparatus is oriented towards a horizon), so that, e.g., passing the first RF energy out of a shroud portion comprises passing the first RF energy out of the shroud portion, wherein the shroud portion has a first wall length that is longer at an upper portion of the shroud portion than a second wall length at a lower portion of the shroud portion.

As mentioned, also described herein are methods of installing a parabolic antenna reflector apparatus. In general, the parabolic antenna reflector apparatus may comprise a parabolic reflector section having a central axis of symmetry and a circular opening perpendicular to the central axis of symmetry, and a shroud portion extending distally from the circular opening. A method of installing the parabolic antenna reflector apparatus may include: mounting the parabolic antenna reflector apparatus to a post, pole, tower or wall so that a longer side of the shroud portion is at the top of the parabolic antenna reflector apparatus and a shorter side of the shroud portion is at the bottom of the parabolic antenna reflector apparatus, nearer to a ground surface; and sliding a radome from a top of the distal opening of the shroud portion of the parabolic antenna reflector apparatus so that a channel of the radome engages with two parallel straight regions on opposite sides of a rim around the distal opening to cover the distal opening.

In general, these apparatuses may be installed so that the long side of the shroud portion is up (towards the sky) and the short side is down (towards the bottom). Although this is somewhat counterintuitive, as the majority of noise and potential interference would arise from the ground (e.g., reflections, interference sources) rather than up, this orientation is effective.

Sliding may include sliding the radome so that the radome forms a plane at an angle of between 0.5 degrees and 20 degrees relative to a plane perpendicular to the central axis of symmetry. Mounting comprises attaching a first mount piece to a convex back side of the parabolic antenna reflector apparatus and attaching a holder to the convex back side of the parabolic antenna reflector apparatus so that the first mount piece is between the holder and the convex back side of the parabolic antenna reflector apparatus.

Any of these method of installing these apparatuses may include attaching an integrated radio transceiver and feed, e.g., attaching an integrated radio transceiver and feed into a central opening through a parabolic reflector section of the parabolic antenna reflector apparatus and into a holder on the back side of the parabolic antenna reflector apparatus, so that the integrated radio transceiver and feed extends within the parabolic antenna reflector apparatus along the central axis of symmetry of the parabolic reflector section. The integrated radio transceiver and feed may include an elongate housing enclosing a substrate, transceiver circuitry on the substrate, an antenna feed pin extending from the substrate, and a director pin extending from the substrate, and a sub-reflector.

Mounting may include attaching a first mount piece to a convex back side of the parabolic antenna reflector apparatus and attaching a second mount piece to the first mount piece to form a mount, wherein the second mount is attached or attachable to the post, pole, tower or wall.

For example, a method of installing a parabolic antenna reflector apparatus may include: attaching a first mount piece to a convex back side of the parabolic antenna reflector apparatus; attaching a holder to the convex back side of the parabolic antenna reflector apparatus so that the first mount piece is between the holder and the convex back side of the parabolic antenna reflector apparatus; attaching a second mount piece to the first mount piece to form a mount, wherein the second mount is attached or attachable to a post, pole, tower or wall; attaching an integrated radio transceiver and feed into a central opening through a parabolic reflector section of the parabolic antenna reflector apparatus and into the holder on the back side of the parabolic antenna reflector apparatus, so that the integrated radio transceiver and feed extends within the parabolic antenna reflector apparatus along a central axis of symmetry of the parabolic reflector section; sliding a radome from a top of a distal opening of a shroud portion of the parabolic antenna reflector apparatus so that a channel of the radome engages with two parallel straight regions on opposite sides of a rim around the distal opening to cover the distal opening, wherein the parabolic antenna reflector apparatus is oriented so that a longer side of the shroud portion is at the top of the parabolic antenna reflector apparatus and a shorter side of the shroud portion is at the bottom of the parabolic antenna reflector apparatus, nearer to a ground surface.

BRIEF DESCRIPTION OF THE DRAWINGS

FIG. 17 shows the mount portion of the apparatus of FIGS. 16A-16E, which may be used to mount the apparatus to a surface, post, tower, or the like.

FIG. 19A shows the parabolic barrel reflector of FIG. 18.

FIGS. 19B and 19C show the bracket mount of FIG. 18.

FIG. 19D shows an example of an integrated radio/feed, as described herein.

FIG. 19E shows the integrated radio/feed of FIG. 19D with the cover removed (exposing the circuitry and feed body.

FIG. 19F shows the holder for an integrated radio/feed such as the one shown in FIG. 19D, keyed to maintain the orientation of the radio/feed in the parabolic barrel reflector.

FIG. 22 shows a mount portion of the apparatus of FIGS. 16A-16E, which may be used to mount the apparatus to a surface, post, tower, or the like.

FIG. 24 shows a mount portion of the apparatus of FIGS. 16A-16E, which may be used to mount the apparatus to a surface, post, tower, or the like.

DETAILED DESCRIPTION

Described herein are apparatuses (including devices and systems) including choke shrouds and methods for improving and protecting radio devices and systems, such as those used for high-speed, long-range wireless communication, using choke shrouds. In general, these apparatuses may include a shroud component extending an opening of an antenna reflector (e.g., parabolic reflector) and a choke boundary portion extending from a distal end of the shroud component (where the choke is oriented perpendicular to the central axis of the shroud portion). The choke boundary portion may be mounted on the shroud portion so that the choke boundary and shroud are held in a fixed relationship with each other. The shroud may be adapted to connect with an open end of a reflector (such as a parabolic reflector) and hold the choke boundary region relative to the reflector to attenuate RF electromagnetic signals to and/or from an antenna when it is coupled with the reflector. In some variations, the apparatuses may also include one or more connectors configured to mount the choke shroud to an antenna reflector. In some variations, the apparatuses may also include a radome configured to cover at least part of an opening of a shroud or antenna reflector to protect the inside of the reflector and the antenna from damaging elements, such as dirt, water, wind, etc.

Figure 1B:
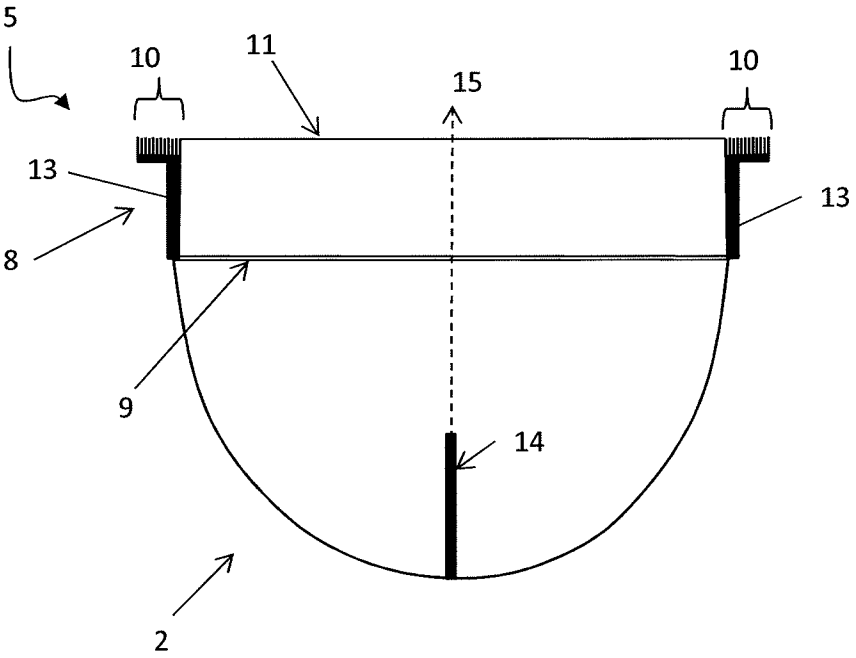
FIG. 1B shows the parabolic reflector of FIG. 1A with a choke shroud attached thereto.
Figure 1A:
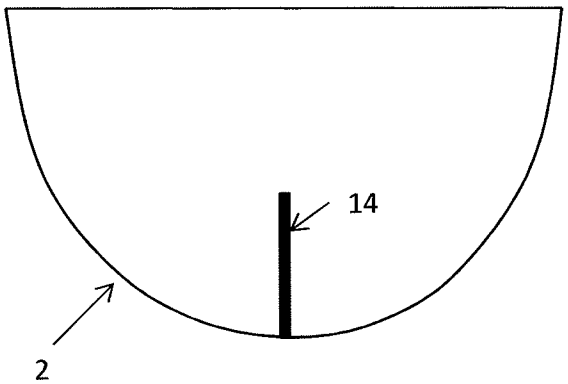
FIG. 1A shows a side-view of an antenna having a parabolic reflector.

The apparatuses and systems may be used with any reflector or antenna system such as those known in the art. For example, FIG. 1A illustrates a schematic of one example of an RF antenna including a parabolic reflector 2 to which a feed for an RF transceiver (transmitter and/or receiver) 14 is coupled. In operation, a typical RF antenna such as the one shown in FIG. 1A may transmit and receiver, however a substantial amount of interference between this antenna and one or more nearby neighbors, including reflectors that are operating on the same networks FIG. 1B shows a sectional side-view of the antenna system of FIG. 1A, including the parabolic reflector 2, with a choke shroud 5 that includes a shroud component 8 that is integrated with a choke boundary 10 (shown in different cross-sections) mounted on antenna reflector 6. Shroud portion 8 including a first (proximal) end 9 and second (distal) end 11 with side wall 13 there between. Wall 13 is a curved side wall encircling central axis 15 of shroud portion 8. In this example, the apparatus include a central axis 15 that is typically (or may be made to be) continuous with to the central axis of antenna feed 14 and with the reflector central axis and extends distally (up in FIG. 1B) to proximally (down in FIG. 1B). In other examples, the shroud central axis may not be parallel (e.g., may be oblique) relative to the antenna central axis. In FIGS. 1A and 1B, antenna feed 14 extends distally away from the base of reflector 6. In this example, antenna reflector 6 is a parabolic shaped reflector configured to reflect and direct electromagnetic radiation to or from antenna 14. The reflector may be, for example, plastic or metal, and may be coated to provide a reflective surface. The side wall 13 of the shroud region is connected to the choke boundary 10 (shown in partial sections) which is adjacent to shroud region 8 (e.g., extends laterally away from second or distal end 11 of shroud region 8 and extends laterally away from central axis 15). Ridges of the choke boundary portion 10 may be offset from and distal to shroud portion 8 (e.g. ridges may extend laterally and distally from the central axis of shroud 8). Part, some, or all of a choke boundary region may be adjacent to the shroud region, off-set from the shroud region, lateral to the shroud region, or distal to the shroud region. In some variations, the choke boundary may be off-set from the shroud and may not overlie the shroud region.

Figure 2B:
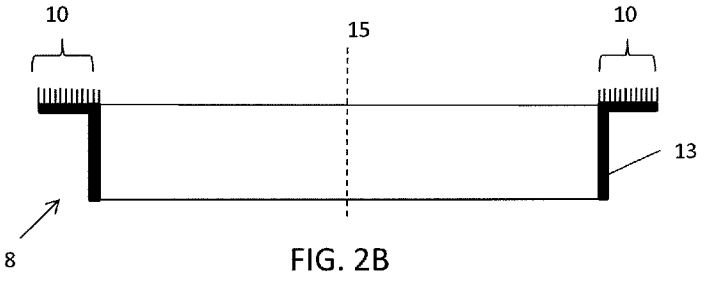
FIGS. 2B-2D illustrate sectional side views of variations of a choke shroud having a choke boundary region that fully encircles the shroud portion of the choke shroud. A radome is not shown (but may be included)
Figure 2C:
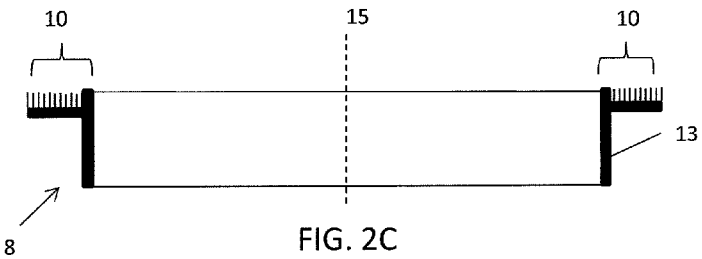
Figure 2D:
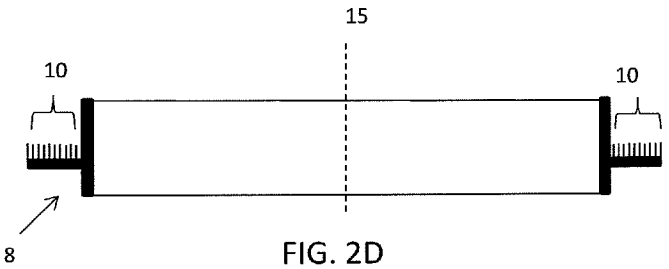
Figure 2A:
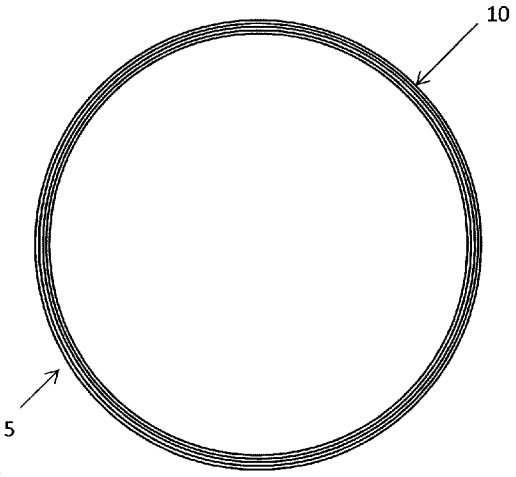
FIG. 2A is a top view (showing the distal face) of one variation of a choke shroud that can be mounted on an antenna reflector.

FIG. 2A shows a top view of choke shroud apparatus 5 that is adapted to be mounted on an antenna reflector. Choke shroud apparatus 4 includes shroud portion 8 having a side wall 13 and at a choke boundary 10 (show in the cross-sections of alternate variations of FIGS. 2B, 2C and 2D). The choke boundary region may be shown as cut in this view, which shows first and second portions of the choke boundary region. Shroud side wall 13 is configured to be mounted on an antenna reflector, such as the reflector shown in FIGS. 1A and 1B. Shroud side wall 13 may be a support structure, such as a support for a choke boundary region and/or a radome. For example, a choke boundary region may be mounted to a shroud region in a fixed relationship and may project away from the shroud. Shroud 8 may extend forward (distally) from the end of the reflector when in place on the reflector. A continuous surface (from proximal to distal) may be created by the reflector and the shroud portion when the shroud region is in place on the reflector.

A shroud region may be hollow and have a curved side wall encircling a central axis and may have first and second ends. The first and second ends may be opposed to each other and the wall may be between or adjacent to the first and second ends. A shroud may have a surface that extends partially of continuously around (encloses) a central axis and may have elements or portions of the surface that are circular, conical, ellipsoid, ovoid, rectangular, etc. A shroud end may be circular, conical, ellipsoid, ovoid, rectangular, etc. A shroud as described herein may generally be a cylinder or cylindrically shaped and have circular, ellipsoid, or oval end(s). A central axis of a shroud may be configured to be continuous with a central axis of a reflector when the shroud is in place on the reflector or may be configured to be off-set relative to the central axis of the reflector.

In some variations a first end (e.g., the proximal end or the end closest to a reflector) or second end (e.g., the distal end or the end furthest from the reflector) of a shroud may not be perpendicular to a central axis of the shroud, reflector, and/or antenna, though in general will have a first end and a second end perpendicular to one or more of these central axes. A shroud may have the same cross-sectional profile (e.g., same diameter), shape, and size at its first and second ends (as well as in between the ends), but in some variations, the cross-sectional profile (e.g., diameter) shape, and size at a first end of a shroud may be different from the cross-sectional profile at the second end. A shroud may have a generally cylindrical shape. For example, a shroud may be a right circular cylinder (and have a circular cross-section), but may instead have a cross-section that is an ellipse, a hyperbola, an oval, a parabola, etc. along its length or ends and may be an ellipsoid cylinder, a hyperbolic cylinder, an ovoid cylinder, a paraboloid cylinder, etc. A shroud may be generally cylindrically shaped and have a cross-section that is one or more of a circle, an ellipse, a hyperbola, an oval, a parabola, etc.), but may have some portion that has a different or irregular shape. All or only a portion of a shroud may be cylindrical. In some particular examples, a first end of shroud may have the same (or close to the same) diameter, shape, and/or size as the forward open end (or rim) of a reflector. A shroud may be attached (or configured to be attached to) to a rim of a reflector. Attaching a shroud to the forward open end of a reflector may create a more or less continuous surface between the shroud and the reflector (e.g., continuously longitudinally or in the direction of the central axis of the shroud or reflector). A space between a reflector and a shroud may be made continuous (as with an adhesive, a band, a filler, a gasket, an O-ring, etc.) to completely fill in the space or an end of the shroud may be abutted to an end of the reflector (with a line between the ends) to essentially create a continuous surface. An end (e.g., a first end) of a shroud may be slightly larger or slightly smaller than a forward end of a reflector and may fit inside or outside the reflector to form a tight fit. A portion of the shroud and reflector may overlap. A first end of a shroud may be mounted at (or adapted to be mounted at) a forward open end of an antenna reflector, and the forward open end of the reflector may be configured to transmit or receive radiation to or from the antenna. A shroud may be configured such that it extends away from the open end of the reflector when mounted to the reflector (e.g., when the first end of the shroud is attached to the forward open of the reflector).

A shroud may be a closed shape or may be an open shape. An open shroud may have an open end(s) (e.g., one end may be open; two ends may be open) and may also have a closed end (e.g., closed by a relatively RF transparent material such as a as a radome). A closed shroud portion may have closed end(s). An open end of a shroud is generally transparent to electromagnetic radiation and electromagnetic radiation can pass through an open shroud end. A closed end of a shroud may be transparent to (at least some types of) electromagnetic radiation to allow electromagnetic radiation of interest (such as radio or micro waves) to pass through a closed end of the shroud. A closed end may function, for example, to prevent material such as air, animals, debris, insects, rain, snow, wind, etc. from entering a shroud (e.g., an inside of a shroud) or entering an inside of a reflector (e.g., an inside defined by the reflector such as the area bounded by the reflector and in a plane across its opening) when the shroud is in place on a reflector. A closed end may prevent some material from entering but may allow other material to enter. A closed end may be a continuous structure or a discontinuous structure (such as being made from bars, shafts, etc.) For example, a closed end may prevent strong winds from passing through but may allow some air or some wind to pass through.

A body (wall) of a shroud portion of these apparatuses may substantially be a single continuous piece of material or may be made from two, three, four, or more panels that are joined to create a continuous material. In some variations, a shroud may not be substantially reflective and may not direct electromagnetic radiation. A shroud may provide support or be a support structure without reflecting or directing electromagnetic radiation.

In some variations, a shroud may have a reflective inner surface or a reflective outer surface and may reflect (or be configured to reflect) electromagnetic radiation. For example, a shroud may be metal or may be plastic and may be coated or painted to provide a reflective surface configured to reflect electromagnetic radiation, such as radiofrequency radiation. A shroud may act or be configured to direct electromagnetic radiation, such as RF radiation. A shroud may reduce unwanted radiation such as side (e.g., far side lobes) or back radiation to or from an antenna (or between two or more antennas, such as in an antenna system). However, a shroud is not a reflector of an antenna system. A reflector reflects electromagnetic radiation to a focal point (of an antenna) and a shroud does not reflect electromagnetic radiation to a focal point (of an antenna). A shroud may direct electromagnetic radiation without radiating it into a reflector. In some variations, a shroud may include or be coated or treated to include electromagnetic absorbing material and may be configured to absorb electromagnetic radiation. The structure or composition of a shroud may improve a signal to or from an antenna by reducing unwanted radiation signals such as from the environment or to or from another antenna.

As indicated above, a choke boundary portion may be mounted to the shroud and the shroud may be useful for attaching the choke boundary to the reflector (via the shroud) and for positioning the choke boundary relative to the reflector (and also relative to a central axis of the antenna). FIGS. 2B, 2C and 2D show portions of a choke region 10 (including the ridges shown). The choke region has been attached to at least a portion of a choke wall. In this example, the choke ridges and choke walls in the example of a choke boundary shown in FIGS. 2A-2C form concentric rings around the central axis and around the side wall of the shroud portion. For example, FIG. 2B shows choke boundary extending away from the side wall of the shroud 8. The choke wall extends transversely from the central (longitudinal) axis of shroud side wall 8, and the choke boundary including the choke wall and choke ridges overlie shroud side wall 8. A choke wall may extend in any direction (e.g., obliquely or parallel) relative to the central (longitudinal) axis of shroud 8, but in some variations will extend approximately transversely relative to the central (longitudinal) axis of shroud side wall 8. A choke shroud may attach (or be configured to attach to) an end of a reflector, such as using one or more connectors. A connector may be, for example, an adhesive, a band of material, a bolt, a glue, a hinge, a pin, a screw, etc. A connector may be a metal or a non-metal, polymeric, synthetic, etc. A choke shroud may fit over or inside a portion of a reflector. A choke region of a choke shroud may be positioned over or inside a portion of a reflector and may be held in place by one or more connectors such as those described above, or by a tight fit (e.g., an interference fit), etc.

An isolation choke boundary region may refer to a structure or part mounted to the shroud region, or integrally formed with the shroud wall, and configured to attenuate or reduce electromagnetic spillover from an antenna (e.g., a transmission antenna, a receiving antenna, a transmission/ receiving antenna) thereby decreasing unwanted signal to the antenna. An isolation choke boundary portion may attenuate or reduce electromagnetic radiation to or from an antenna when it is mounted (e.g., via the shroud portion) on the reflector and the antenna transmits or receives electromagnetic radiation signals. Thus in some variations, choke apparatus for an antenna system is provided, including a shroud comprising a curved side wall encircling a central axis, the wall adjacent to apposed first and second shroud ends wherein the first and second ends allow electromagnetic radiation to pass through, the first shroud end adapted to be mounted at a forward open end of an antenna reflector for focusing electromagnetic radiation to an antenna, the forward open end configured to receive the electromagnetic radiation and the shroud configured to extend away from the open end of the reflector when mounted; and a choke boundary mounted to the shroud and external to the wall, the boundary configured to attenuate electromagnetic wave radiation to or from the antenna when the shroud is mounted on the reflector and the antenna transmits or receives electromagnetic radiation.

An isolation choke boundary region may be referred to herein as an isolation barrier, isolation boundary, choke, choke boundary, isolate choke, choke barrier, etc. A choke (e.g., isolation choke boundary region) may provide a structure (including a corrugated structure) having multiple barriers, such as ridges, that reduce the cross-talk between the transmission and receiving parabolic antenna dishes. The height/depth and spacing of the ridges may be adapted so that they isolate the particular frequency range (e.g., bands) used by the device. For example, the barrier structures forming the isolation choke boundary may have a depth or range of depths centered on the ¼ wavelength of the bands being used, as describe in greater detail herein. Functionally, an isolation choke boundary may be configured to provide greater than a minimum level of isolation (e.g., 10 dB isolation) when positioned between adjacent parabolic transmitter and receiver dishes, as described.

An isolation choke boundary (which may also be referred to as a choke, choke boundary, or isolation choke) generally acts as a barrier or damper between two (or more) antennae. For example, an isolation choke boundary may act as a barrier between a transmitting antenna and a receiving antenna. The choke boundary may be configured to suppress propagation of radio waves having a frequency greater than or equal to 9 GHz and less than or equal to 41 GHz. Variations of the radio devices described herein may be configured to operate around the 5 GHz band, and the choke may include a plurality (e.g., >3, more than 5, more than 6, more than 7, more than 8, more than 9, more than 10, more than 11, more than 12, more than 13, more than 14, more than 15, more than 16, more than 20, more than 25, etc.) ridges that are spaced apart. Such ridges may run parallel to the outer rim of the shroud. Such ridges may run parallel to one or more than one parabolic reflectors to which the choke is attached. In general, an isolation choke boundary includes of ridges that extend in height perpendicular to the plane of the ends (opening(s)) of the shroud (and to the parabolic antenna(s) when in place on shroud and the parabolic antenna(s)). The ridges may extend at least partially (and may extend entirely) around the perimeter of the shroud or the second or distal shroud end. The ridges may extend at least partially around the rim(s) of the shroud or the second distal shroud end so that the ridges are directed perpendicular to the plane of the shroud end. The height, spacing between adjacent ridges, number of ridges, shape of ridges, and length of the ridges may be optimized based on the particular electromagnetic bands (e.g. radio bands) used. For example, a choke may be optimized for operation around the 5 GHz band, such that the device has greater than about 70 dB isolation between transmitting and receiving antennas. The choke component shown may add about 10 dB isolation (e.g., about 12 dB isolation, etc.).

In some variations, the isolation choke boundary region is formed from layers of metal (strips, sheets, etc.) or other appropriate material, that are placed adjacent to each other (combined together) with some of the layers displaced to form the ridges and channels at the edge of the combined layers. For example, a choke boundary layer may be formed in part by layering strips, ribbons, or the like, together, and bending the combined structure into the desired curve (e.g., to mount to the edge of the parabolic antenna and/or the shroud). The layers of material may be secured together in any appropriate manner, including adhesively (e.g., by resin or epoxy) and/or by screwing, anchoring, fastening, riveting, or the like.

In use, when a second (e.g., parabolic) antenna is in proximity to a first parabolic antenna, and the first parabolic antenna is coupled to choke shroud as described herein, when the second antenna is adjacent or near the first antenna with the choke shroud, the first antenna may be more effectively isolated from the second antenna. In general, the isolation choke boundary region may be positioned between the first antenna reflector and the opening of a second parabolic reflector. Although described in detail for use with parabolic reflectors, non-parabolic reflectors may also (instead) be used.

For example, a radio system for transmission of wireless signals described herein may include: a first reflector; radio circuitry configured for transmission of radio-frequency signals from the first reflector; a shroud coupled to the first reflector; and an isolation choke boundary coupled to the shroud. A radio system may also include a second reflector, and an isolation choke boundary as described herein may be configured to improve the overall isolation between the two parabolic reflectors (between two parabolic antennas). For example, the overall isolation of radio frequency signals between the first and second parabolic reflectors including the isolation provided by the isolation choke boundary may be greater than about 10 dB, 20 dB, 30 dB, 40 dB, 50 dB, 60 dB (e.g., greater than about 65 dB, greater than about 70 dB, greater than about 75 dB, greater than about 80 dB, etc.). For example, the overall isolation of radio frequency signals between the first and second parabolic reflectors including the isolation provided by the isolation choke boundary may be greater than about 70 dB.

As mentioned, the isolation choke boundary may include ridges. The ridges may run along the length of the isolation choke boundary (e.g., in the direction of the outer rim of the reflector(s)). The ridges may be the same heights or different heights. In some variations, the ridges alternate in height. For example, in the isolation choke boundary adjacent ridges in the isolation choke boundary may be separated by a channel; in some variations the depth of each channel may be greater than the width (the distance) between adjacent ridges. The depth between channels may be uniform, or it may be different; in some variations the depth within a channel may vary.

For example, an isolation choke boundary may be configured to extend along the curved boundaries of two adjacent shrouds or parabolic reflectors and may include a plurality or ridges running adjacent to each other; the ridges may be arranged so that they follow the perimeter of both openings of the parabolic reflectors. The choke boundary may be configured so that the plurality of ridges are arranged along a sinusoidal curve, e.g., so that either the tops or bottoms of adjacent ridges form a sinusoidal curve across a diameter of the isolation choke boundary. Thus, in some variations, the ridges of the isolation choke boundary are arranged along a sinusoidal curve. Any of the isolation choke boundaries described may have a variable cross-sectional profile in a transverse section through the choke. Alternatively, in some variations the choke has a non-symmetric rib height profile, and thus symmetry is not a requirement.

Thus, as mentioned, at least some of the ridges of the isolation choke boundary may comprise different heights; adjacent ridges of the isolation choke boundary may comprise different heights and may be separated by channels having different depths. The channels between adjacent ridges of the isolation choke boundary may be separated from each other by some fraction of the wavelengths. The channels between adjacent ridges of the isolation choke boundary may have a depth that is about ¼ of the center frequency used by the apparatus. For example, for an apparatus adapted to transmit between about 5.4 and about 6.2 GHz, the depth(s) of the channels in the isolation choke boundary may be between about 13.89 mm and about 12.1 mm; for apparatuses adapted to operate at between about 4 GHz and about 8 GHz, the depth(s) of the channels in the isolation choke boundary may be between about 18.8 mm and 9.4 mm deep.

Figure 3B:
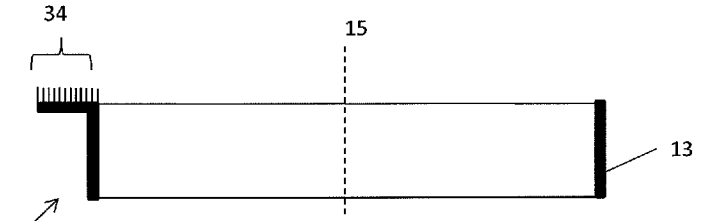
FIGS. 3B-3D illustrate sectional side views of variations of the choke shroud of FIG. 3A having a choke boundary region that only partially encircles the shroud portion of the choke shroud. A radome is not shown (but may be included)
Figure 3C:
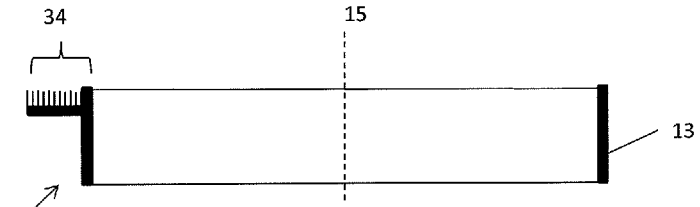
Figure 3D:
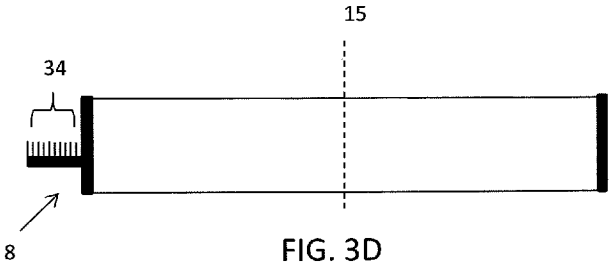
Figure 3A:
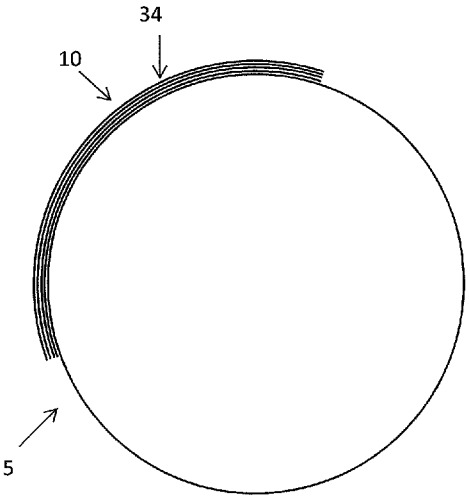
FIG. 3A is a top view (showing the distal face) of another variation of a choke shroud that can be mounted on an antenna reflector.

In any of these examples, the choke shrouds described herein may include a choke portion that extends only partially around the perimeter of the side wall of the shroud portion, as shown in the top view of FIG. 3A. FIG. 3A shows another choke portion 34 that can be mounted on an antenna reflector as part of the choke shroud. Also in this example, as in others examples, the choke boundary regions 34. Choke boundary regions may have any shape or orientation, including those described herein (e.g., relative to other choke boundaries positions). For example, choke boundaries regions may include ridges and channels. Ridges and channels may be relatively uniform in height and depth or may vary, etc. A portion of a choke boundary may overlie a (lateral) portion of a shroud and another portion of a choke boundary may be distal to the shroud (such as shown in FIG. 2B).

Figure 4B:
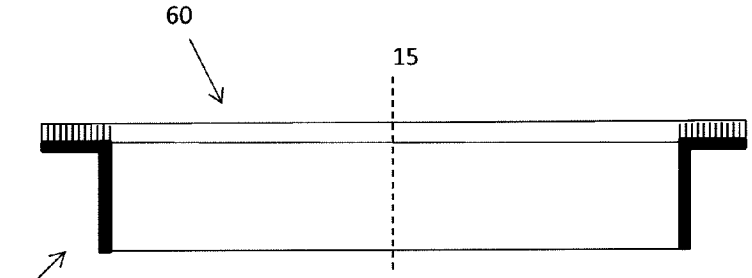
FIGS. 4A-4C illustrate top, side sectional, and side perspective views, respectively, of one variation of a choke shroud including a radome covering the distal end, including the choke boundary region.
Figure 4C:
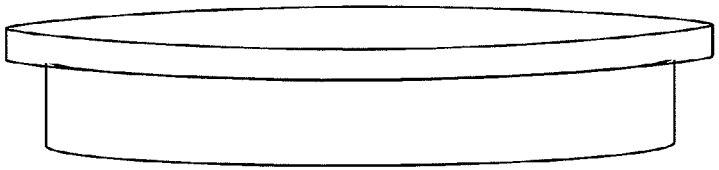
Figure 4A:
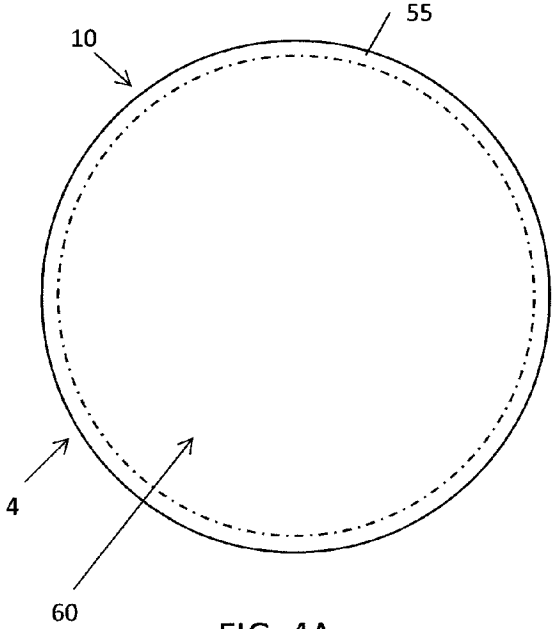

FIGS. 4A-4C illustrate a variation of a choke shroud including a radome. In this example, the choke shroud apparatus may be mounted on an antenna reflector with a choke boundary encircling or partially encircling the shroud. FIG. 4A shows a choke shroud 4 with cylindrically shaped shroud region (side wall 8) that can attach to a reflector at a proximal end. The central axis 15 of the choke shroud is shown in FIG. 4B. The apparatus include a radome 60. In FIGS. 4A-4C, the radome covers the entire outer distal surface, including the distal end opening through the choke shroud, and the choke boundary region 55. Choke boundary region 55 is mounted on shroud region (e.g., shroud side wall 8) and encircles it. Although shown as a right cylinder, the shroud region may also not be a right cylinder. As mentioned, the isolation choke boundary portion may extend only partially around the opening of a shroud or parabolic reflectors. For example, the isolation choke boundary may extend partially around an opening of the choke (or of the reflector).

The isolation choke boundary region may extend along the edge(s) of the shroud portion (e.g., around the shroud or around the shroud end) or around the reflector mouth less than 180 degrees, between about 30 and about 180 degrees around the shroud, shroud end, or reflector mouth (e.g., at least about 40 degrees, at least about 50 degrees, at least about 51 degrees, at least about 52 degrees, at least about 53 degrees, at least about 54 degrees, at least about 55 degrees, etc.). In any of these variations, the isolation choke boundary may overhang an outer edge of the shroud portion or parabolic reflector wall. For example, a shroud may be relatively narrow and the choke boundary may overhand the reflector and the shroud.

Figure 5A:
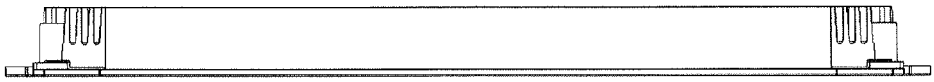
FIGS. 5A-5C show side, tope perspective and end views, respectively, of a portion of a choke boundary region that may be mounted to a shroud portion.
Figure 5B:
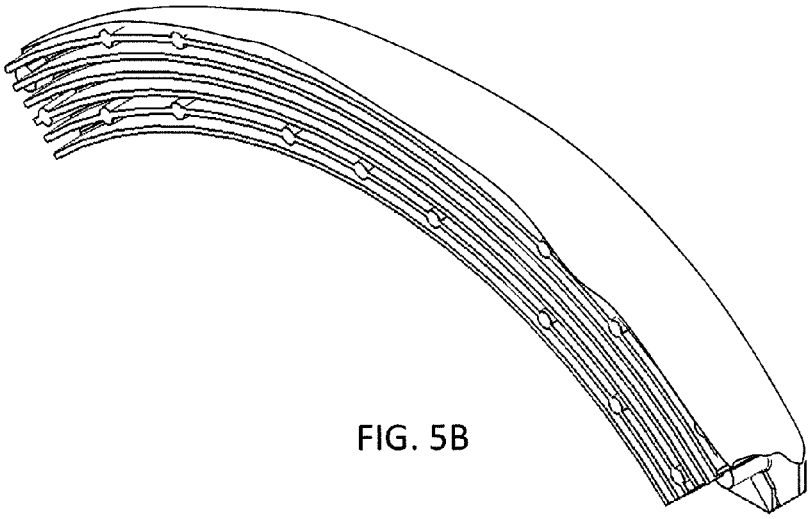
Figure 5C:
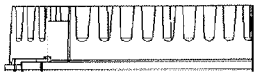

FIGS. 5A-5C shows examples of a region of a choke boundary portion. In this example, an optically absorptive material (not shown) maybe placed on the shroud wall proximal to the choke boundary, but it could also be located elsewhere instead or in addition. For example, optically absorptive material could be lateral or distal to the choke boundary region, on part or all of the shroud region. Optically absorptive materials could be on or inside a shroud or could be on part of a choke, such as choke wall. The optically absorptive material may serve to reduce stray or unwanted radiation to or from an antenna to which the choke shroud is attached.

Figure 5D:
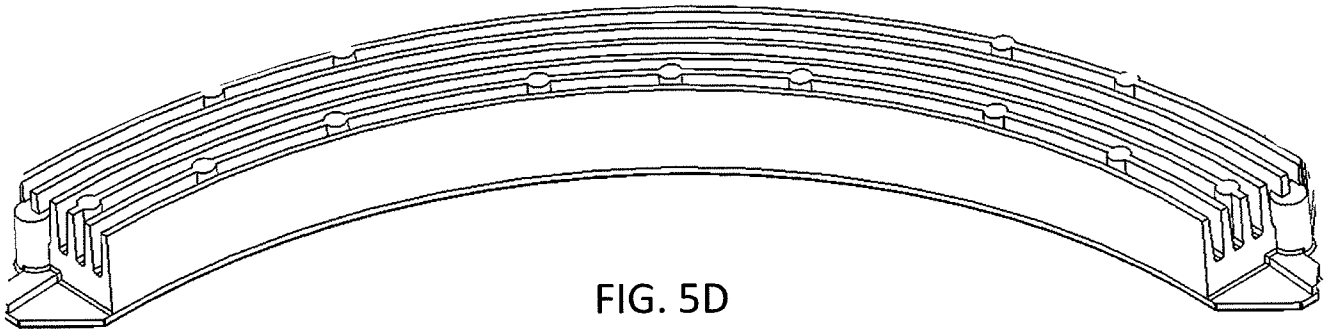
FIG. 5D is a front perspective view of the choke boundary portion shown in FIGS. 5A-5C.
Figure 5E:
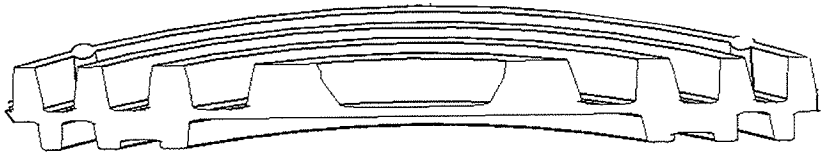
FIG. 5E is a partial section through the view of FIG. 5D.

In FIGS. 5A-5C, the choke boundary region is shown to have a plurality (e.g., more than 3, more than 4, more than 5, more than 6, more than 7, more than 8, more than 10, etc.) of ridges; the maximum number of ridges is constrained by the space considerations (e.g., how big the diameter of the choke shroud can be). In general, the choke shroud should have between about 3 and about 40 ridges, e.g., 5-40 ridges, 10-40 ridges, 10-30 ridges, etc. FIG. 5D shows a side view of a portion of a choke boundary region that may be mounted (or integrally formed with) a shroud region. In FIG. 5D, the ridges are all approximately the same height and width, and are arranged concentrically adjacent to each other. FIG. 5E is a cross-section through the portion shown in FIG. 5D.

Figure 6:
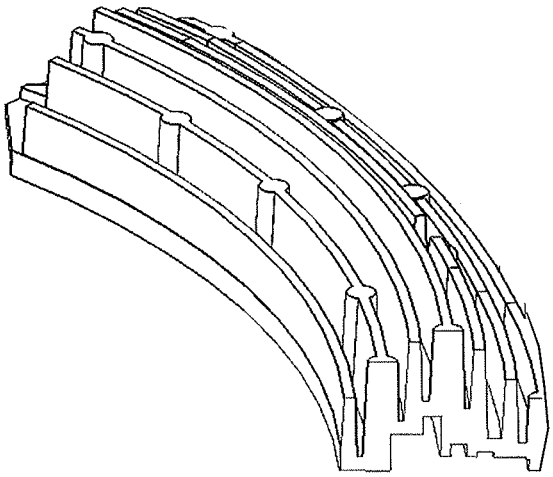
FIG. 6 is a partial section through an alternative variation of a choke boundary region of a choke shroud, having ridges of different heights and channels of different depths.

FIG. 6 shows another example of a choke region that may be mounted to a shroud portion. In this example, the choke boundary region is formed of a plurality (e.g., 7) of ridges that are arranged to extend distally (relative to the central axis of the choke shroud) different lengths. Thus, the ridges may have different sizes, or may be approximately the same sizes, but arranged on a curved (e.g., sinusoidal) surface, as shown in FIG. 6.

Figure 7:
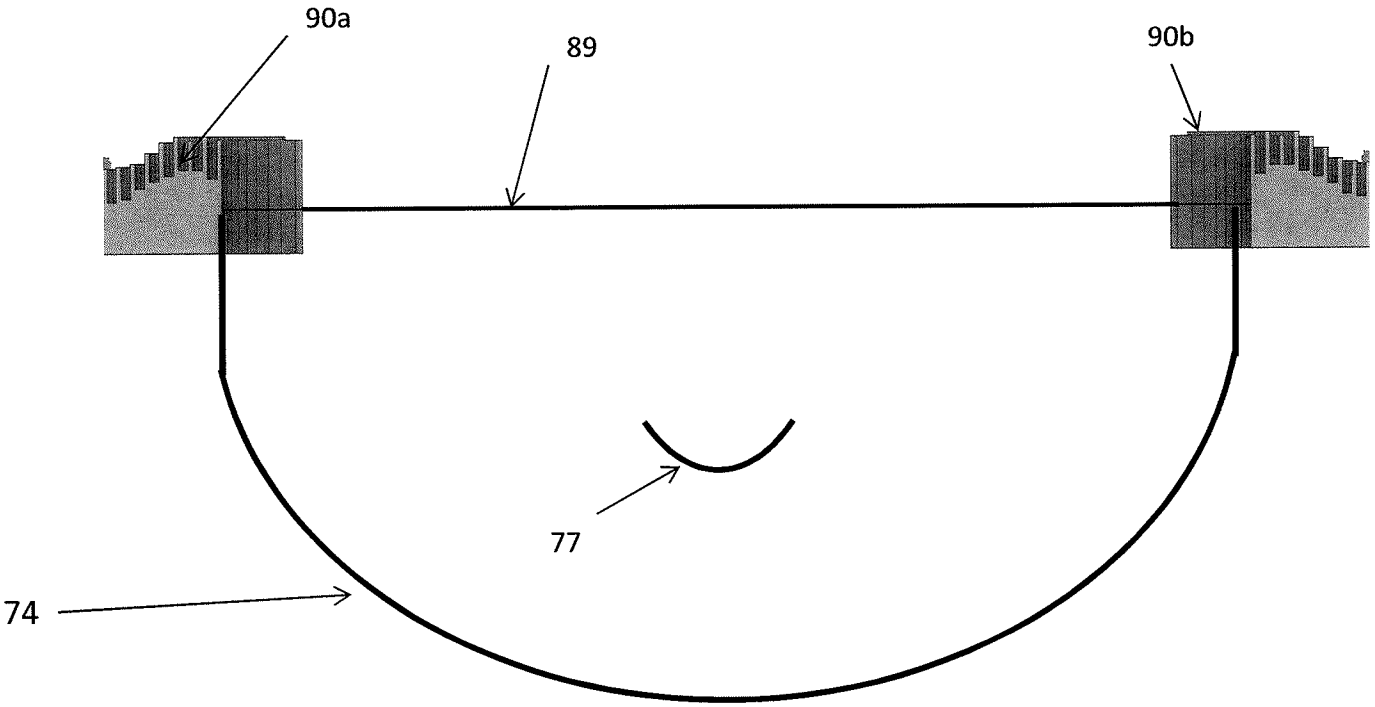
FIG. 7 schematically illustrates the operation of a choke shroud within a radio device having a transmission antenna and a receiving antenna.

In operation, the choke shroud acts to attenuate RF signals to/from the parabolic reflector that are off-axis (e.g., lateral). For example, FIG. 7 shows a side-view through a cross-section of an antenna with a choke shroud apparatus attached. The choke boundary region is cut in this section and shown as first choke boundary section 90*a* and second choke boundary section 90*b*. Radome 89 may be mounted over the distal opening into the shroud. A radome may be useful for providing protection to the antenna system. The radome may allow electromagnetic radiation (e.g., radio waves) to pass through but provides a barrier to other material. For example, a radome may provide a mechanical barrier by keeping materials such as air (wind), animals, debris, dirt, etc. from passing into the antenna system (e.g., into the choke shroud and/or reflector or an internal space defined by the reflector). A radome may function by preventing damage to the antenna system. A radome may be mounted (or configured to be mounted) to a shroud in a fixed relationship. A radome may be mounted or may be configured to be mounted to a shroud at any location. For example, a radome may be mounted at a first (proximal) end of a choke shroud (e.g., a shroud end configured to be mounted to a reflector), but more commonly may be mounted to a second (distal) end of a shroud (e.g., the shroud end that is not configured to be mounted to a reflector 74). As indicated above, a shroud may be mounted (or configured to be mounted) to a reflector in a fixed relationship and a radome may be mounted (e.g., via a shroud) in a fixed relationship to the reflector. A radome may cover some or all of an opening of an antenna reflector or a shroud. An O-ring may be used to secure the radome to the back of a lip of a reflector or a shroud. An extension of an O-ring may seal the radome to the back of the isolation choke. In some variations of a choke shroud apparatus, the first shroud region end is open and the second end comprises a radome mounted to the choke shroud and configured to prevent material from entering an internal space defined by the reflector when the choke shroud and radome are mounted on the reflector. A radome may substantially cover the entire second end of a choke shroud. Antenna components within the reflector (e.g., feed 77) may also be covered by the choke shroud. In some variation the choke shroud extends the distal-facing opening of the reflector allowing the radome to be positioned flat over the feed.

As mentioned above, in general, the dimensions of the choke region, such as the number, height, width, spacing, etc. of the ridges (and channels) may be selected and/or optimized for attenuation of a particular frequency (range) of an antenna system. For example, the depth between the ridges may be approximately ¼ wavelengths of the wavelengths used by the apparatus. In variations in which the apparatus is configured to transmit and receive between 4 GHz and 8 GHz, the depths between adjacent ridges may be between about 18.8 mm and 9.4 mm (e.g., centered around 13 mm); in variations in which the apparatus is configured to transmit/receive in the 5.4 GHz to 6.2 GHz range, the depth may be between about 13.9 and 12.1 mm. The ridges may be arranged to minimize edge diffraction and reduce the energy communicated between the adjacent transmission and receiving antenna dishes. As described in more detail below, an isolation choke boundary region may be configured so that the range of frequencies isolated is adjustable. For example, an isolation choke boundary region maybe adjustable to adjust the height(s) of the ridges.

A choke boundary region may be mounted to (or at least partially over) the outer edges of a shroud region. In this variation, the choke boundary region may overhang into the distal opening of the shroud region. The choke boundary region may have, for example, more than 12 ridges. The ridges may have a pitch that is less than about 0.35 inches. The ridges may be arranged to follow the curvature of the mouth of a reflector. The ridges may be separated by channels. The separation of the ridges (e.g., the width and/or depth of the channels) may be constant or varied. In some variations the height of the ridges may be varied. For example, adjacent ridges may have different heights (going from higher to lower, or alternating high/low, etc.) extending "up", out from of the plane of the mouth of the reflector.

The arrangement of the ridges and channels may also be seen in many of the examples described above. In general, a choke boundary region may be configured as a low Q structure and may integrate as many ridges as possible without substantially compromising the power of the antenna to which it is coupled.

As mentioned above in relation to FIG. 6, the ridges of a choke boundary region may be arranged so that the ridges are not in a single plane, but adjacent ridges are instead arranged in a curved (e.g., sinusoidal) or stepped pattern. For example, in the perspective view of FIG. 6, the upper surface of the choke boundary region, formed by the ridges extending laterally along the surface, is uneven. The apparent heights of adjacent ridges are uneven, as some extend further above the major plane of the choke boundary (the "top" of the choke boundary) than others. This is even more apparent in the side views shown in FIG. 7. A section though the middle of the choke is shown, illustrating the arrangement of the ridges in a curved (e.g., sinusoidal) pattern. The apparent heights of adjacent ridges are different. In some variations the spacing between the ridges may also be different, and/or the depths (e.g., between about 9 mm and 19 mm).

As mentioned above, the surfaces of the choke boundary region and shroud region may be covered by a radome. In some variations of the choke shroud apparatus, the choke region may be positioned over the lip of the shroud region and in front of (extending further than) the subreflectors of each reflector of the system, as shown in FIG. 7. In this example, the choke boundary region has a low-frequency wave profile on top of the high-frequency notch (ridged) profile. As described, this may provide an increase in the isolation of antenna reflectors (antennas) when in place adjacent or near another antenna.

In some variations, the isolation choke boundary region and/or the choke region may include an absorber (e.g., a microwave absorber) material as part of the structure. The material may act to absorb energy including energy within a frequency range relevant to the operation of the apparatus. For example, a strip or region of absorber such as microwave absorber may extend between the two antenna dishes when the choke is positioned between the two dishes. An example of a microwave material includes a polymeric material filled with magnetic particles; the particles may have both a high permeability (magnetic loss properties) and a high permittivity (dielectric loss properties). The absorber maybe a solid (e.g. magnetic) absorber and/or a foam absorber. For example, a foam absorber may be an open celled form that is impregnated with a material that is lossy at the appropriate frequencies (e.g., a carbon coating). An absorber may be held on the choke (e.g., extending along a long axis of, the choke that would be positioned between the two reflector dishes). The absorber may be any appropriate thickness, width and length, such as between about 0.5 mm and about 5 cm thick and/or wide, etc. The absorber may be shaped (e.g., may include projections, ridges, etc.) and/or may form one or more of the ridges of the choke boundary region.

Also described herein are isolation boundary (isolation choke boundary) regions that are automatically or manually adjustable to adjust the isolation frequency. For example, and isolation choke boundary may be adjustable by adjusting the height(s) of the ridges extending between the reflectors. The ridge heights may be adjusted from a particular height or range/distribution of heights based on the desired transmitting/receiving frequency band. In general, the height of the ridges may be a fraction (e.g., ¼) of the wavelength based on the band, and may be set to or centered to the center frequency of the band. For example, an operating frequency bandwidth of 5470-5950 MHz, having a center frequency of 5710 may have a height of the ridges of the choke region of (or centered around) 13.25 mm. Similarly, an operating frequency bandwidth of 5725-6200 MHz, having a center frequency of 5962.5 MHz, may have a ridge height for the choke region of (or centered around) 12.6 mm. However, if an adjustable choke region is used, the heights of the ridges may be adjusted from about 13.25 to about 12.6 if the desired band of operation is changed.

The heights of the ridges may be adjustable by mechanically adjusting the ridges so that they extend from or retract into the base of the choke. In some variations the ridges extend into and out of the base and are mechanically (and/or electrically) adjustable to various heights. The heights may be manually adjusted, e.g., using a knob or other control, including controls having pre-set heights which may correspond to desired operating bands. Any of these devices may also be automatically adjustable, e.g., so that the circuitry controlling the radio may also control and/or adjust the height of the isolation barrier ridges; if the device switches operation from one band (e.g., 5470-5950 MHz) to another (e.g., 5725-6200 MHz), then it may automatically tune, or adjust, the height of the ridges of the choke. For example, the heights of the ridges may be adjusted between about 4 mm and about 20 mm (e.g., 8 mm to 20 mm, 10 mm to 18 mm, etc.). In some variations the spacing between ridges may also be adjustable.

In general, the plurality of ridges of an isolation choke boundary region may extend past an outer edge of the shroud region and/or parabolic reflector. A choke boundary ("choke") may include any appropriate number of ridges. For example, a choke region may include at least 10 ridges or any other number as described above. As mentioned, a choke boundary region may include ridges. In some variations, a first subset of the ridges of the isolation choke boundary may follow a curvature (in the major plane of the isolation choke boundary) of an outer edge of the first shroud and a second subset of the ridges of the isolation choke boundary follow a curvature of the outer edge of the second shroud.

Any of the isolation choke boundary regions described may have a variable cross-sectional profile in a transverse section through the choke region, but may generally be symmetric about the long axis plane. Alternatively, in some variations the choke region has a non-symmetric rib height profile, and thus symmetry is not a requirement.

A radio device for transmission of broadband wireless signals described herein may include: a parabolic reflector; radio circuitry configured for transmission of broadband radio-frequency signals between about 4 and about 8 GHz from the parabolic reflector and configured for reception of broadband radio-frequency signals between about 4 and about 8 GHz by the parabolic reflector; a choke shroud coupled or coupleable to the reflector including a an isolation choke boundary region and a shroud region. The isolation choke boundary region may include a plurality of ridges extending perpendicular to the central axis of the choke shroud. The isolation choke boundary region may be configured to provide greater than 10 dB isolation of the parabolic reflector.

In some variations the radio circuitry of the apparatus is configured for transmission and/or reception of broadband radio-frequency signals between about 5 and about 7 GHz from the parabolic reflector.

Although the devices described herein are especially useful for use with radio device for transmission of broadband wireless signals for transmission or reception of broadband radio-frequency signals between about 4 and about 8 GHz, many of the features and methods of operation described herein may be used as part of other radio devices, and may therefore improve such devices, including radio devices that are configured to operate over different radio-frequency ranges. Although there may be advantages to applying the features and improvements described herein in this ("5 GHz") range, other ranges may be used. For example, features and improvements as described herein may be used in radio antennas having non-parabolic antenna dishes, or having fewer or more than the number of antennas described. Any features, elements and methods such as those described herein, including (but not limited to) the isolation choke boundary, RAD, and mounting system (e.g., quick release pole mount, etc.), may be used as part of any other antenna system.

In any of the variations described herein, more than two reflectors (e.g., parabolic reflectors) may be used, e.g., 3, 4, 5, 6, or more. Each reflector may be connected or connectable to a choke shroud.

As mentioned, any of the apparatus described herein may also include a cover (e.g., radome cover) over all or a portion of the device (e.g., the choke shroud). In general, theses device may be adapted for exterior use, and may withstand temperature, moisture, wind and/or other environmental forces.

As mentioned, the systems/devices may be configured to prevent interference between adjacent antennas (radios). For example, a parabolic reflector may be retrofitted with a choke shroud to enhance isolation from a nearby second radio device.

Figure 1F:
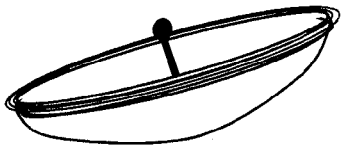
FIGS. 1E and 1F illustrate the application of another example of a signal isolation unit (having a minimal or no shroud component) to an antenna, as described herein.
Figure 1E:
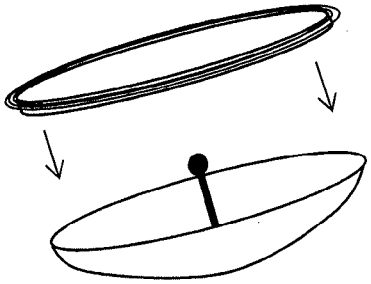
Figure 1D:
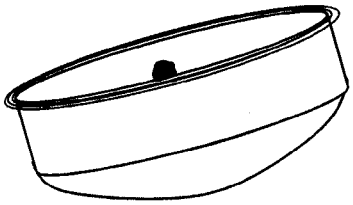
FIGS. 1C and 1D illustrate the application of one example of a signal isolation shroud (choke shroud) to an antenna.
Figure 1C:
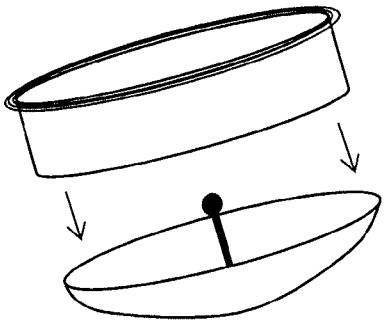
Figure 8A:
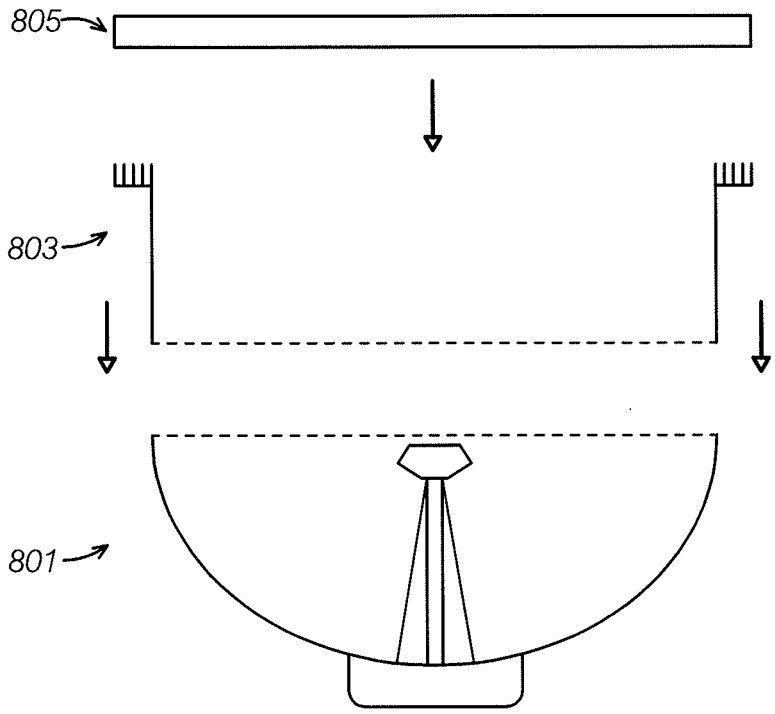
FIG. 8A is a section illustrating the application of another example of a choke shroud (and optional radome) to an antenna.
Figure 8B:
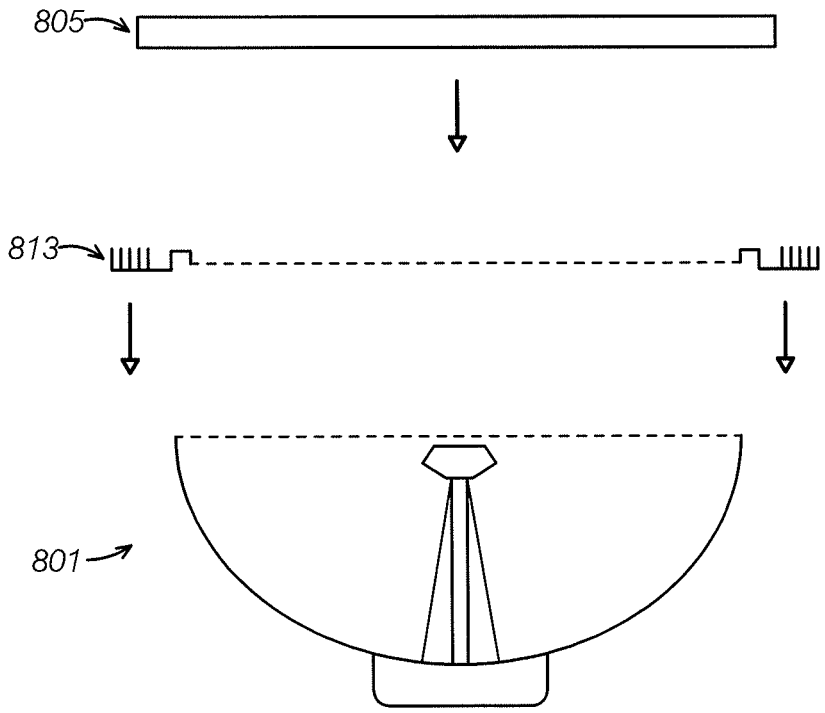
FIG. 8B is an illustration of another example of a choke shroud (also referred to as a choke or isolation unit), having minimal or no shroud component, to an antenna.

Any of the apparatuses described herein may include a shroud component of any height, or they may not include a significant shroud component. For example, FIGS. 1C and 1D illustrates a perspective view of a choke shroud attaching to an antenna. In this example, the choke shroud has a shroud component which extends the choke region above the outer perimeter of the antenna reflector. The inner wall of the shroud region may be reflective or absorptive (e.g., absorbing, such as a radio/energy absorbing coating). FIGS. 1E and 1F illustrate another variation in which the apparatus includes only a minimal, or no shroud region. Instead, the choke is applied to the outer perimeter of the antenna reflector without substantially extending the antenna by a shroud. FIG. 8A illustrates a sectional view of the application of a choke shroud 803 onto an antenna 801; an optional radome 805 may also be applied (or integrated onto the choke shroud 803). Similarly, FIG. 8B shows a sectional view of the application of a choke 813 with a minimal (or no) shroud portion onto an antenna 801, including an optional radome 810.

Figure 9B:
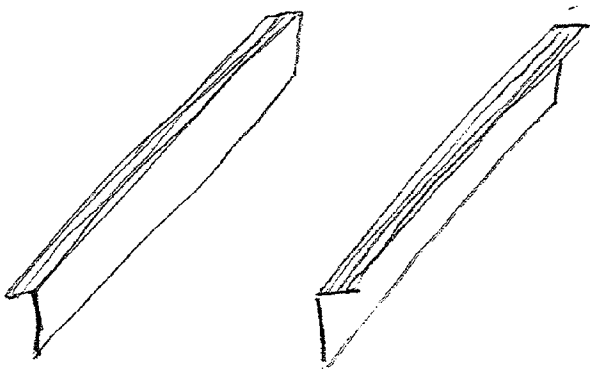
FIGS. 9B and 9C illustrate variations of choke shrouds that may be used with the sector antenna of FIG. 9A.
Figure 9C:
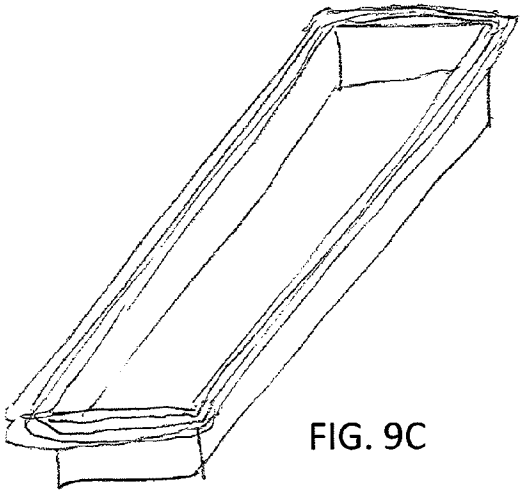
Figure 9A:
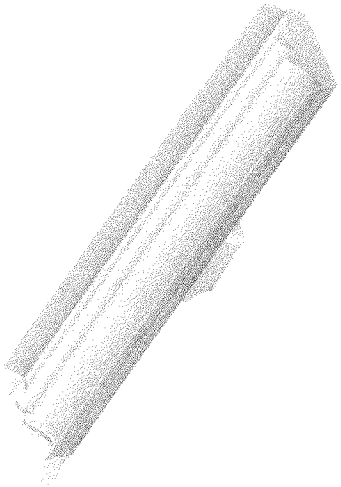
FIG. 9A is an example of another form factor for an antenna, illustrating a sector antenna, which may be used with a choke shroud (or just choke) apparatus as described herein.

Although the majority of antennas described herein are dish and/or parabolic reflector-type antennas, any appropriate antenna type may be used, including, for example, an elongate (e.g., sector) antenna, as shown in FIG. 9. In this example, a choke and/or choke shroud may be attached to the sides (e.g., the elongate sides) of the sector antenna to provide the benefits described above. For example, FIG. 9B illustrates a pair of choke shroud components that may be attached to an antenna such as the one shown in FIG. 9A. In general, any of the chokes/choke shrouds described herein may be in separate pieces or components that may be attached to the antennas. FIG. 9C shows another example of a choke shroud having a single member that fits onto an elongate rectangular antenna such as the sector antenna of FIG. 9A. Any of these examples may be modified so that the shroud portion is minimal or not present (e.g., attaching just a separate choke element to the outer perimeter of the reflector).

Figure 10A:
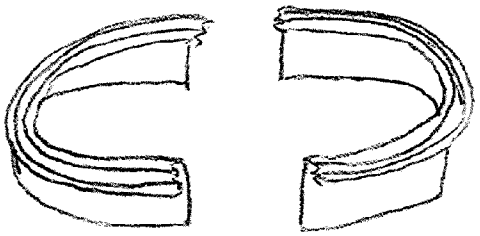
FIG. 10A illustrates an example of a choke shroud having two portions that may be joined together to form a complete choke shroud as shown in FIG. 10A (or the pieces may be used individually as partial chokes/choke shrouds).

FIG. 10A illustrates one example of a choke shroud formed of multiple pieces that are assembled onto the outer perimeter of the antenna to form the complete choke shroud (such as any of those illustrated above in FIGS. 1C-1D, 2A-2D, and 4A-4C. In this example, two rigid, or semi-rigid pieces are joined around the perimeter of the antenna reflector to form the choke shroud. In some variations (as described above in reference to FIGS. 3A-3D) a choke shroud may be configured to extend only partially around the outer perimeter of the antenna reflector. For example, either piece shown in FIG. 10A may be used by itself as a choke shroud (partial choke shroud). A partial choke shroud may be clipped onto (or otherwise attached to) an antenna reflector to provide noise reduction only in a specific direction, for example, when there is an antenna immediately adjacent in the direction that the partial choke shroud is attached.

Figure 10B:
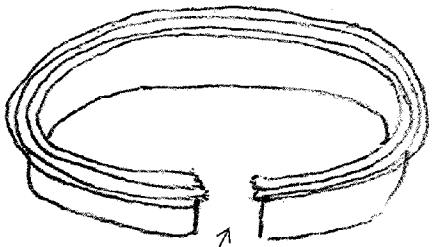
FIG. 10B is an another example of a choke shroud that is a single piece that may be fit onto an antenna having two ends that may be joined together when securing the choke shroud over the antenna.

FIG. 10 shows another example, in which the choke shroud is a single piece that is open and can be closed around the antenna reflector. In this example, the choke shroud may be partially flexible, which may aid in attaching it to the perimeter of an antenna reflector as illustrated above. The opening 1004 may be reduced (or expanded) when applying the apparatus onto the antenna. Once over the antenna, it may be locked or otherwise secured into place (e.g., using a strap, screw, clip, or other element holding the separated sides together.

Figure 11A:
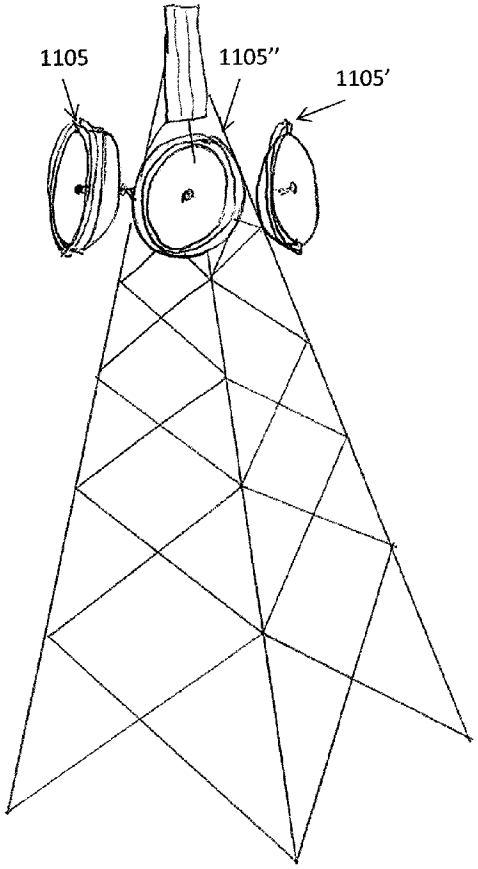
FIG. 11A schematically illustrates the use of choke shrouds on a tower (e.g., cellular tower) where a number of antennas may be positioned near each other and it would be beneficial to enhance isolation between the antennas. In this example the antennas may include a complete or partial choke or choke shroud. For illustration purposes, none of these antennas is shown with a radome covering, though such covers may be included.
Figure 11B:
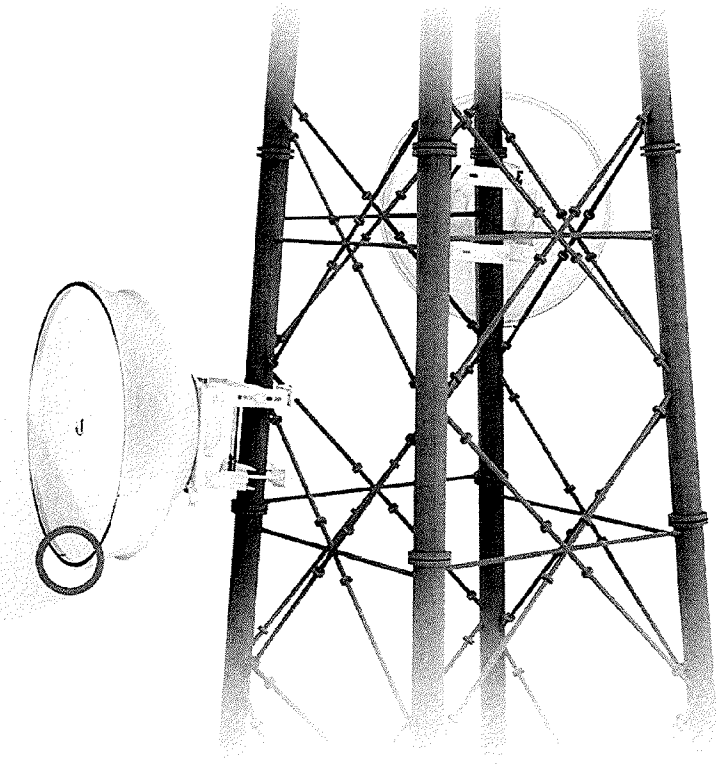
FIG. 11B shows another example of an antenna apparatus including a choke shrouds on a tower.
Figure 11C:
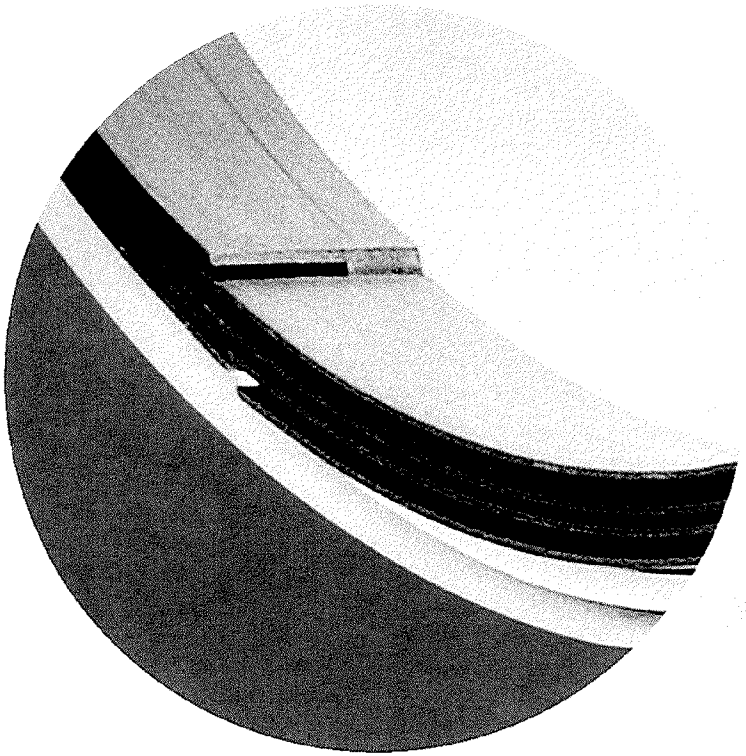
FIG. 11C is an enlarged view of the choke region of the choke shroud, showing the ridges and channels forming the choke boundary or baffle region.

The apparatuses described herein may find particular use in locations in which a number of antennas are positioned near each other, as shown in FIG. 11A. FIG. 11A schematically illustrates a tower with multiple antennae positioned near each other though oriented in different directions. This example shows a tower with multiple antennae, some of which include complete or partial choke shrouds 1105, 1105', 1105" to provide noise cancellation/enhance isolation. The choke shrouds may prevent signals from nearby antenna from interfering with transmission to/from antenna having the choke shroud, and may also minimize signals from that antenna impinging on the adjacent antennae. FIGS. 11B and 11C illustrate another example of a choke shroud attached to an antenna apparatus having a parabolic reflector and attached to a tower (FIG. 11B). FIG. 11C shows an enlarged view of the choke outer edge (mouth) region of the shroud attached to the antenna shown in FIG. 11B.

Figure 12C:
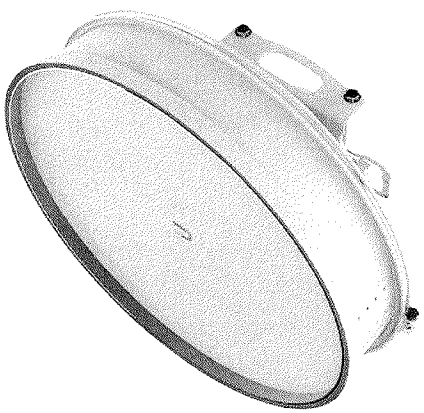
FIGS. 12A-12C show various front perspective views of an example of a choke shroud that may be coupled to an apparatus such as a parabolic reflector of and antenna.
Figure 12B:
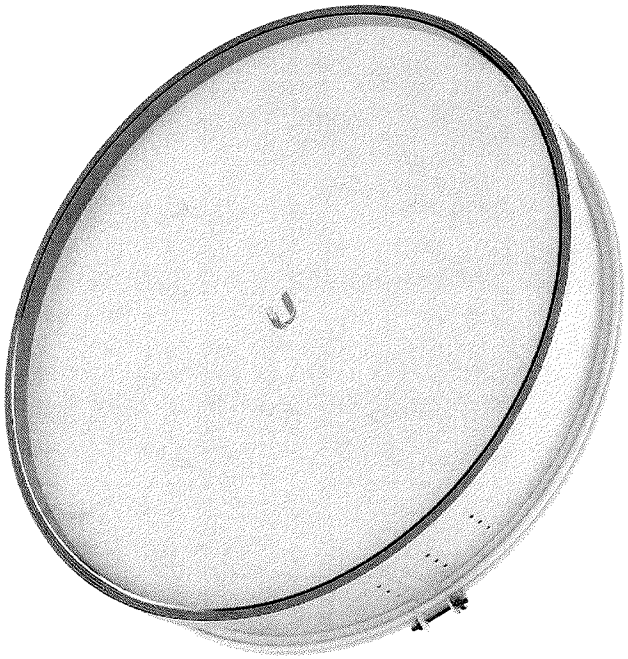
Figure 12A:
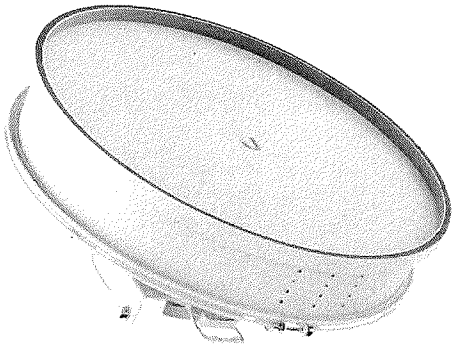
Figure 13A:
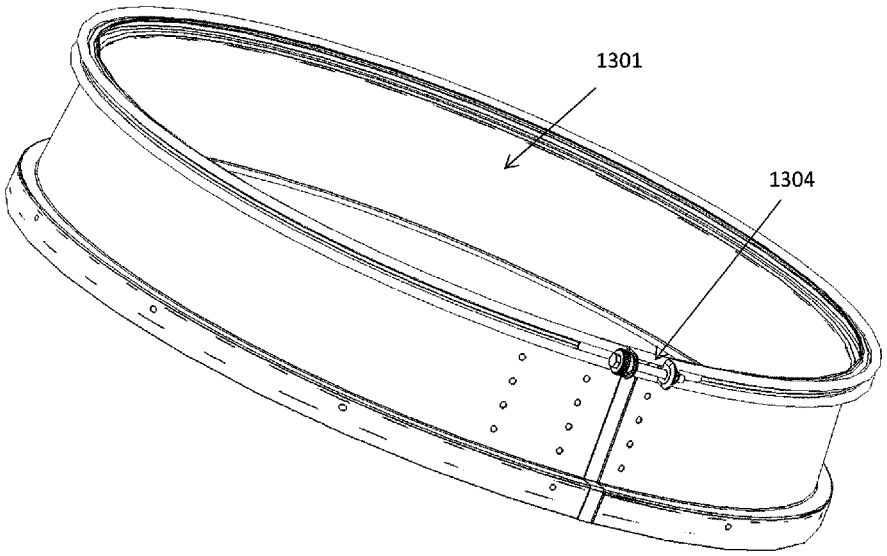
FIG. 13A illustrates another variation of a choke shroud as described herein. In this example, the shroud (choke shroud) may be secured by a tightening nut (or other constricting and/or retaining mechanism) to the open mouth of an antenna reflector.
Figure 13B:
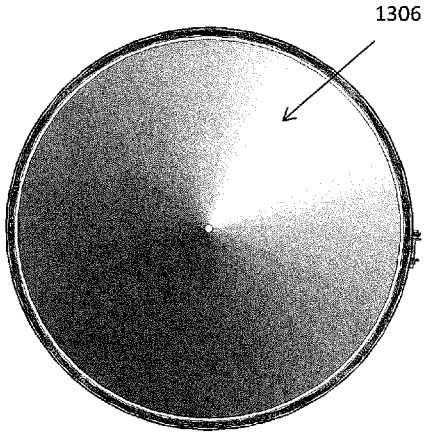
FIGS. 13B and 13C show front and back views, respectively, of the choke shroud (including a cone-shaped radome covering the front surface) of FIG. 13A.
Figure 13C:
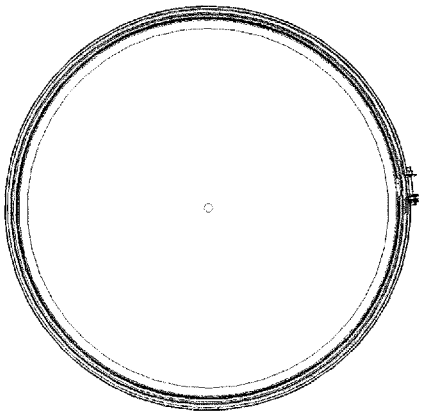
Figure 13D:
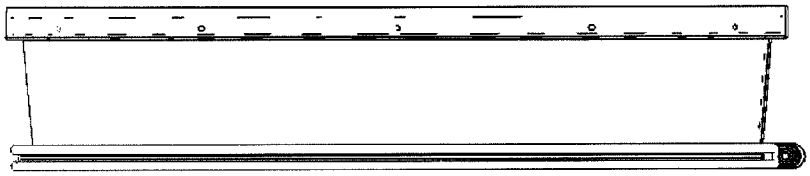
FIGS. 13D and 13E shows side views (e.g., right side and bottom views, respectively).
Figure 13E:
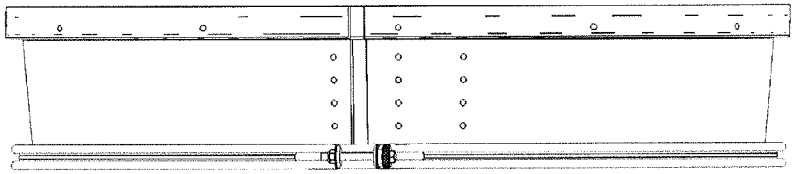
Figure 13F:
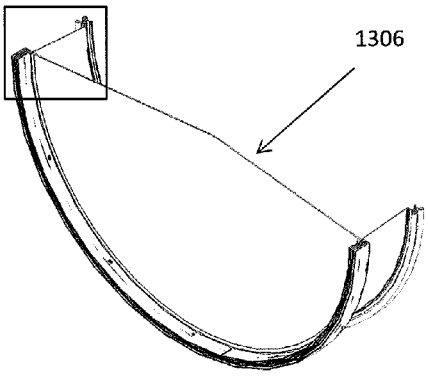
FIG. 13F shows a section through the shroud of FIGS. 13A-13E.
Figure 13G:
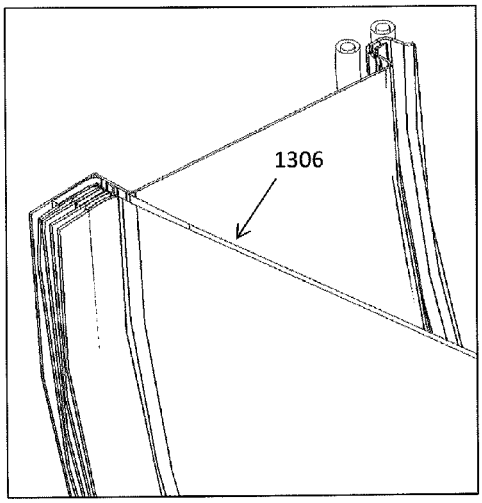
FIG. 13G shows a close-up of one portion of the shroud (including radome). In this example, the shroud of FIGS. 13A-13G includes a choke boundary, as is visible in FIG. 13G.

Another variation of a choke shroud is shown in FIGS. 12A-12C. These figures show perspective views of a choke shroud that may be coupled to an apparatus such as a parabolic reflector of and antenna. FIGS. 13A-13G illustrate another variation of a choke shroud 1301 as described herein. In this example, the shroud (choke shroud) may be secured by a tightening nut 1304 (or other constricting and/or retaining mechanism) to the open mouth of an antenna reflector. In this example, the choke shroud includes a radome (cover) that is mostly RF transparent, or allows RF energy to pass through relatively attenuated; however the radome 1306 may be shaped to enhance the performance of the isolation choke shroud. For example in FIG. 13B, as shown in the profile of FIG. 13F the radome concave inward, and/or cone-shaped (in towards the parabolic reflector). The body of the shroud may also be tapered in any of the shrouds described herein, as shown in FIGS. 13D-13E, with sidewalls slightly angled away from the midline of the apparatus, and not parallel as in other examples. The angle away from the parallel may be small (e.g., between about 0.5 degrees and 20 degrees, between about 0.5 degrees and 15 degrees, between about 0.5 degrees and 10 degrees, etc.).

Figure 14A:
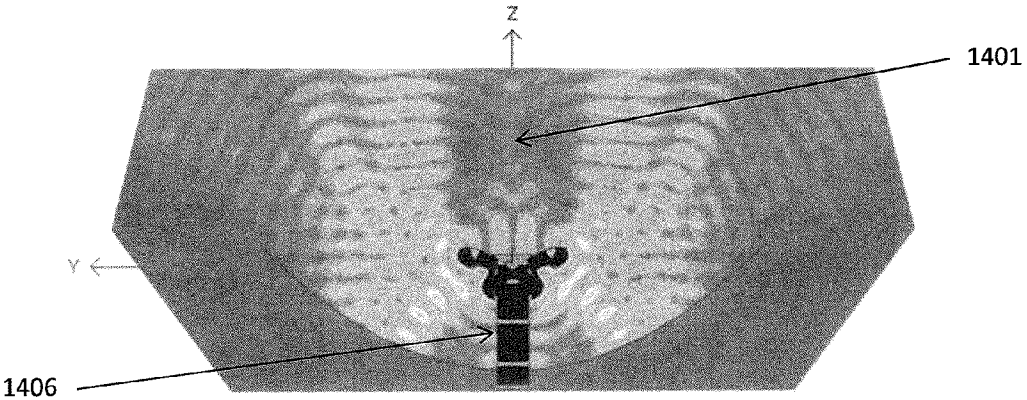
FIG. 14A shows a power profile for signals emanating from a parabolic reflector without a shroud.
Figure 14B:
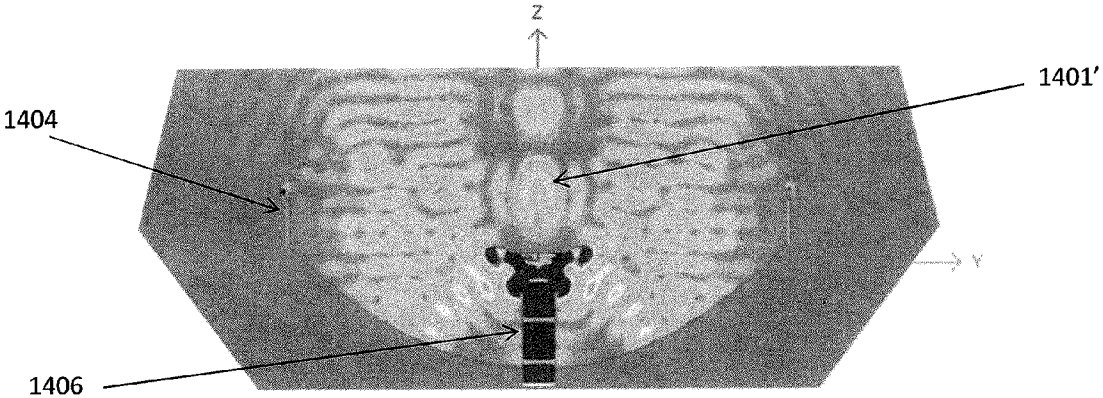
FIG. 14B shows a power profile for signals from the same parabolic reflector with a shroud such as the one illustrated in FIGS. 13A-13G, showing an improvement in the energy (signal) directed in the z direction out of the apparatus.

The performance of an antenna/radio apparatus including any of the choke shrouds described herein may be generally better than the performance without the shroud, in particular in isolating the beam energy from the apparatus. FIG. 14A shows a power profile for signals emanating from a parabolic reflector without a shroud, and FIG. 14B shows a power profile for signals from the same parabolic reflector with a shroud 1404, showing an improvement in the energy (signal) directed in the z direction out of the apparatus. The midline region 1401 with the shroud has a greater signal energy while off-midline regions have a lower energy.

Figure 15A:
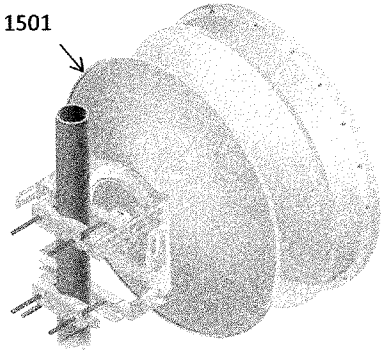
FIGS. 15A-15F illustrate one method of attachment of a choke shroud as described herein onto a parabolic antenna dish.
Figure 15B:
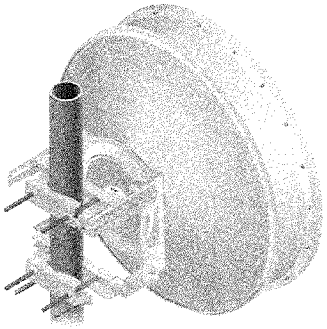
Figure 15C:
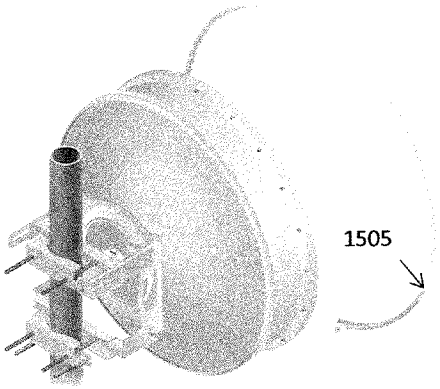
Figure 15D:
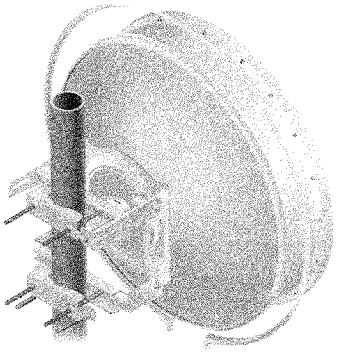
Figure 15E:
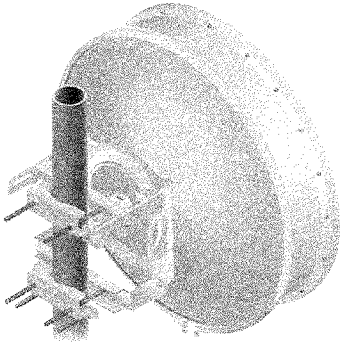
Figure 15F:
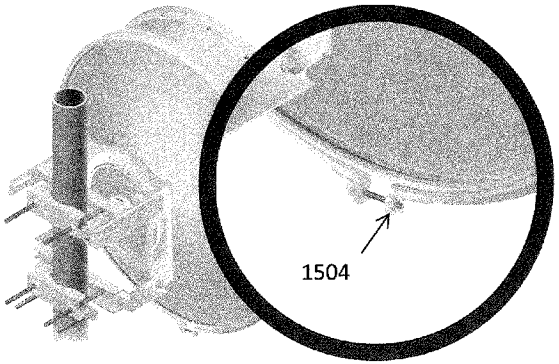

FIGS. 15A-15F illustrate attachment of a shroud to a parabolic reflector, as described above. In this example, the shroud is a circular/tubular structure with a slit down one side, allowing it to be expanded and placed around the open mouth of the parabolic reflectors 1501 as shown in FIG. 15A. Once in place, a securing hoop 1505 may be positioned over the attachment site, as shown in FIGS. 15C-15E and the hoop may be tightened and locked into place by securing a screw 1504.

Reflectors with Integrated Shrouds

Also described herein are parabolic reflectors integrated with a shroud (which may be a choke shroud or a shroud without a choke). Any of these isolation reflectors may be referred to herein as integrated reflectors and shrouds, reflectors with integrated isolation shrouds, or parabolic barrel reflectors. In general, these apparatuses include a parabolic reflector region having a first function of curvature that is parabolic, that transitions to a second, region distal to the first parabolic region that is either parallel-walled, or has walls that are nearly (e.g., within +/−10 degrees of) parallel, giving them a roughly barrel-like extension from the parabolic region.

In particular, described herein are parabolic antenna reflector apparatuses including a reflector or body portion that is integrally formed of a parabolic reflector section (or parabolic reflector portion) and a shroud portion (or shroud section) that may be formed to be different regions of the same component (body). This integrated body may be formed of a single piece of material, such as by deep drawing of a sheet of metal. Deep drawing may refer to a fabrication method in which a sheet metal blank is radially drawn into a forming die by the mechanical action of a punch. The process is considered "deep" drawing when the depth of the drawn part exceeds its diameter. This may be achieved by redrawing the part through a series of dies.

The parabolic reflector section typically has a central axis of symmetry (e.g., in the direction of the distal mouth of the reflector section. This distal mouth region may be a circular opening perpendicular to the central axis of symmetry. The axis of symmetry 1605 of a parabolic reflector section 1603 is illustrated in FIG. 16B, showing one example of a parabolic antenna reflector apparatus having an integrated (unitary body) with a parabolic reflector section 1602 that is continuous with a shroud portion 1607.

In general, a shroud portion may extend distally from the circular opening of the parabolic reflector section. The distal opening of the shroud portion is angled relative to the axis of rotation. This means that the wall of the shroud portion is higher on one side of the shroud portion than on an opposite side, and the distal opening of the shroud portion typically forms a plane that is angled relative to the central axis (the axis of symmetry). For example, the shroud portion may have a distal opening forming a plane that is at an angle of between 0.5 degrees and 20 degrees (e.g., between about 0.5 and 15 degrees, 0.5 and 10 degrees, 1 and 15 degrees, 1 and 10 degrees, etc.) relative to a plane that is perpendicular to the axis of symmetry. In some variations the radome may be non-flat (e.g., conical, having a non-uniform thickness, etc.). The radome is typically a protective cover that is relatively transparent to the RF energy transmitted/received by the apparatus. Thus, a radome may be constructed of material that minimally attenuates the electromagnetic signal transmitted or received by the antenna. As mentioned, any of the apparatuses described herein may include a radome. For example, in the parabolic antenna reflector apparatuses described herein, the radome may be a flat and may cover the distal opening of the shroud portion, covering the inside of the shroud portion at the angle.

The parabolic antenna reflector apparatuses described herein may generally be adapted for use with an integrated radio transceiver and feed. For example, the parabolic reflector portion of the body may include a central opening having a diameter of greater than 3 cm (e.g., sufficiently large to permit passage and/or hold the integrated radio transceiver and feed hosing as described in greater detail below. The parabolic antenna reflector apparatus may also include a holder or housing mounted on a proximal side of this central opening so the central opening is continuous with an inner chamber within the holder, wherein the inner chamber comprises a coating of a radio-frequency (RF) shielding material. The inner chamber is generally configured to hold and/or secure the integrated radio transceiver and feed so that it extends into the main body of the reflector (e.g., into the parabolic reflector region and the shroud portion). The inner chamber of the holder may include one or more tracks or channels (e.g., extending along the inner length in the direction of the axis of symmetry when mounted to the back/proximal side of the parabolic reflector portion. These channels maybe sized and shaped to secure the housing of an integrated radio transceiver and feed. In general, the inner chamber of the holder may be configured to secure an integrated radio transceiver and feed so that the integrated radio transceiver and feed is aligned with the central axis of symmetry.

The holder is generally configured to prevent transmission of RF energy out of the central opening, or from the back of the integrated radio transceiver and feed. Thus, the holder may be coated, plated, or formed of an RF attenuating or absorbing (or reflecting) material that prevents transmission of RF energy out of the holder. For example, the holder may be plated with copper and nickel.

As mentioned above, any of these parabolic barrel reflectors may be specifically adapted for use with an integrated radio/feed, as described, for example, in U.S. Pat. No. 8,493,279, and described below. Thus, the apparatuses described herein may include a rear holder (which may also be referred to as a receiver or holder) for the rear (proximal) portion of the integrated radio/feed. The rear holder may be secured, e.g., by slotted locking mechanism, screws, or the like, including by supporting between the base of the parabolic region of the reflector and a mount attached thereto, to the back of the parabolic barrel reflector, so that an integrated radio/feed that passes through the back of the reflector may be securely (and in a fixed orientation) held within the reflector. The inside, outside, or both of the rear holder may be made from or coated with a material that reflects and/or attenuates RF energy, to prevent transmission from the behind the reflector. The reflector itself may have a large central opening through which the integrated antenna/feed passes and one or more securing areas. The holder may also include a door or closure for passing a cord or cable (e.g., connecting to the transceiver circuitry) for signal(s) transmitted using the apparatus.

In any of the shrouds, including in particular the integrated parabolic reflectors with integrated shrouds (parabolic barrel reflectors) described herein, the mouth or distal opening of the shroud portion may form a plane that is off-axis from the midline of the apparatus. This is illustrated, e.g., in FIG. 23E, described in greater detail below. Thus the feed (integrated radio transceiver and feed) may be held within the reflector at an angle that is not perpendicular to the mouth (and any radome covering the mouth). Although the direction of transmission typically follows the symmetry of the feed (integrated radio/feed), the front appears to be pointing in a different direction because of the angled mouth. Thus, rather than a 90 degree angle, the angle of the feed relative to the mouth (and any cover, e.g., radome) may be between 45 degrees and 89.9 degrees (e.g., between a first value of 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, or 89 degrees, and a second value of 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 89.5 or 89.9 degrees, where the second value is higher than the lower value).

Figure 16A:
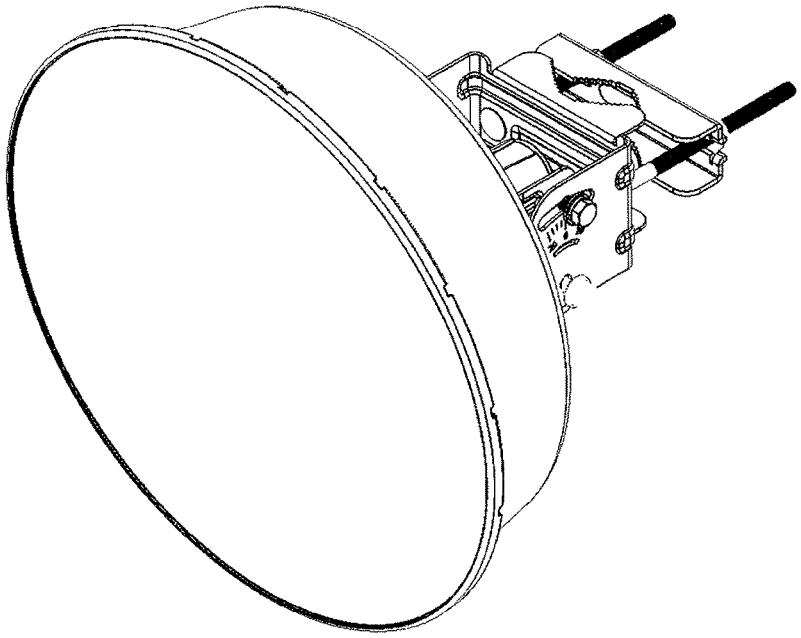
FIG. 16A illustrates one variation of an integrated antenna reflector and shroud apparatus (which may be referred to herein as a parabolic barrel reflector), covered with a radome.
Figure 16B:
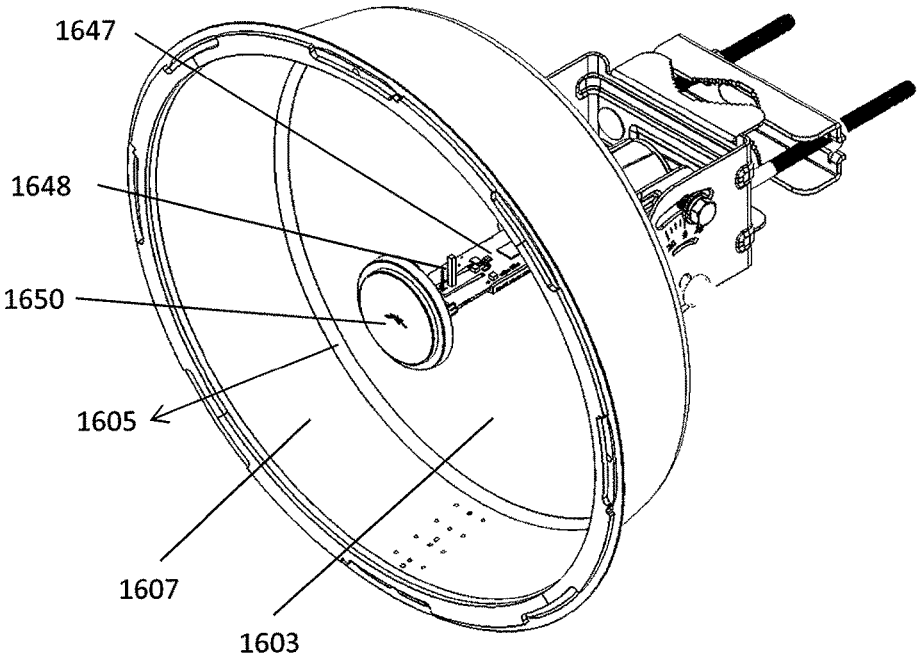
FIG. 16B shows the apparatus of FIG. 16A with the radome removed, showing the integrated radio/feed mounted within the reflector. This example has a 300 mm mouth opening diameter.
Figure 16C:
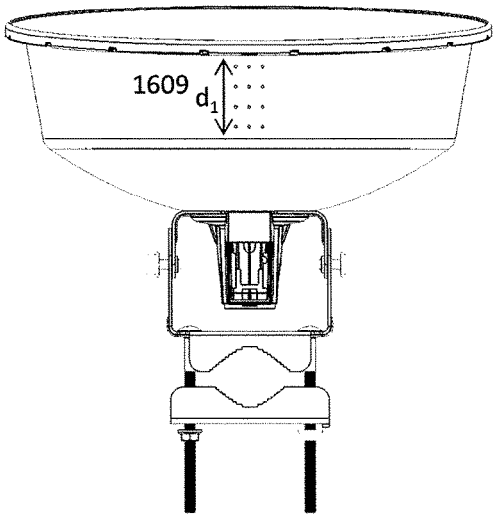
FIGS. 16C-16E illustrate bottom, top and side views, respectively of the integrated parabolic antenna reflector and shroud apparatus shown in FIGS. 16A-16B, including a mount and attached integrated radio/feed.
Figure 16D:
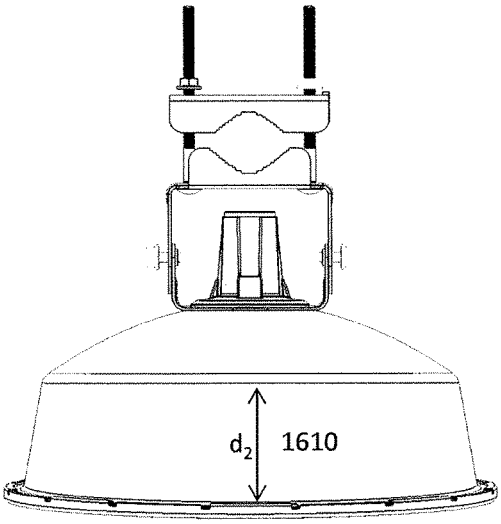
Figure 16E:
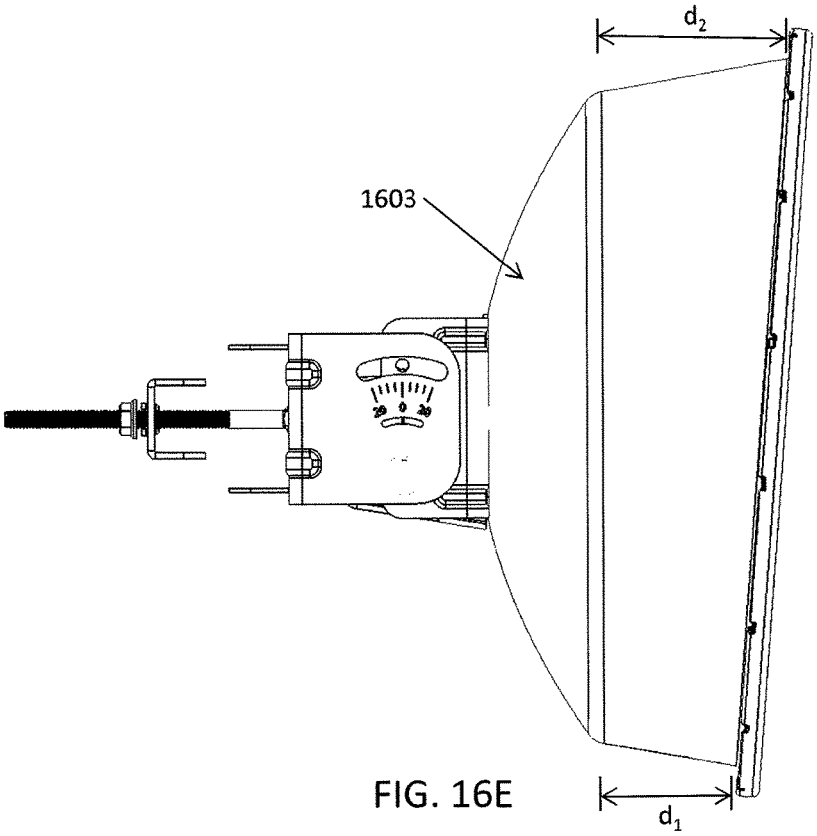

For example, FIG. 16A illustrates one variation of an integrated antenna reflector and shroud apparatus (which may be referred to herein as a parabolic barrel reflector), covered with a radome. FIG. 16B shows the apparatus of FIG. 16A with the radome removed, showing the integrated radio/feed mounted within the reflector. In this example, the integrated radio transceiver and feed is shown with the cover/housing removed, showing the feed pin 1648, sub-reflector 1650 and circuitry mounted to a common substrate 1647. The antenna assembly shown in this example has a 300 mm mouth opening diameter. FIGS. 16C-16E illustrate bottom, top and side views, respectively of the integrated parabolic antenna reflector and shroud apparatus shown in FIGS. 16A-16B, including a mount and attached integrated radio/feed. As shown in FIG. 16C (bottom view) compared to FIG. 16D (top view), the width (diameter, $d_1$) 1610 of the shroud portion 1607 at the top is much larger than the width (diameter, $d_2$) 1609 at the bottom, e.g., approximately 1.5× in this example. The angle between a plane perpendicular to the axis of rotation of the parabolic region 1603 and the distal opening of the shroud portion ($\alpha$) is typically between about 0.1 and 20 degrees; in FIG. 16E, this angle ($\alpha$) is approximately 10 degrees.

In FIG. 16E, the mount apparatus is also shown, illustrating a bolting mount that is capable of binding to a number of differ surfaces, including radio towers (e.g., poles), walls, etc.

Figure 17:
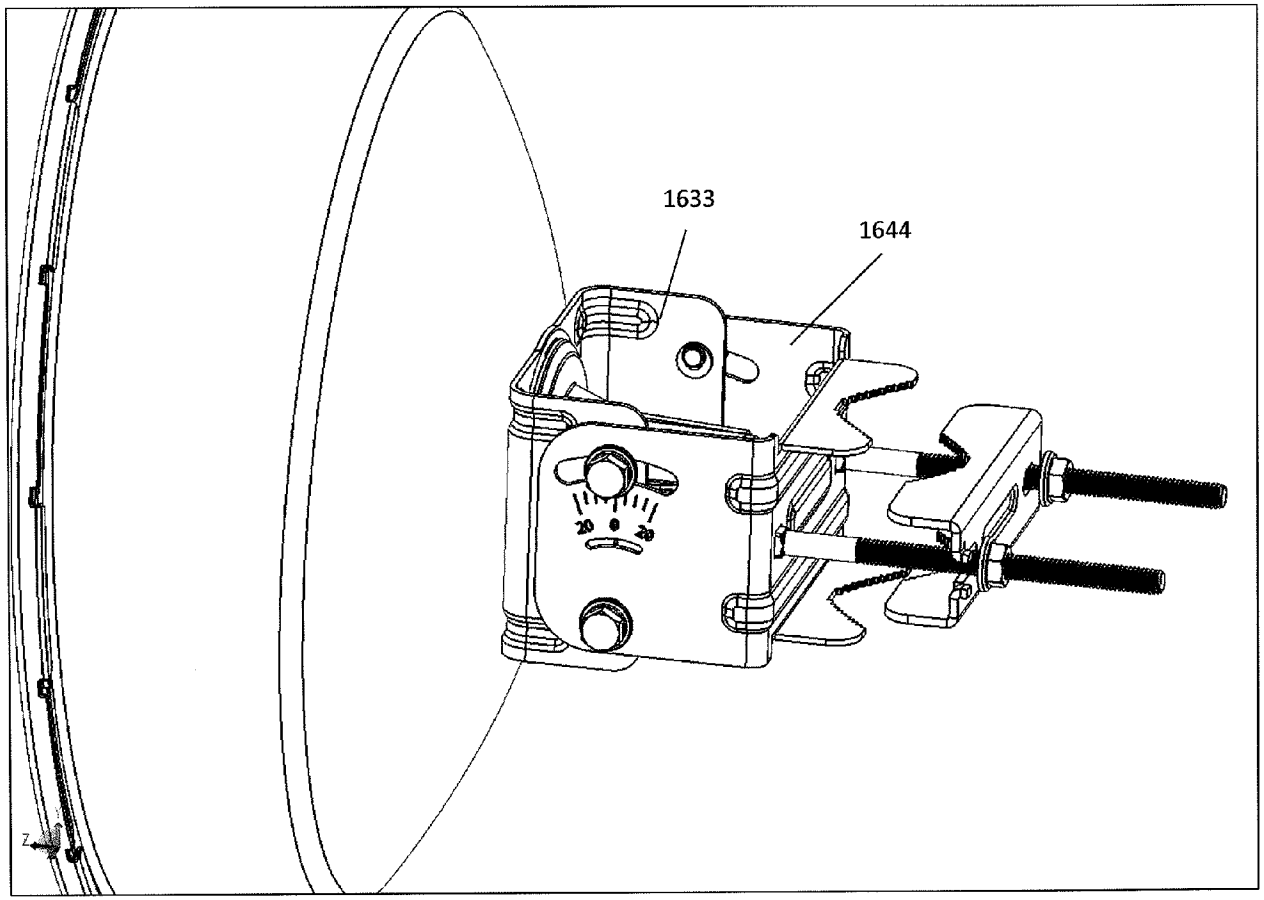

The mount shown, as will be described in further detail below, has two parts; an inner portion (between the holder for the integrated radio transceiver and feed) and an outer portion, shown over the inner portion and partially covering the holder. FIG. 17 shows a slightly enlarged view of the mount portion of the apparatus of FIGS. 16A-16E, which may be used to mount the apparatus to a surface, post, tower, or the like. The inner mount 1633 can be bolted to the outer mount 1644, which may itself include one or more mounting bolts 1654 for securing the apparatus to a pole, post, or the like.

Figure 18:
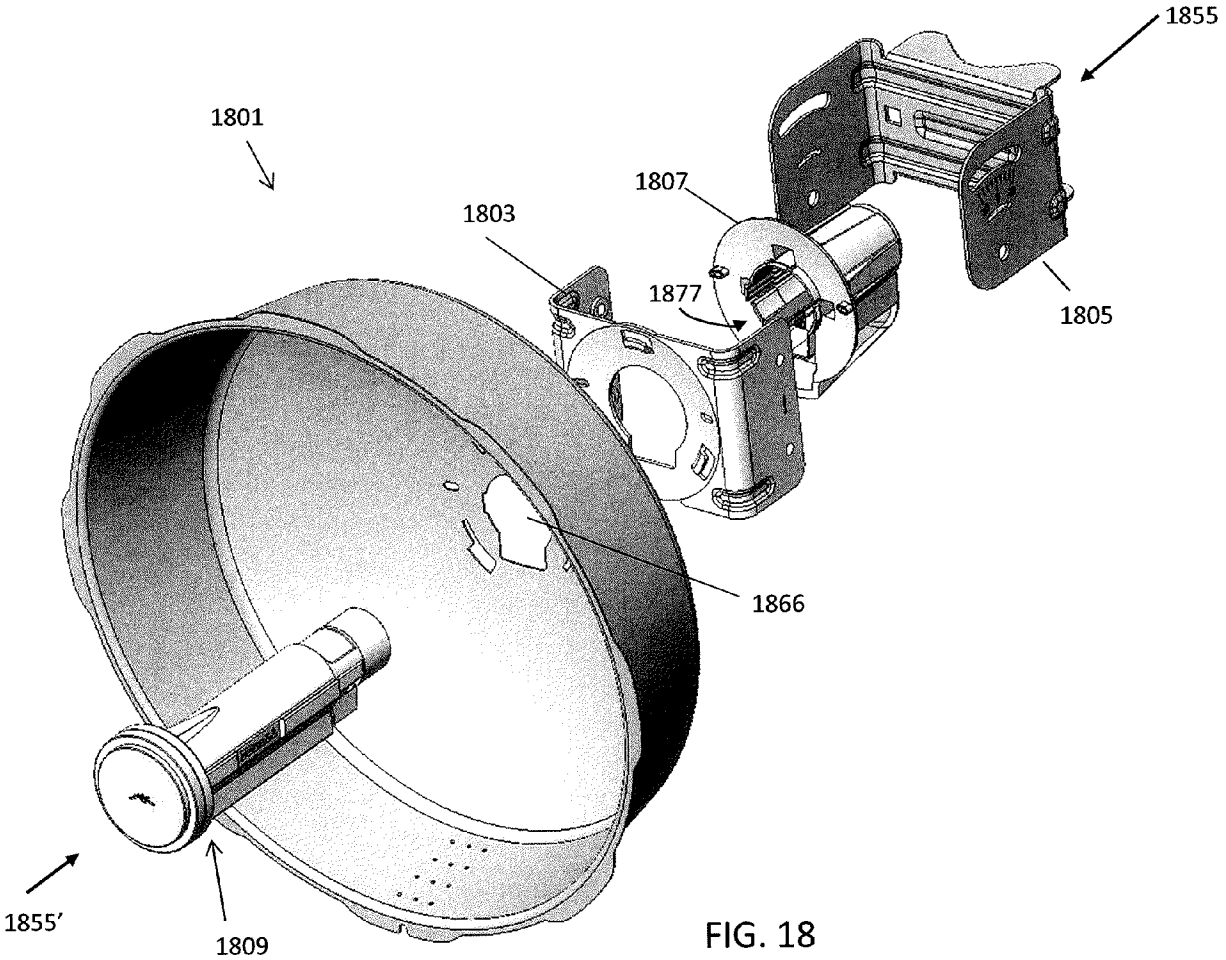
FIG. 18 is an exploded view of the apparatus of FIGS. 16A-16E, showing the component parts, including the parabolic barrel reflector, two mount portions, an integrated radio/feed, and a holder for the integrated radio/feed.

FIG. 18 is an exploded view of the apparatus of FIGS. 16A-16E, showing the component parts, including the parabolic barrel reflector 1801 (shown as an integrated piece having a first proximal parabolic reflector region, and a second distal shroud portion), a first mount piece 1803 (inner mount) and a second mount piece 1805 (outer mount), a holder 1807 for an integrated radio/feed, and the integrated radio transceiver and feed 1809. These components are all shown aligned along the axis of rotational symmetry 1855, 1855' of the parabolic reflector portion. The parabolic reflector portion includes a central opening or hole 1866. The holder 1807 may be aligned so that the inner chamber or region 1877 of the holder 1807 is aligned with an opening through the first mount piece 1803 and the central opening 1866 through the parabolic reflector portion of the integrated reflector/shroud housing 1801.

FIG. 19A shows the parabolic barrel reflector (main body 1801) of the apparatus shown in FIG. 18. This main body includes the inner, parabolic reflector portion 1823, and the outer shroud region 1824, where the shroud portion 1824 has smaller width along one side (at the bottom, near the drainage holes 1883) than at the opposite (top) side.

FIGS. 19B and 19C show the inner bracket mount 1803 and outer bracket mount 1805, respectively, of the apparatus shown in FIG. 18. FIG. 19D shows an example of an integrated radio/feed, as described herein, and FIG. 19E shows the integrated radio/feed 1901 of FIG. 19D with the cover removed (exposing the circuitry 1905, common substrate 1903, a feed pin 1913, and a sub-reflector 1909).

FIG. 19F shows a holder 1807 for an integrated radio/feed 1901 such as the one shown in FIG. 19D, keyed within the inner region 1877 to maintain the orientation of the radio/feed in the parabolic barrel reflector.

Figure 19H:
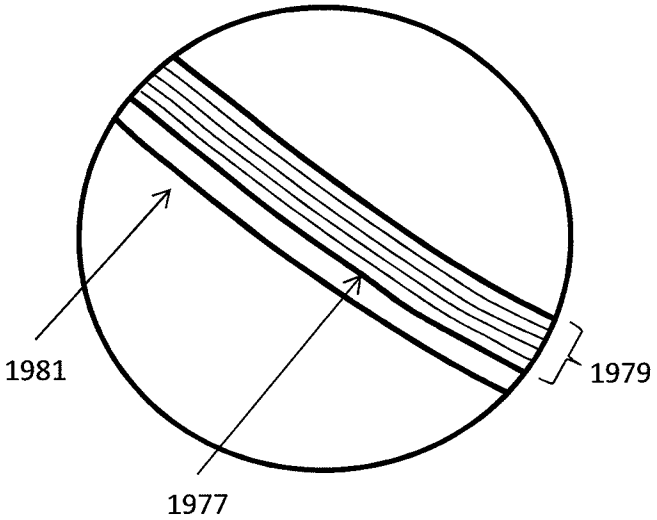
FIG. 19H is an enlarged view of the choke boundary region of the integrated shroud.
Figure 19G:
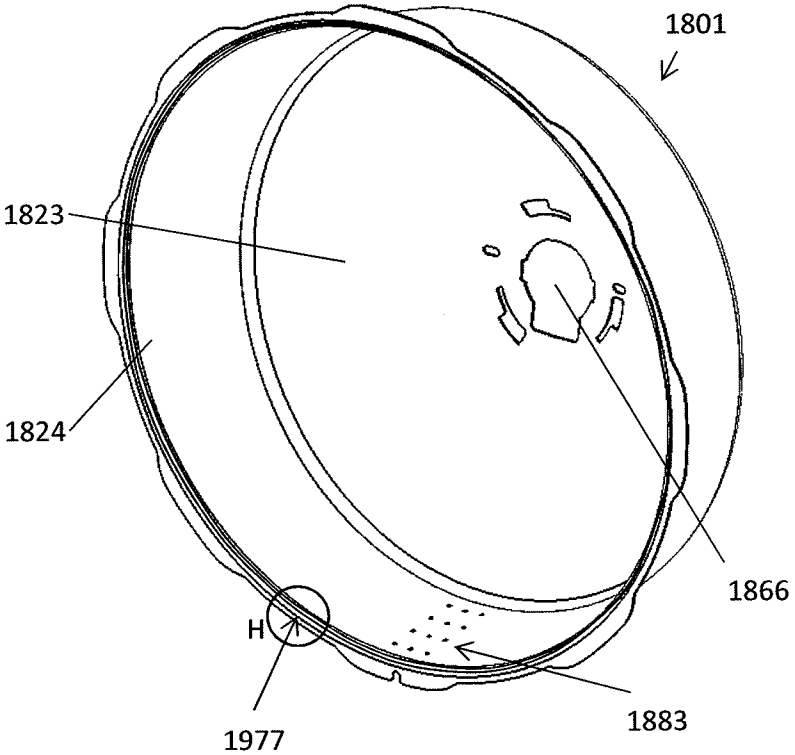
FIG. 19G shows an alternative variation of the parabolic barrel reflector of FIGS. 18 and 19A, including an outer choke boundary region around the outer edge of the shroud.

As mentioned above, any of the apparatuses described herein, including any of the parabolic barrel reflector apparatuses described herein, may include a choke boundary region acting a as a filter around the outer mouth/opening of the apparatus. For example, FIG. 19G shows a variation of a parabolic barrel reflector similar to the one shown in FIG. 19A (and FIG. 18), only including a choke boundary region 1977 formed as a plurality of ridges 1979. As mentioned above, these ridges may include a depth that is approximately ¼ A wavelength of the bands being used, as described herein. FIG. 19H shows an enlarged view of this choke region. In FIG. 19H, the choke region is shown radially inward from the radome attachment region or lip 1981 so that the radome may cover the choke region when covered; alternatively, the choke boundary may be outside of the radome (and/or radially outward from the radome attachment region. In general, the choke region may be referred to as an integrated notch filter and located along the outer edge of the apparatus.

Figure 20A:
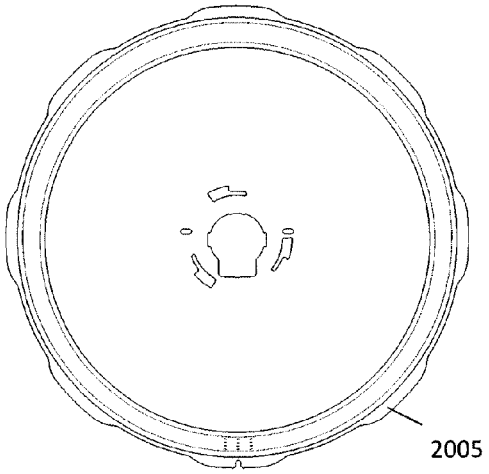
FIG. 20A shows an example of a parabolic barrel reflector for an antenna apparatus, similar to that shown in FIGS. 16A-19A.
Figure 20B:
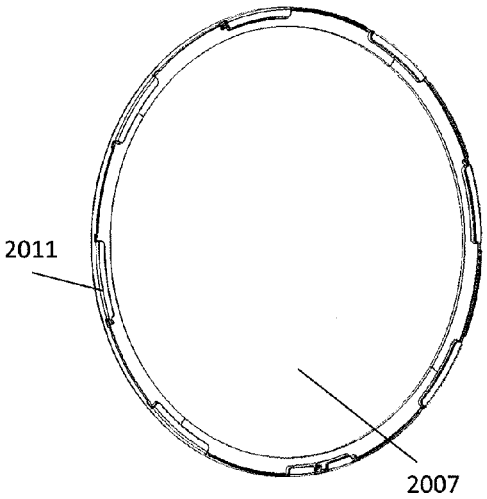
FIG. 20B is an example of a radome (cover) that may be attached over the mouth of the parabolic barrel reflector.
Figure 20C:
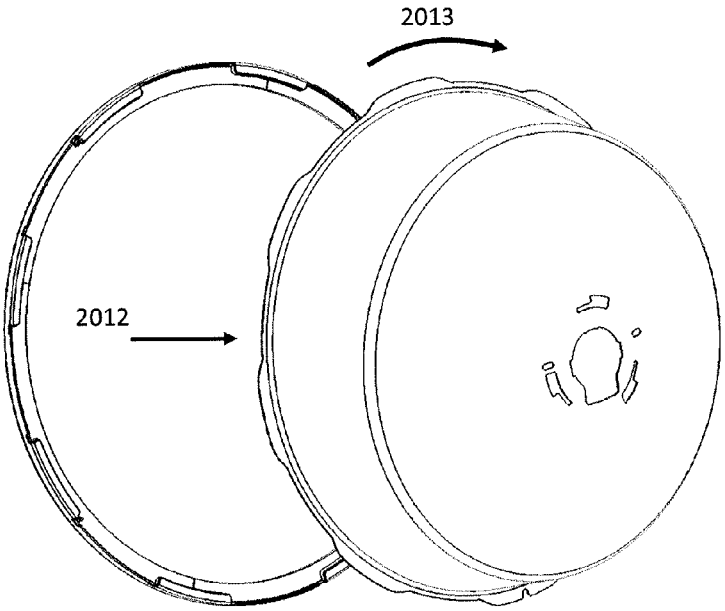
FIG. 20C illustrate attachment of the radome of FIG. 20B to the mouth of the parabolic barrel reflector of FIG. 20A.

FIG. 20A shows one example of the parabolic barrel reflector (body) portion 2001 for an antenna apparatus, similar to that shown in FIGS. 16A-19A. In this example, the outer edge of the shroud portion of the body has a lip or rim 2005 that is flanged outwards, and has regions of different width, forming a scalloped edge. FIG. 20B is an example of a radome (cover) 2007 that may be adapted to mate with this outer lip or rim region 2005 and attach over the mouth of the parabolic barrel reflector. In FIG. 20B, the radome outer edge region has edge regions 2011 that are complimentary to the scalloped edges 2005 of the rim. FIG. 20C illustrate attachment of the radome of FIG. 20B to the mouth of the parabolic barrel reflector of FIG. 20A. For example, the radome cover may be placed against the opening 2012, then aligned so that the scalloped edges fit between the outer edge regions 2011; to engage the radome to the body of the apparatus, as shown in FIG. 20C, the radome (or theoretically the body) may be rotated 2013 to engage the radome cover.

Figure 21A:
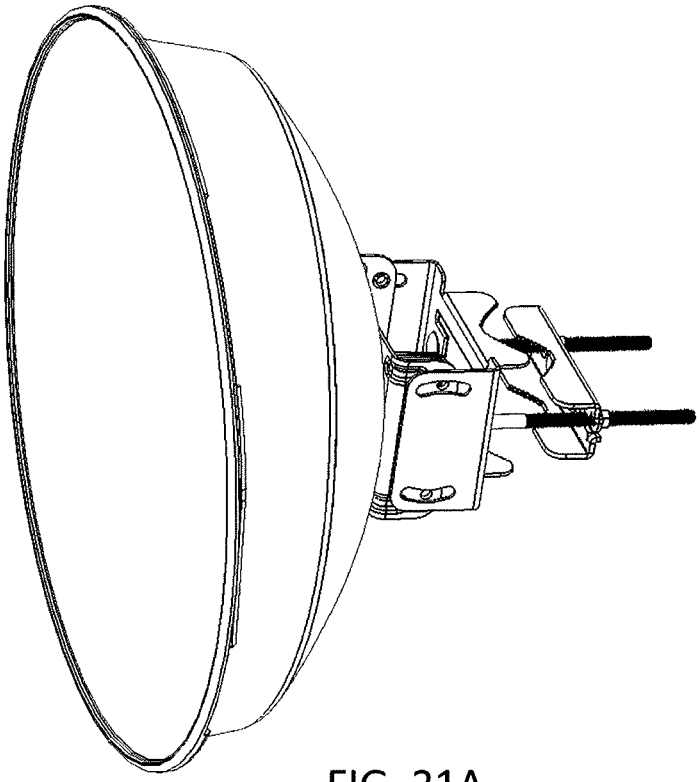
FIG. 21A illustrates a variation of an integrated antenna reflector and shroud apparatus (which may be referred to herein as a parabolic barrel reflector), covered with a radome.
Figure 21B:
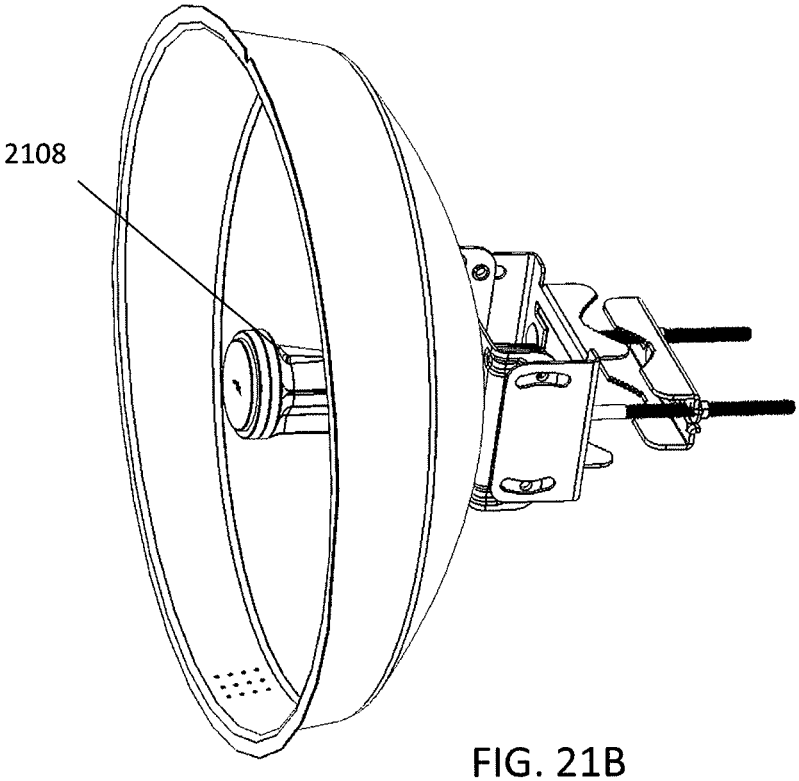
FIG. 21B shows the apparatus of FIG. 21A with the radome removed, showing the integrated radio/feed mounted within the reflector. This example has a 400 mm mouth opening diameter.
Figure 21C:
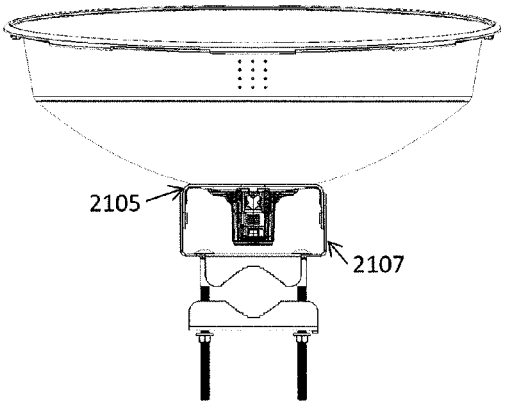
FIGS. 21C-21E illustrate bottom, top and side views, respectively of the integrated parabolic antenna reflector and shroud apparatus shown in FIGS. 21A-21B, including a mount and attached integrated radio/feed.
Figure 21D:
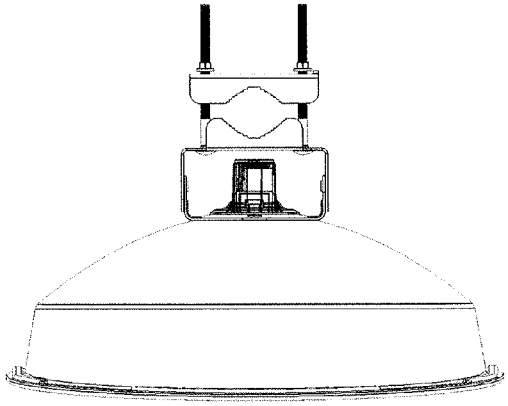
Figure 21E:
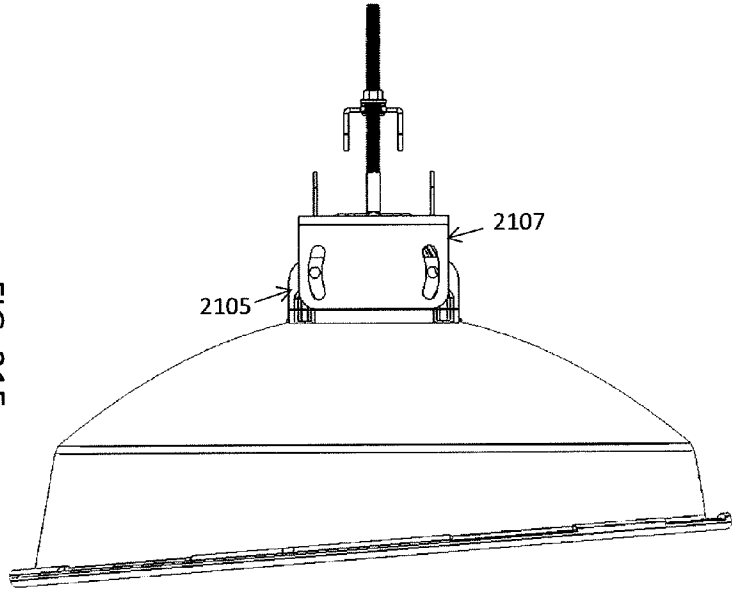

FIG. 21A illustrates a variation of an integrated antenna reflector similar to that shown in FIG. 16A, and an integrated parabolic reflector/shroud apparatus (parabolic barrel reflector), covered with a radome. Similarly, FIG. 21B shows the apparatus of FIG. 21A with the radome removed, showing the integrated radio/feed 2108 mounted within the reflector. The housing over the integrated radio transceiver and feed 2108 is shown attached and over the integrated radio transceiver and feed. This example has a 400 mm mouth opening diameter. FIGS. 21C-21E illustrate bottom, top and side views, respectively of the integrated parabolic antenna reflector and shroud apparatus shown in FIGS. 21A and 21B, including a mount (inner mount piece 2105 and outer mount piece 2107) and attached integrated radio/feed (not visible).

Figure 22:
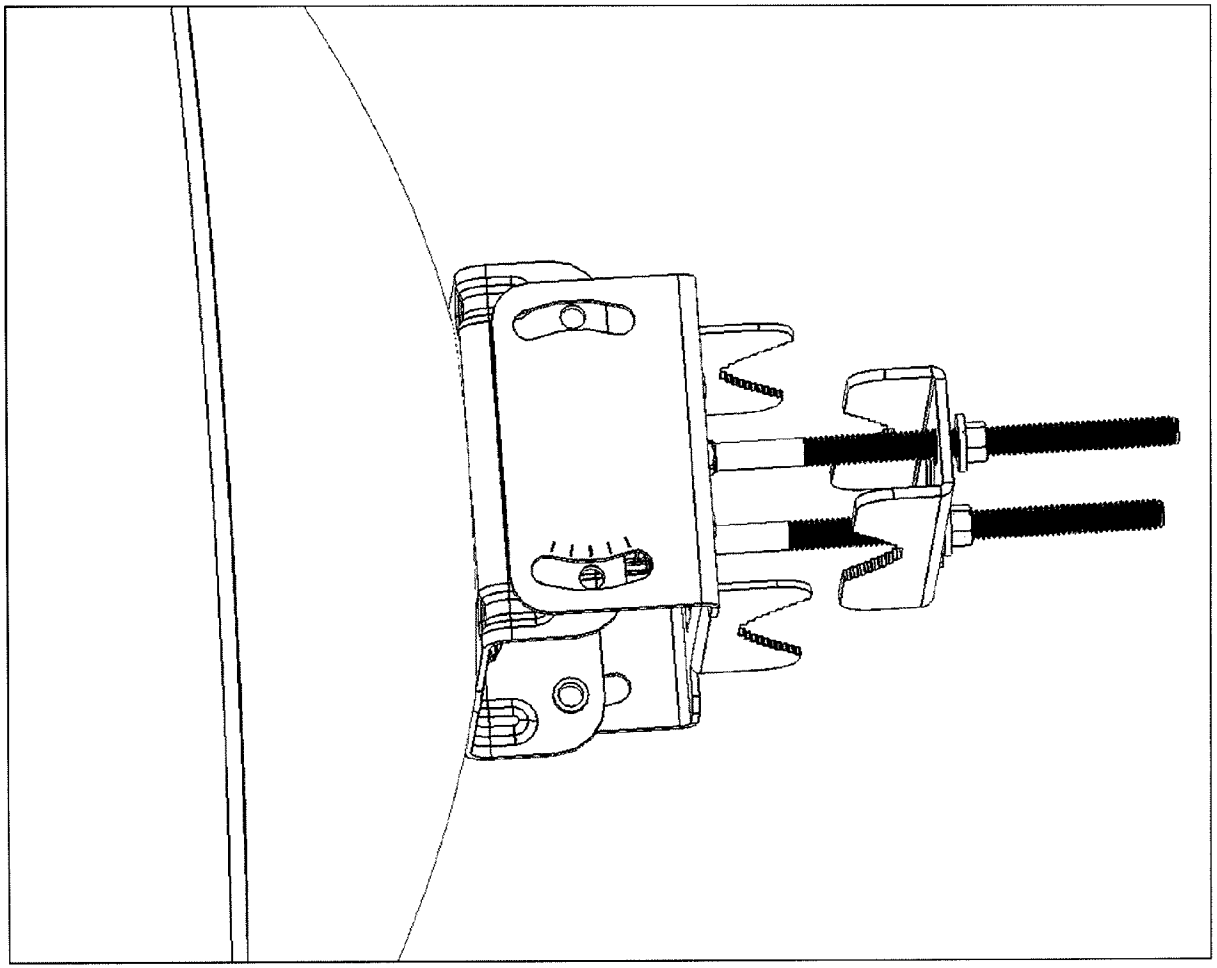

FIG. 22 shows a mount portion of the apparatus of FIGS. 16A-16E, which may be used to mount the apparatus to a surface, post, tower, or the like.

Figure 23A:
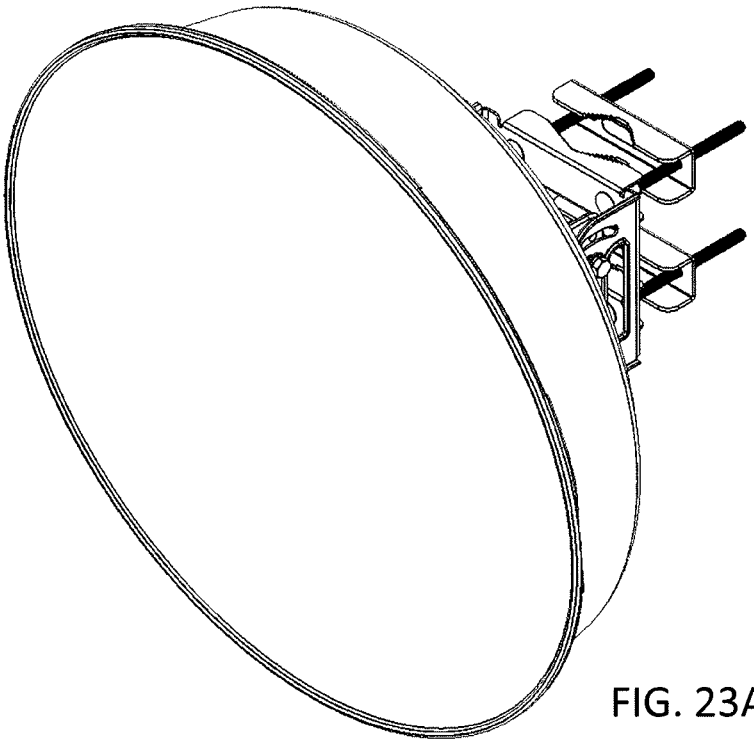
FIG. 23A illustrates a variation of an integrated antenna reflector and shroud apparatus (which may be referred to herein as a parabolic barrel reflector), covered with a radome.
Figure 23B:
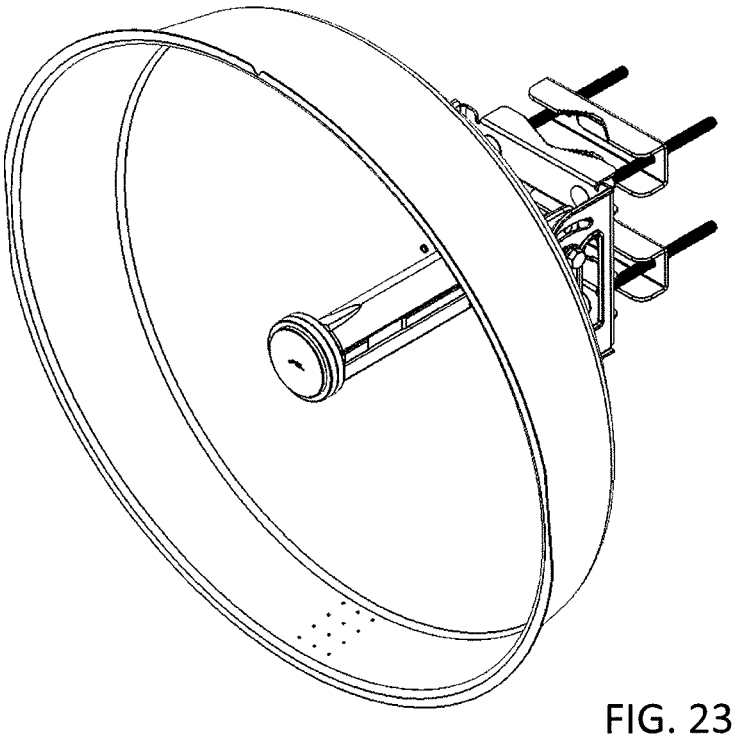
FIG. 23B shows the apparatus of FIG. 23A with the radome removed, showing the integrated radio/feed mounted within the reflector. This example has a 500 mm mouth opening diameter.

Similarly, FIG. 23A illustrates another variation of an integrated antenna reflector and shroud apparatus (which may be referred to herein as a parabolic barrel reflector) 2301, covered with a radome 2308. FIG. 23B shows the apparatus of FIG. 23A with the radome removed, showing the integrated radio/feed mounted within the reflector. This example has a 500 mm mouth opening diameter.

Figure 23C:
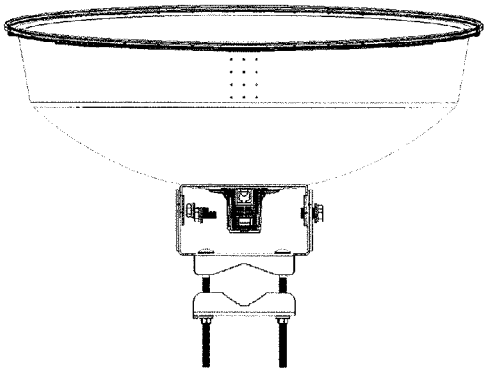
FIGS. 23C-23E illustrate bottom, top and side views, respectively of the integrated parabolic antenna reflector and shroud apparatus shown in FIGS. 23A-23B, including a mount and attached integrated radio/feed. The angle ($\alpha$) shown in FIG. 23E illustrates the angle between the plane formed by the mouth (opening) of the parabolic barrel reflector and the long axis of the integrated radio/feed held within the parabolic barrel reflector. In general, this angle may be between 89.5 degrees and 60 degrees, e.g., between 60 degrees and 85 degrees, etc.).
Figure 23D:
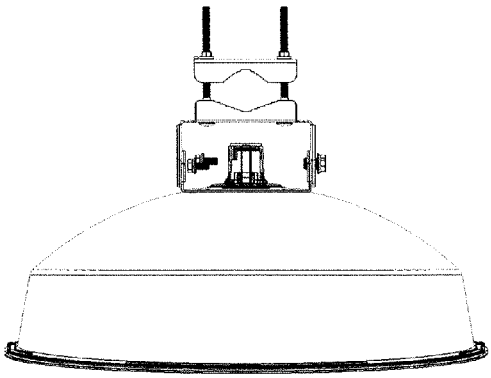
Figure 23E:
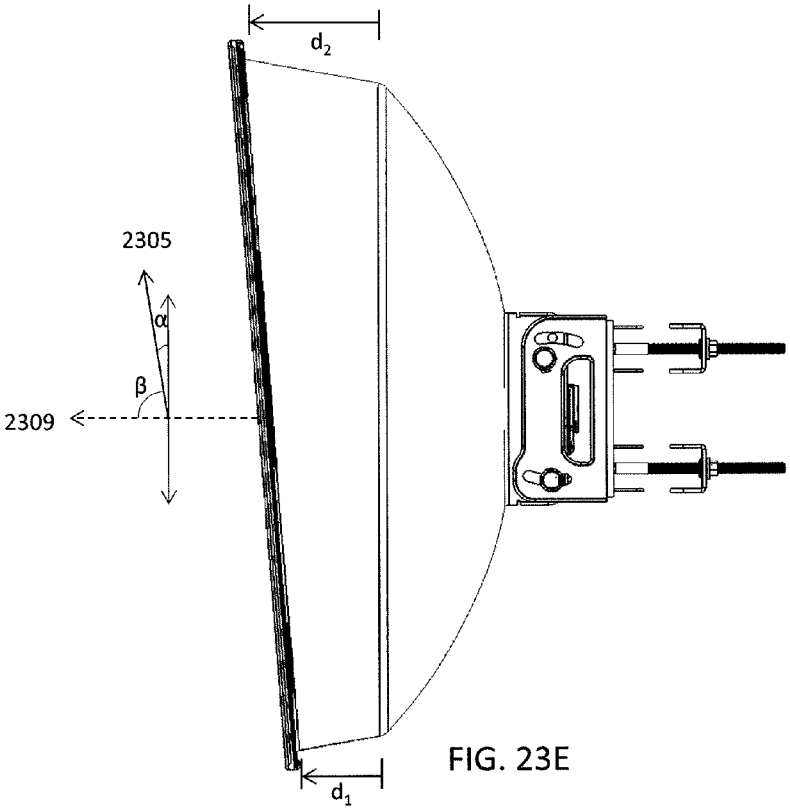

FIGS. 23C-23E illustrate bottom, top and sides views, respectively of the integrated parabolic antenna reflector and shroud apparatus shown in FIGS. 23A and 23B, including a mount and attached integrated radio/feed.

FIG. 23E illustrates the angle ($\alpha$) of the distal opening of the shroud portion, which is the angle of the plane formed by the distal opening relative to a plane that is perpendicular to midline, the axis of symmetry 2309 of the parabolic reflector region. The angle $\beta$ (which is 90-$\alpha$) is the angle of this distal opening relative to the axis of symmetry itself. As discussed above, this angle may be determined by, e.g., holding one edge diameter at a fixed level relative (e.g., $d_1$) in the direction of the central axis of symmetry, and setting the height (diameter) of the opposite edge approximately half of an offset wavelength distally in the direction of the central axis of symmetry (e.g., $d_2$). The offset wavelength may be a mean, median, or center wavelength of the operational RF range of the apparatus (e.g., a mean/medial of 5 GHz, $d_2$ may be approximately 5 cm higher than $d_1$). Thus, during operation, the more uniform the energy, the resulting angle of the radome may provide an approximate cancellation of energy reflected back towards the reflector by the radome.

A shroud configuration having distal mouth opening that forms an angle relative to the axis of symmetry of the parabolic reflector portion of the apparatus is counterintuitive, as this modification to the shroud is not optimal, and could allow a greater amount of noise, because of the asymmetry of the distal opening of the shroud. This is particularly true when the apparatus is oriented with shorter side of the shroud facing the ground, a direction having a greater number of possible sources of reflection and interference. Despite these potential disadvantages, this orientation may be beneficial in angling the radome down, e.g., towards the ground (preventing rain, snow and ice from accumulating on the shroud) and forming an angle relative to a plane perpendicular to the axis of symmetry of the parabolic reflector portion. For example, this design may prevent or reduce the front-to-back ratio of the apparatus. In the absence of the angled distal opening, when there is a high degree of rotational symmetry in the operation of the apparatus, edge signals that would otherwise wrap around the edge of the distal opening of the shroud portion may combine in-phase and point behind the antenna. Having an angled distal opening, in which the shroud has a larger side length on one side, e.g., the top, compared to an opposite side of the shroud, e.g., the bottom, may disrupt this backward-directed in-phase constructive interference, and may therefore improve the front-to-back ratio.

FIG. 23E illustrates one example of an apparatus, and shows an angle 2305 ($\beta$) between the plane formed by the mouth (opening) of the parabolic barrel reflector and the long axis 2309 of the integrated radio/feed held within the parabolic barrel reflector. In general, this angle may be between 89.5 degrees and 60 degrees, e.g., between 60 degrees and 85 degrees, etc.). Alternatively, the angle of the distal opening (and therefore the angle of any flat radome covering the opening) may be expressed as relative to a plane that is perpendicular to the axis of symmetry, shown as $\alpha$ in FIG. 23E.

Figure 24:
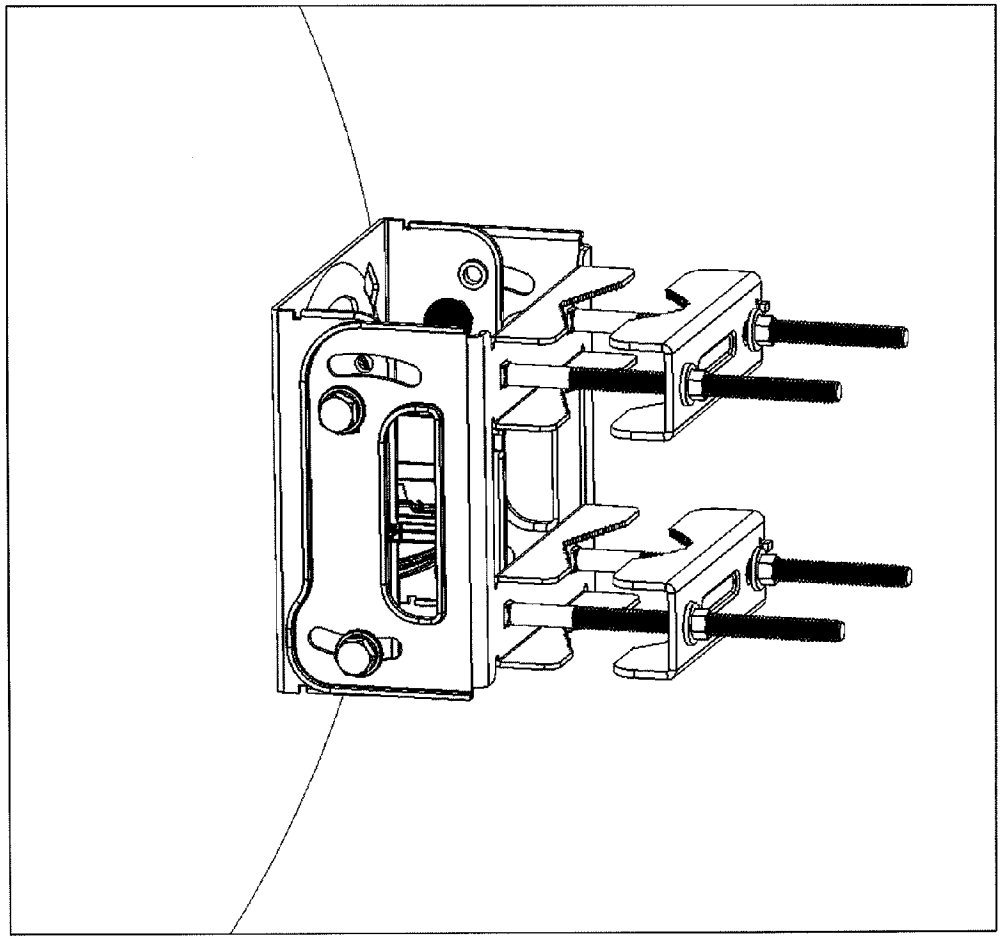

FIG. 24 shows an enlarged view of one variation of a mount portion of an apparatus such as the one shown in FIGS. 16A-16E, which may be used to mount the apparatus to a post, tower, or the like. This variation of a mount has two parts; a first mount portion that attaches to the back (or through) the parabolic reflector region of the parabolic antenna reflector apparatus, and a second part (second mount portion) that can couple with the first mount portion may also include attachments (e.g., bolt attachments or bolts) to a pole, stand, tower, or other surface.

Figure 25:
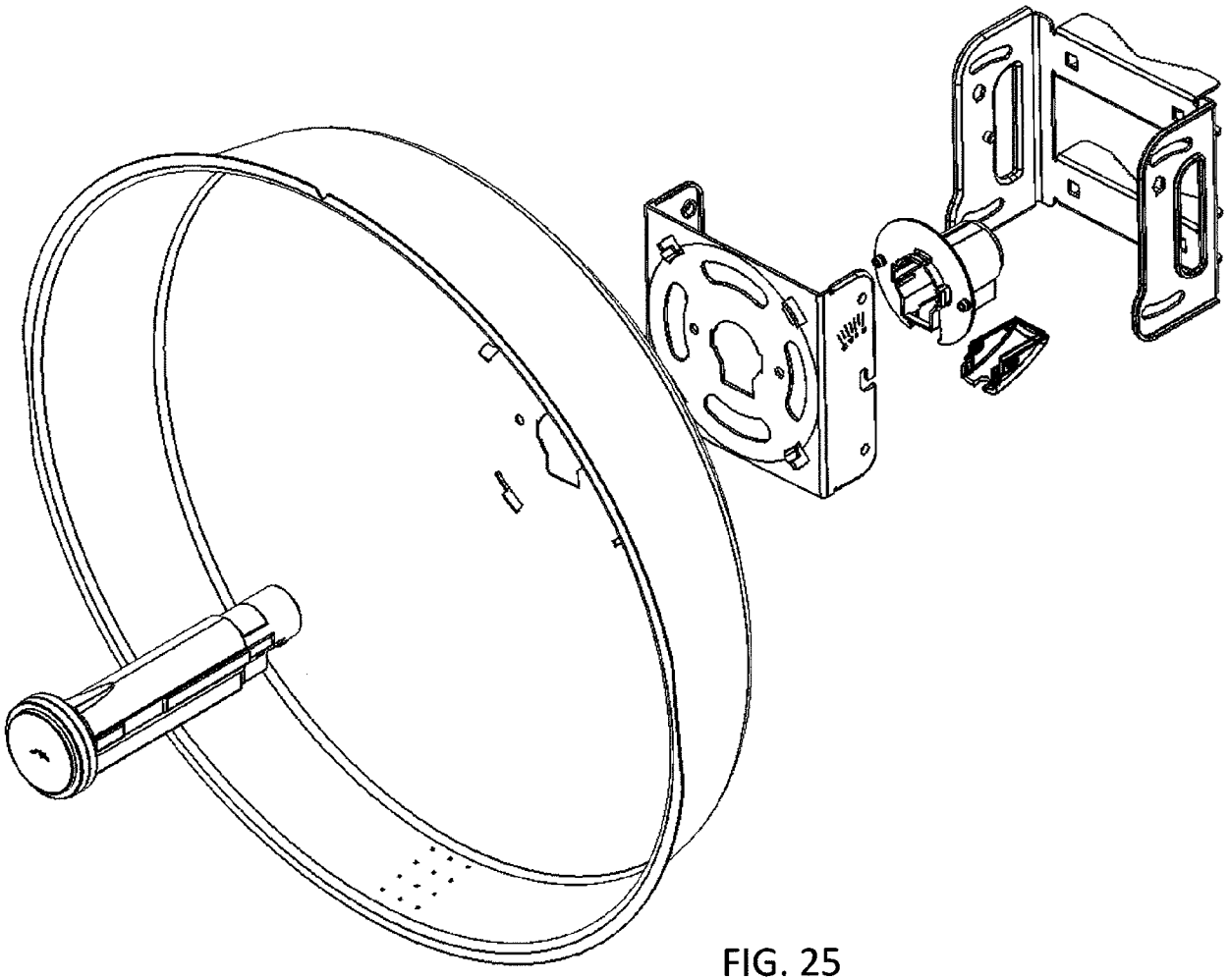
FIG. 25 is an exploded view of the apparatus of FIGS. 23A-23E, showing the component parts, including the parabolic barrel reflector, two mount portions, an integrated radio/feed, and a holder for the integrated radio/feed.
Figure 26A:
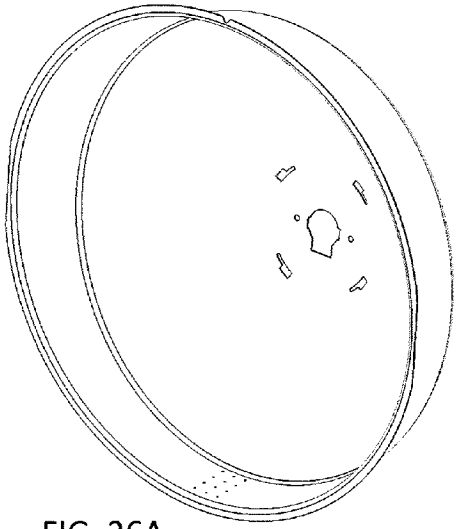
FIG. 26A shows the parabolic barrel reflector of FIG. 25.
Figure 26C:
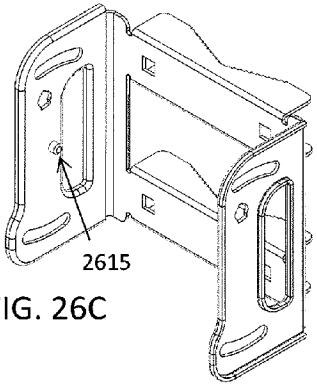
FIGS. 26B and 26C show the bracket mount of FIG. 25.
Figure 26B:
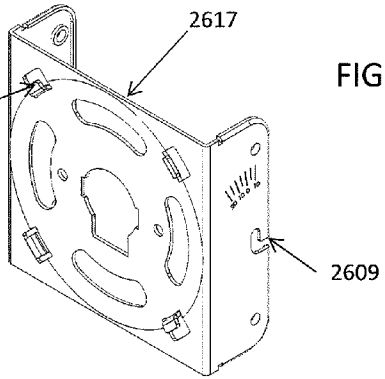

FIG. 25 is an exploded view of the apparatus of FIGS. 23A-23E, showing the component parts, including the parabolic barrel reflector, two mount portions, an integrated radio/feed, and a holder for the integrated radio/feed. This exploded view may also provide insight into how the apparatus may be assembled for operation. For example, the apparatus may be initially assembled by attaching an integrated radio transceiver and feed through the wall (e.g., the central region) of the apparatus so that it is secured held in the holder and extends into the cavity formed by the concave side of the apparatus, which is also shielded to prevent leakage/back transmission of RF signals from the receiver. The holder, may support the integrated radio transceiver and feed aligned with (e.g., pointing in the same direction as) the central axis of symmetry of the parabolic dish portion. FIGS. 26A-2F show the same elements (though in different embodiments) shown in the exploded view of FIG. 25. FIG. 26A shows a parabolic barrel reflector of FIG. 25, including the central opening and attachment sites for the mount and/or holder described herein. FIGS. 26B and 26C show front and back views, respectively, the bracket mount of FIG. 25.

In general, the holder mounted to the back of the apparatus may include shielding to prevent or decrease transmission of RF energy from the integrated radio transceiver and feed out of the back of the apparatus. For example, as described in reference to FIGS. 18, 19F (e.g., holder 1807), 26F, and 30A, a holder may be mounted behind the apparatus and may be used to hold, align and partially shield an integrated radio transceiver and feed. The integrated radio transceiver and feed may be positioned through a reflector (e.g., parabolic reflector) and held with the transceiver and and/or any sub-reflector within the housing partially through a hole in the reflector and secured by a holder so that the integrated radio transceiver and feed is aligned relative to the axis of the reflector. The holder may be shielded as described herein, to absorb and/or reflect RF energy; for example, the holder (inside and/or outside) may be coated with an RF reflecting and/or absorbing material, such as a plating of copper and nickel plating to prevent, limit or weaken back-directed RF energy.

Any of the antenna apparatuses described herein may include a holder for holding/securing/aligning an integrated radio transceiver and feed. These antenna apparatuses may include or may not include a choke, and/or may include or may not include a shroud portion. For example, described herein are antenna reflector apparatuses (e.g., parabolic antenna reflector apparatuses) comprising: a (e.g., parabolic) reflector section having a central axis of symmetry and a circular opening perpendicular to the central axis of symmetry; an integrated radio transceiver and feed comprising an elongate housing enclosing a substrate, transceiver circuitry on the substrate, and an antenna radiator extending from the substrate; a central opening through the parabolic reflector section through which the integrated radio transceiver and feed passes (which may be, e.g., greater than 3 cm in diameter); and a holder mounted on a proximal side of the central opening so the central opening is continuous with an inner chamber within the holder, wherein the inner chamber secures the integrated radio transceiver and feed (e.g., so that the integrated radio transceiver and feed is aligned with the central axis of symmetry). Thus, also described herein are dish antennas with an integrated feed/transceiver where the proximal end of the feed is located pass the center of the dish (protruding from the back side of the dish) and the proximal end of the feed is at least partially shielded to prevent RF interference. The dish antenna is not limited to one with a shroud (e.g., the dish antenna may be a traditional parabolic dish with no shroud, or a grid antenna dish).

As will be described in greater detail herein, any of the antenna apparatuses described herein may include an integrated radio transceiver and feed comprising an elongate housing enclosing a substrate, transceiver circuitry on the substrate, an antenna radiator extending from the substrate. The antenna radiator may include an antenna feed (such as, but not limited to a feed pin, feed plate, etc.) and in some variations a director (e.g., such as a director pin, director plate, etc.). In some variations, the antenna radiator includes a sub-reflector that is also in communication with the substrate.

The mounting bracket(s) shown in FIGS. 26A-26C are adapted to allow the antenna apparatus to be conveniently mounted (e.g., hung on a wall, post, mount, etc.). For example, in FIG. 26B, the plate may include multiple notches 2609 on the plate of the mount shown FIG. 26B allow the installer to "hang" a dish (which is secured to the plate 2617 in 26B) onto the bracket in FIG. 26C (which may already be secured onto a pole); the two notches on the plate in FIG. 26B may correspond (and mate with) to protrusions 2615 on the inner service of the U shaped bracket in FIG. 26C. An installer can than tilt the disk to the desired angle relative to the bracket shown in FIG. 26C, and secure the antenna in place (and orientation), e.g., using screws or other securements to secure and lock the antenna apparatus in place. The mount formed by the plate shown in 26B and bracket in 26C is an improvement over other configurations in which an installer had to hold the dish, along with the mount, while trying to align screw holes on the plate (shown in FIG. 26B) and the bracket (shown in FIG. 26C), and then place the screws to secure the dish to the bracket.

Figure 26D:
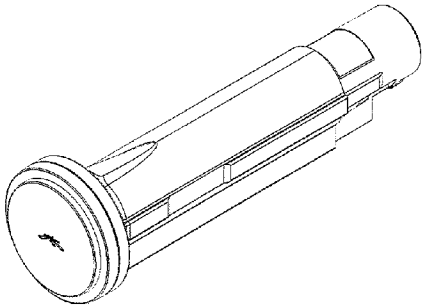
FIG. 26D shows an example of an integrated radio/feed, as described herein.
Figure 26E:
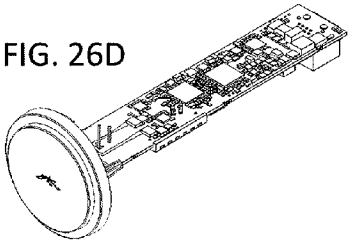
FIG. 26E shows the integrated radio/feed of FIG. 26D with the cover removed (exposing the circuitry and feed body.
Figure 26F:
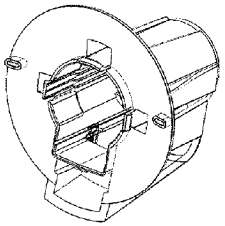
FIG. 26F shows the holder (e.g., housing) for an integrated radio/feed such as the one shown in FIG. 26D, keyed to maintain the orientation of the radio/feed in the parabolic barrel reflector.

FIG. 26D shows an example of an integrated radio/feed, as described herein, and FIG. 26E shows the integrated radio/feed of FIG. 26D with the cover removed (exposing the circuitry and feed body. FIG. 26F shows the holder (e.g., housing) for an integrated radio/feed such as the one shown in FIG. 26D, keyed to maintain the orientation of the radio/feed in the parabolic barrel reflector.

Figure 27A:
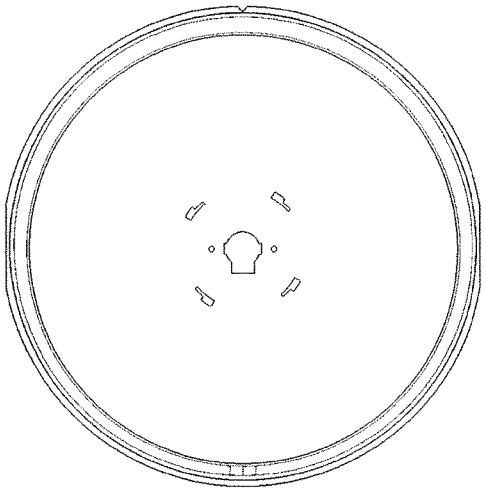
FIG. 27A shows a parabolic barrel reflector for an antenna apparatus, similar to that shown in FIGS. 23A-26A. This variation is adapted so that the radome may slide over the mouth of the parabolic barrel reflector.
Figure 27B:
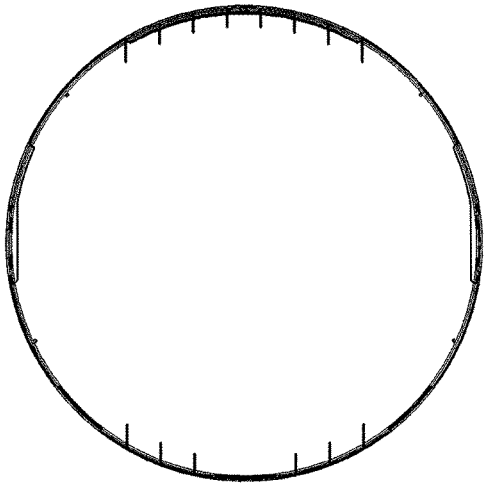
FIG. 27B is an example of a radome (cover) adapted to slide and attached over the mouth of the parabolic barrel reflector such as the one shown in FIG. 27A.
Figure 27C:
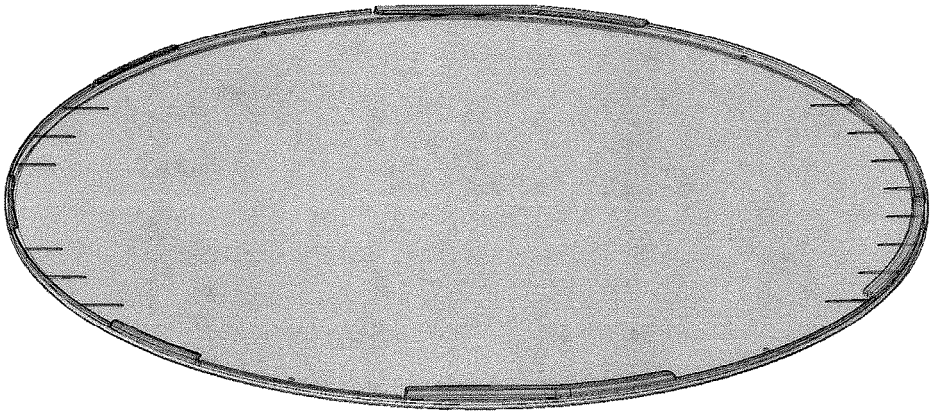
FIG. 27C is an enlarged perspective view of the radome of FIG. 27B, showing the rim region that is adapted to slide over the mouth of the parabolic barrel reflector.

In some variations assembly of the apparatuses described herein may be performed by first mounting the apparatus to a post, pole, tower or other surface (wall, etc.). For example, the mount may be a two-part mount; the first part, a second mount apparatus (of 4). May be first attached (in the lightweight form) to the pole, post, tower or other surface and the first mount portion may be secured to the body of the apparatus. Thereafter, the first and second mount pieces may be joined to form a single mount. The first and second mount may be welded together, and/or held together by screws, bolts, etc. In some variations, once the main body of the apparatus is connected and attached to a mount, a radome cover may be applied. In the variation shown in FIGS. 27A-28C, the radome includes a channel or other edge reason that may engage with an outer edge of the distal opening (mouth) of the shroud portion. FIG. 27A shows the back side of a radome as described herein. The edge of the radome may include a rim or lip that is flattened over a region on either side, so that the flattened regions may be held within the track, channel or the like of the radome. FIG. 27B shows a front view of the radome of FIG. 27A, and FIG. 27C shows an enlarged back perspective view, including the channels integrated radio transceiver and feed that are along an outer side region for engaging with the rim of the apparatus. FIG. 27A shows a parabolic barrel reflector for an antenna apparatus, similar to that shown in FIGS. 23A-26A. This variation is adapted so that the radome may slide over the mouth of the parabolic barrel reflector. FIG. 27B is an example of a radome (cover) adapted to slide and attached over the mouth of the parabolic barrel reflector such as the one shown in FIG. 27A. FIG. 27C is an enlarged perspective view of the radome of FIG. 27B, showing the rim region that is adapted to slide over the mouth of the parabolic barrel reflector.

Figure 28A:
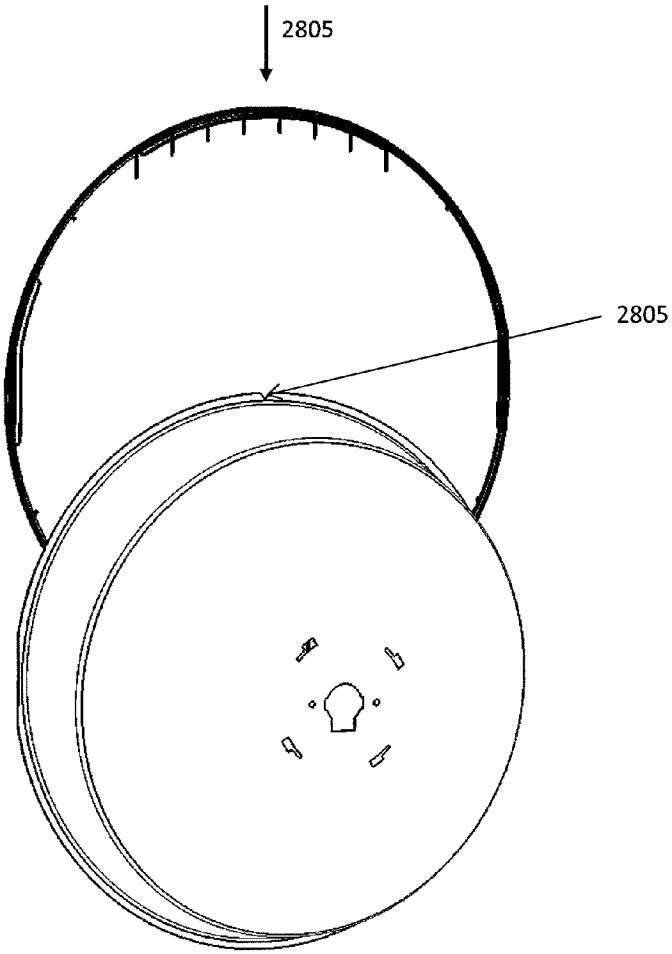
FIGS. 28A and 28B illustrate attachment of the radome of FIGS. 27B-27C over the mouth of the parabolic barrel reflector of FIG. 27A by sliding the cover from the top, down the flattened slides (perpendicular to the top, which is marked, e.g., by a cut-out region) and over the mouth of the combined parabolic reflector and shroud.
Figure 28B:
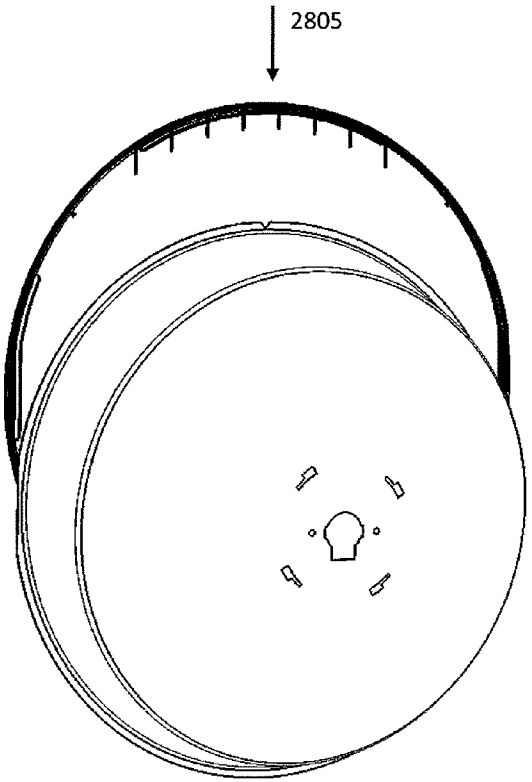

FIGS. 28A and 28B illustrate attachment of the radome of FIG. 27B-27C over the mouth of the parabolic barrel reflector of FIG. 27A by sliding 2803 the cover from the top, down the flattened slides (perpendicular to the top, which is marked, e.g., by a cut-out region 2805) and over the mouth of the combined parabolic reflector and shroud.

Figures 29A, 29B:
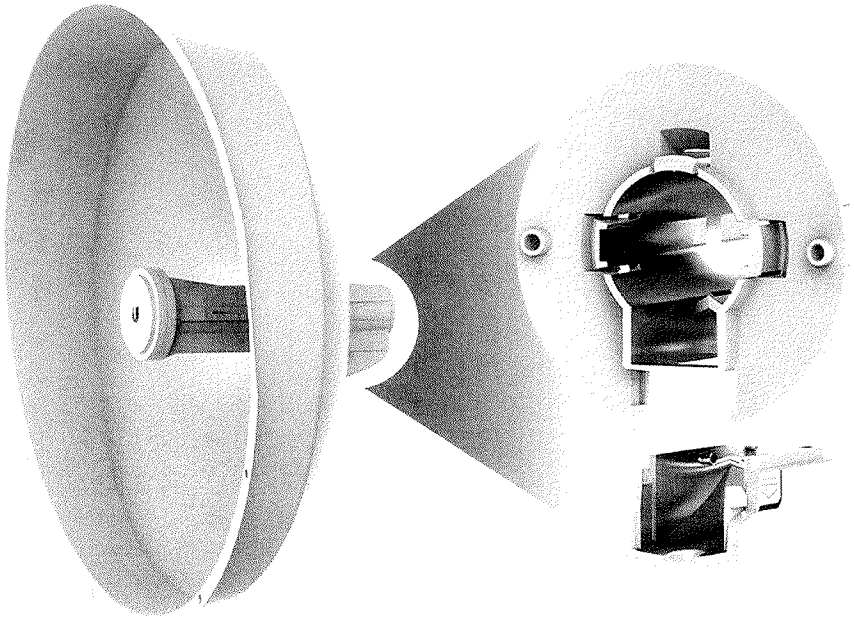
FIG. 29A shows an example of an apparatus including an integrated radio/feed device that is secured in the parabolic barrel reflector using a rear housing (holder or receiver) that is shown in greater detail in FIG. 29B; the receiver is metal plated within the housing to prevent passage of RF energy (e.g., microwave energy) from the back of the apparatus when holding the integrated radio/feed.

FIG. 29A shows an example of an apparatus including an integrated radio/feed device that is secured in the parabolic barrel reflector using a rear housing (holder or receiver) that is shown in greater detail in FIG. 29B; the receiver is metal plated within the housing to prevent passage of RF energy (e.g., microwave energy) from the back of the apparatus when holding the integrated radio/feed. For example, the rear housing may include a copper and nickel plating to prevent, limit or weaken back-directed RF energy.

Figure 30A:
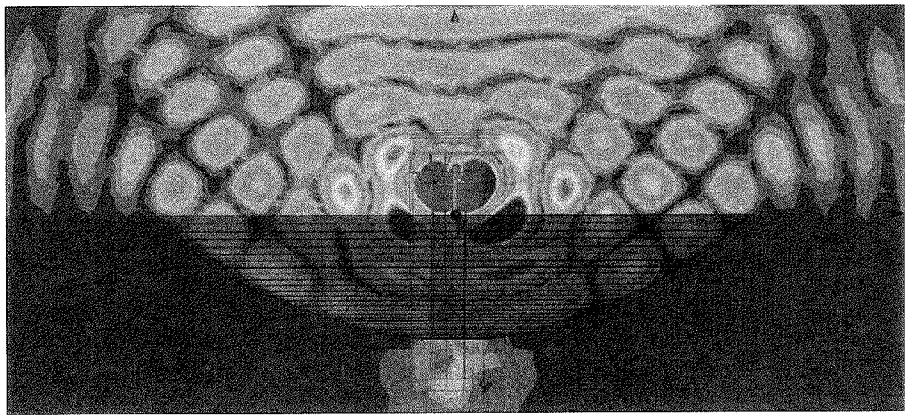
FIG. 30A shows an energy profile through a radio apparatus having a parabolic reflector, using an integrated radio/feed device.
Figure 30B:
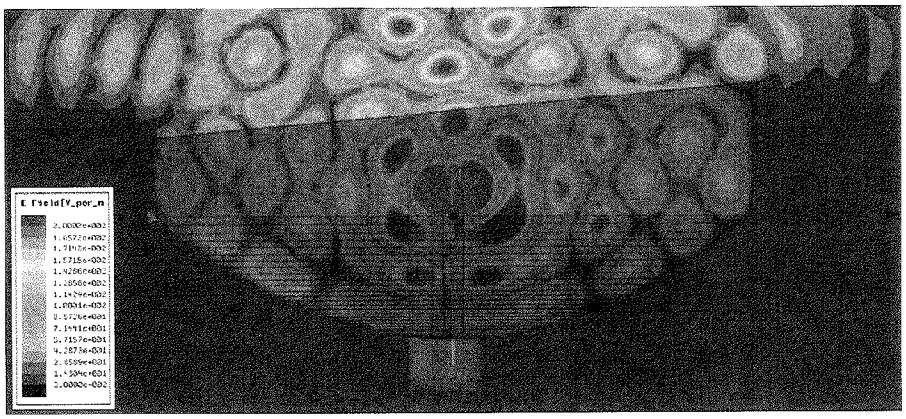
FIG. 30B shows the same integrated radio/feed device within a parabolic barrel reflector similar to those described herein, which act as RF isolators, showing a greater energy near the midline of the apparatus, exiting the mouth of the apparatus, compared to a parabolic reflector without an integrated shroud region. The thermal plot shows a range of field energies from 2e−2 (behind the apparatus) to a high of 2e+2.

In operation the apparatuses described herein may direct substantially more, higher-power signals in a predetermined desired direction (e.g., in parallel with the axis of symmetry). FIG. 30A shows an energy profile through a radio apparatus having a parabolic reflector, using an integrated radio/feed device. FIG. 30B shows the same integrated radio/feed device within a parabolic barrel reflector similar to those described herein, which act as RF isolators, showing a greater energy near the midline of the apparatus, exiting the mouth of the apparatus, compared to a parabolic reflector without an integrated shroud region. The thermal plot shows a range of field energies from 2e−2 (behind the apparatus) to a high of 2e+2.

Figure 31:
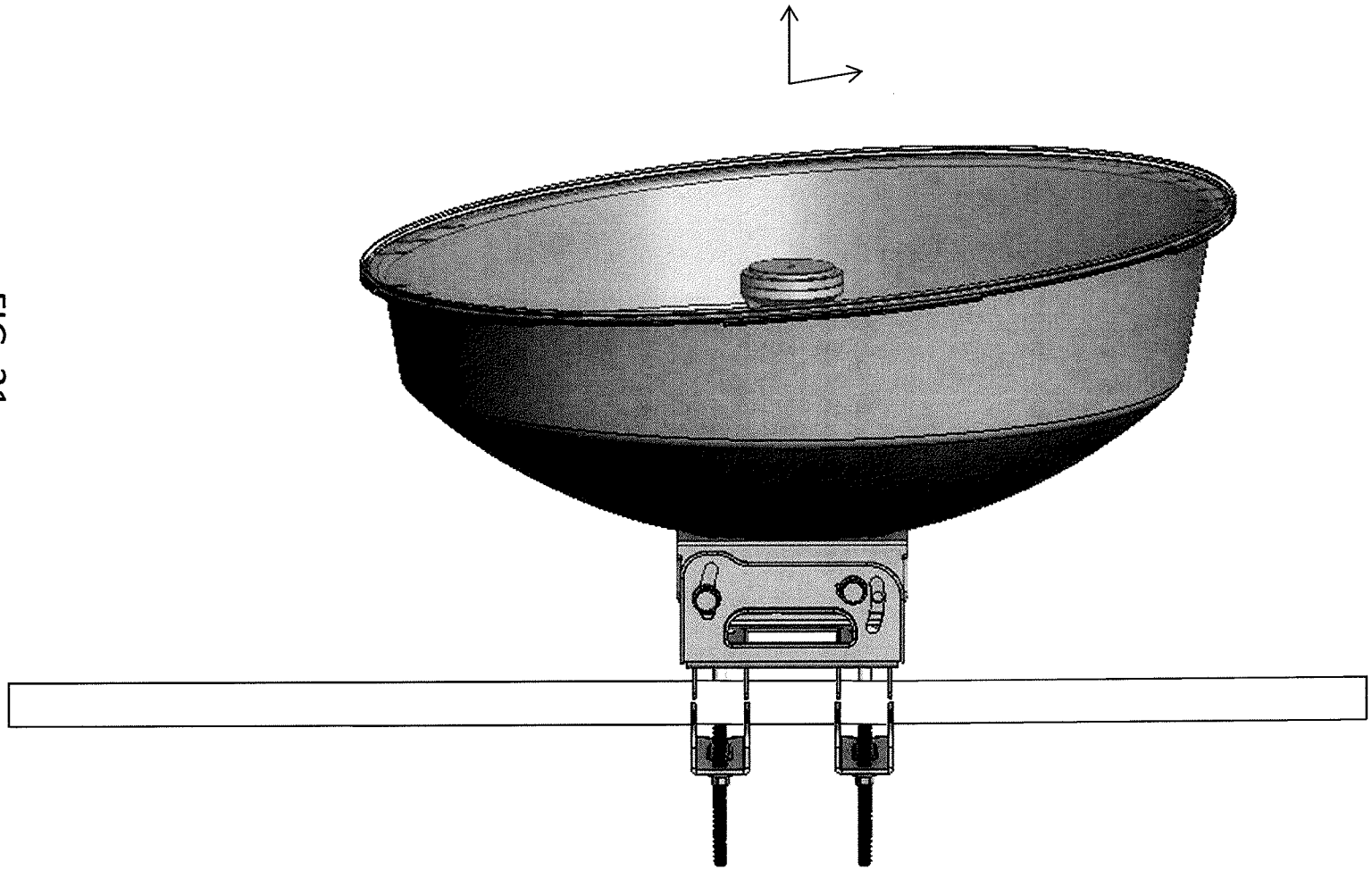
FIG. 31 illustrates an example of a radio apparatus including an integrated radio/feed within a parabolic barrel reflector and mounted to a pole via the mounts.

FIG. 31 illustrates an example of a radio apparatus including an integrated radio/feed within a parabolic barrel reflector and mounted to a pole via the mounts. As discussed above, the apparatus may be directed for use in point-to-point or point-to-multipoint transmission. In FIG. 31, the apparatus is aimed for transmission to the horizon, parallel to the ground region beneath the apparatus, while it appears to be directed downwards based on the direction of the radome cover.

Figure 33:
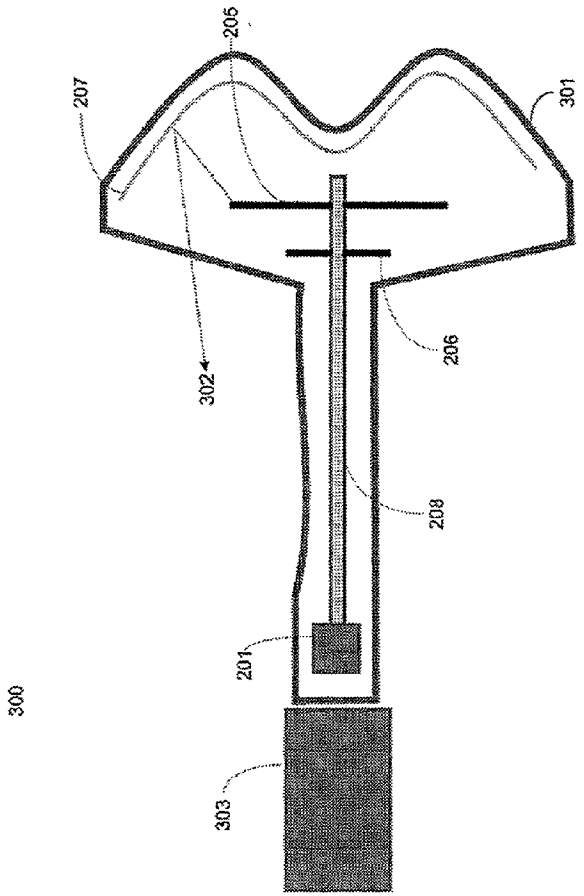
FIG. 33 illustrates an exemplary integrated radio transceiver and feed in a housing with an antenna tube.
Figure 32:
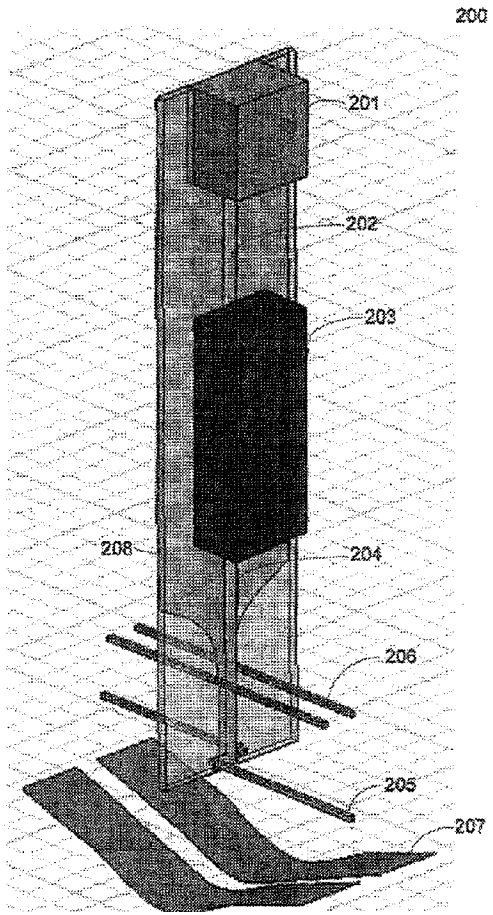
FIG. 32 illustrates an exemplary integrated radio (RF) transceiver and feed.

FIGS. 32 and 33 illustrate exemplary integrated radio transceiver and feeds that may be used with any of the apparatuses described herein. An integrated radio transceiver and feed may generally include a radio transceiver, an antenna (sub-antenna), an antenna feed mechanism, and the necessary RF connections (including cabling) to connect these elements. An integrated radio transceiver and feed may comprises the radio transceiver integrated with the antenna feed mechanism and the antenna conductors. Many benefits result from this integration, including the elimination of RF cabling and connectors. The antenna feed assembly may comprise connectivity for a digital signal interface; antenna feed pins, director pins and sub-reflectors. Typically, these elements may be located on a printed circuit board (PCB) and housed in weather proof housing. An integrated radio transceiver and feed may include one or more antenna feed pins, the one or more director pins and the one or more sub-reflectors. The integrated radio transceiver and feed may include the antenna feed system, its associated housing, and a parabolic sub-reflector, and may be used with any of the parabolic antenna reflector apparatuses described herein. By mounting the antenna feed pins and director pins perpendicular to a printed circuit board within the integrated radio transceiver and feed, the performance of the antenna system may be significantly improved.

Any of these integrated radio transceiver and feeds may include a center fed parabolic reflector (sub-reflector) and a radio transceiver, wherein the radio transceiver is physically integrated with a center feed parabolic reflector, and wherein the radio transceiver is powered through a digital cable. Many benefits result from this integration, including the elimination of RF cabling and connectors in the microwave system. In one embodiment, the antenna feed assembly may further comprise connectivity for a digital signal interface; antenna feed pins, director pins and sub-reflectors. Typically, these elements are located on a printed circuit board and housed in weather proof housing.

A radio transceiver may have a connector for an Ethernet cable that receives not only the digital signals, but also the power for the radio transceiver and the center fed reflector. The Ethernet cable may couple to a passive adapter, which in trims couples to a client station, wherein the passive adapter is powered by a USB cable that is also coupled to the client station. The passive adapter may inject power in the portion of the Ethernet cable that couples to the radio transceiver. The length of the Ethernet cable may be selected such that there is sufficient power to support the radio transceiver and to support the transmission of the digital signal to the radio transceiver. This embodiment may support a radio transceiver that incorporates a radio gateway with OSI layer 1-7 capabilities.

An integrated radio transceiver and feed may have a connector for a USB cable that receives not only the digital signals, but also the power for the radio transceiver and the center fed parabolic reflector. The USB cable may couple to a USB repeater, which in turns couples to a client station. The length of the USB cables may be selected such that there is sufficient power to support the radio transceiver and to support the transmission of the digital signal to the radio transceiver. This embodiment may support a radio transceiver that incorporates a USB client controller, e.g., supporting OSI layer 1-3. Although described in the context of an IEEE 802.11 Wi-Fi microwave system, the systems disclosed herein may be generally applied to any wireless network.

A parabolic reflector (or sub-reflector) is generally a parabola-shaped reflective device, used to collect or distribute energy such as radio waves. The parabolic reflector typically functions due to the geometric properties of the paraboloid shape: if the angle of incidence to the inner surface of the collector equals the angle of reflection, then any incoming ray that is parallel to the axis of the dish will be reflected to a central point, or "locus". Because many types of energy can be reflected in this way, parabolic reflectors can be used to collect and concentrate energy entering the reflector at a particular angle. Similarly, energy radiating from the "focus" to the dish can be transmitted outward in a beam that is parallel to the axis of the dish. An antenna feed may include an assembly that comprises the elements of an antenna feed mechanism, an antenna feed conductor, and an associated connector. An antenna feed system may include an antenna feed and a radio transceiver. A classical antenna system typically includes an antenna feed and an antenna, such as a parabolic reflector. In an integrated radio transceiver and feed, a radio transceiver is typically integrated with the antenna feed, so the antenna system comprises an antenna feed system and an antenna. A center-fed parabolic reflector may include a parabolic reflector, and an antenna feed, wherein the signal to the antenna feed is "feed" through the center of the parabolic antenna. A microwave system is typically a system comprising an antenna system, a radio transceiver, and one or more client station devices. The radio transceiver may be integrated with the antenna system.

FIG. 32 illustrates an exemplary integrated radio transceiver and feed 200. As illustrated, the functions of the radio transceiver may be integrated with the functions of the antenna feed conductor, and the functions of the conventional antenna feed mechanism. The integrated radio transceiver and feed 200 shown in FIG. 32 may be located in the same position relative to a reflective antenna as a conventional antenna feed mechanism. The integrated radio transceiver and feed 200 may be assembled on a common substrate, which may be a multi-layer printed circuit board 208. The integrated radio transceiver and feed 200 comprises a digital connector 201. This digital connector 201 may be an Ethernet or USB connector or other digital connector. A digital signal from a client station may be coupled to the digital connector 201 on a digital cable. To power the radio transceiver in the integrated radio transceiver and feed, the digital cable may include a power component. The power component may be provided on an Ethernet cable, a USB cable, or other equivalent digital cable.

FIG. 33 illustrates another example of an integrated radio transceiver and feed 300 comprising a housing with an antenna tube 303. The housing may be a weather-proof housing such as a plastic housing 301 that encloses the elements of the integrated radio transceiver and feed. An integrated radio transceiver and feed may include a digital connector 201, printed circuit board 208, antenna feed pins 205, director pins 206, and sub-reflector 207. In FIG. 33, the sub-reflector 207 reflects radiated waves 302 back towards a reflective antenna (such as the parabolic antenna reflector apparatuses described above). The housing 301 may conform to the shape of sub-reflector 207. As an option, a plastic housing 301 may permit interchangeability of the sub-reflector 207.

The tube 303 may be adjusted to various lengths in order to accommodate reflectors of different sizes. A digital cable, equivalent to digital cable 111, may be routed through the tube 303 and connected to digital connector 201. Digital connector 201 may have a weatherized connector, such as a weatherized Ethernet or USB connector.

Referring back to FIG. 32, the digital connector 201 may be coupled to a radio transceiver 203 via conductor 202. Conductor 202 may be implemented by a metal by a metal connector on a printed circuit card 208. A radio transceiver 203 may generate an RF signal that is coupled to an antenna feed conductor 204, which in turn couples to antenna feed pins 205. The antenna feed pins 205 radiate the RF signal 103 to an antenna reflector. However, the radiated signal may be modified and enhanced by the director pins 206 and the sub-reflectors 207.

As illustrated in FIG. 32, the antenna feed pins 205 comprise two pins that are located on opposite sides of the printed circuit card, and the pins are electrically connected together. The antenna feed pin may implement a half wave length dipole. However, the inclusion of the director pins 206 and the sub-reflector 207 may modify away from that of a half-wave length dipole. The director pins 206 are known in the industry as passive radiators or parasitic elements. These elements do not have any wired input. Instead, they absorb radio waves that have radiated from another active antenna element in proximity, and re-radiate the radio waves in phase with the active element so that it augments the total transmitted signal. An example of an antenna that uses passive radiators is the Yagi, which typically has a reflector behind the driven element, and one or more directors in front of the driven element, which act respectively like the reflector and lenses in a flashlight to create a "beam". Hence, parasitic elements may be used to alter the radiation parameters of nearby active elements.

The director pins 206 may be electrically isolated in the integrated radio transceiver and feed 200. Alternatively, the director pins 206 may be grounded. For the exemplary embodiment, the director pins 206 comprise two pins that are inserted through the PCB 208 such that two pins remain are each side of PCB 208, as illustrated in FIG. 32. In the exemplary embodiment, the director pins 206 and the antenna feed pins 205 are mounted perpendicular to the printed circuit board 208. Further, these pins may be implemented with surface mounted (SMT) pins.

The perpendicular arrangement of the director pins 206 and the antenna feed pins 205 may allow the transmission of radio waves to be planar to the integrated radio transceiver and feed 200. In this arrangement, the electric field is tangential to the metal of the PCB 208 such that at the metal surface, the electric field is zero. Thus the radiation from the perpendicular pins has a minimal impact upon the other electronic circuitry on PCB 208. Hence, approximately equal F and H plane radiation patterns are emitted that provide for effective illumination of the antenna, thus increasing the microwave system efficiency.

The radiation pattern and parameters are additionally modified by the sub-reflector antenna 207 that is located near the antenna feed pins 205. As illustrated in FIG. 33, the sub-reflector "reflects" radiation back to a reflective antenna such as a parabolic antenna reflector apparatus described above (not shown in FIG. 33). Both the director pins and the sub-reflector modify the antenna pattern and beam width, with the potential of improving the microwave system performance.

As for additional details pertinent to the present invention, materials and manufacturing techniques may be employed as within the level of those with skill in the relevant art. The same may hold true with respect to method-based aspects of the invention in terms of additional acts commonly or logically employed. Also, it is contemplated that any optional feature of the inventive variations described may be set forth and claimed independently, or in combination with any one or more of the features described herein.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments only and is not intended to be limiting of the invention. For example, as used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings of the present invention.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Although various illustrative embodiments are described above, any of a number of changes may be made to various embodiments without departing from the scope of the invention as described by the claims. For example, the order in which various described method steps are performed may often be changed in alternative embodiments, and in other alternative embodiments one or more method steps may be skipped altogether. Optional features of various device and system embodiments may be included in some embodiments and not in others. Therefore, the foregoing description is provided primarily for exemplary purposes and should not be interpreted to limit the scope of the invention as it is set forth in the claims.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A parabolic antenna reflector apparatus, the apparatus comprising:

a parabolic reflector section having a central axis of symmetry and a circular opening perpendicular to the central axis of symmetry;

a shroud portion extending distally from the circular opening, the shroud portion having a distal opening;

a radome covering the distal opening and a side wall;

a choke portion connected to the side wall of the shroud portion, the choke portion comprising a plurality of parallel ridges parallel to the side wall and configured to attenuate RF electromagnetic radiation;

an integrated radio transceiver and feed comprising an elongate housing enclosing a substrate, transceiver circuitry on the substrate, an antenna radiator extending from the substrate;

a central opening through the parabolic reflector section through which the integrated radio transceiver and feed passes; and a holder enclosing a distal end of the integrated radio transceiver and feed and configured to prevent transmission of RF energy out of the central opening and from a back of the integrated radio transceiver and feed, the holder mounted on a proximal side of the central opening so the central opening is continuous with an inner chamber within the holder, wherein the inner chamber secures the integrated radio transceiver and feed so that the integrated radio transceiver and feed is aligned with the central axis of symmetry.

2. The apparatus of claim 1, wherein the wherein the antenna radiator of the integrated radio transceiver and feed further comprises an antenna feed, a director extending from the substrate, and a sub-reflector.

3. The apparatus of claim 1, further wherein the distal opening of the shroud portion forms a plane at an angle relative to a plane perpendicular to the central axis of symmetry.

4. The apparatus of claim 1, further wherein the distal opening of the shroud portion forms a plane at an angle of between 0.5 degrees and 15 degrees relative to a plane perpendicular to the central axis of symmetry.

5. The apparatus of claim 1, wherein the inner chamber comprises a coating of a radio-frequency (RF) shielding material.

6. The apparatus of claim 1, wherein the inner chamber comprises a coating of a radio-frequency (RF) shielding material comprising a copper and nickel plating.

7. The apparatus of claim 1, wherein the central opening through the parabolic reflector section has a diameter of greater than 3 cm.

8. The apparatus of claim 1, further comprising a rim around the distal opening having an outer edge comprising two parallel straight regions on opposite sides of the distal opening; wherein the radome is configure to cover the distal opening by sliding over the distal opening and engaging the two parallel straight regions.

9. The apparatus of claim 1, further comprising a rim around the distal opening, wherein the rim comprises a scalloped outer edge.

10. The apparatus of claim 1, wherein the choke portion extends only partially around a perimeter of the side wall of the shroud portion.

11. The apparatus of claim 1, wherein the holder comprises a door on a side of the holder for passing a cord or cable from the integrated radio transceiver and feed out of the holder.

12. The apparatus of claim 1, wherein the diameter of the distal opening of the shroud portion is between 200 mm and 700 mm.

13. The apparatus of claim 1, further comprising a mounting bracket having a mounting bracket opening, wherein the mounting bracket is attached to the proximal side of the central opening between the parabolic reflector section and the holder so that a proximal end of an integrated radio transceiver and feed may pass through the central opening and bracket opening and into the holder.

14. The apparatus of claim 13, wherein the mounting bracket comprises one or more notches configured to couple to a second mounting bracket having one or more protrusions adapted to engage the hone or more notches of the first mounting bracket, allowing the apparatus to be adjustably mounted onto a post, pole or surface to which the second mounting bracket is secured.

15. The apparatus of claim 1, wherein the shroud portion comprises an annular wall extending between the circular opening of the parabolic reflector section and the distal opening; further wherein the diameter of the annular wall at a top portion of the apparatus is between 1.1 times and 3 times the diameter of the annular wall at a bottom portion of the apparatus.

16. A parabolic antenna reflector apparatus, the apparatus comprising:

a parabolic reflector section having a central axis of symmetry and a circular opening perpendicular to the central axis of symmetry;

a shroud portion extending distally from the circular opening, the shroud portion having a distal opening and a side wall;

a choke portion connected to the side wall of the shroud portion, the choke portion comprising a plurality of parallel ridges distal to the shroud portion and configured to attenuate RF electromagnetic radiation;

a radome covering the distal opening;

a central opening through the parabolic reflector section;

a holder enclosing a distal end of the integrated radio transceiver and feed and configured to prevent transmission of RF energy out of the central opening and from a back of the integrated radio transceiver and feed, the holder mounted on a proximal side of the central opening so the central opening is continuous with an inner chamber within the holder, wherein the inner chamber comprises a coating of a radio-frequency (RF) shielding material; and an integrated radio transceiver and feed comprising an elongate housing enclosing a substrate, transceiver circuitry on the substrate, an antenna radiator extending from the substrate, wherein the integrated radio transceiver and feed is held within the holder so that a sub-reflector extends from the holder, through the central opening and into the parabolic reflector section along the central axis of symmetry.

17. A parabolic antenna reflector apparatus, the apparatus comprising:

a parabolic reflector section having a central axis of symmetry and a circular opening perpendicular to the central axis of symmetry;

a shroud portion extending distally from the circular opening, the shroud portion having a distal opening and a side wall, wherein the parabolic reflector section and shroud section are continuous regions of a single piece of material;

a choke portion connected to the side wall of the shroud portion, the choke portion comprising a plurality of parallel ridges distal to the shroud portion and configured to attenuate RF electromagnetic radiation;

a rim around the distal opening having an outer edge comprising two parallel straight regions on opposite sides of the distal opening;

a radome covering the distal opening, wherein the radome is configure to slide over the distal opening and engage the two parallel straight regions;

an integrated radio transceiver and feed comprising an elongate housing enclosing a substrate, transceiver circuitry on the substrate, an antenna radiator extending from the substrate, and a sub-reflector;

a central opening through the parabolic reflector section through which the integrated radio transceiver and feed passes; and a holder enclosing a distal end of the integrated radio transceiver and feed and configured to prevent transmission of RF energy out of the central opening and from a back of the integrated radio transceiver and feed, the holder mounted on a proximal side of the central opening so the central opening is continuous with an inner chamber within the holder, wherein the inner chamber comprises a coating of a radio-frequency (RF) shielding material, wherein integrated radio transceiver and feed is held within the inner chamber so that the integrated radio transceiver and feed is aligned with the central axis of symmetry.

18. A parabolic antenna reflector apparatus, the apparatus comprising:

a parabolic reflector section having a central axis of symmetry and a circular opening perpendicular to the central axis of symmetry;

a shroud portion extending distally from the circular opening, the shroud portion having a distal opening forming a plane at an angle of between 0.5 degrees and 15 degrees relative to a plane perpendicular to the central axis of symmetry and a side wall;

a choke portion connected to the side wall of the shroud portion, the choke portion comprising a plurality of parallel ridges distal to the shroud portion and configured to attenuate RF electromagnetic radiation;

a radome covering the distal opening;

a central opening through the parabolic reflector section having a diameter of greater than 3 cm; and a holder enclosing a distal end of the integrated radio transceiver and feed and configured to prevent transmission of RF energy out of the central opening and from a back of the integrated radio transceiver and feed, the holder mounted on a proximal side of the central opening so the central opening is continuous with an inner chamber within the holder, wherein the inner chamber comprises a coating of a radio-frequency (RF) shielding material, further wherein the inner chamber is configured to secure an integrated radio transceiver and feed so that the integrated radio transceiver and feed is aligned with the central axis of symmetry.

19. The apparatus of claim 18, further comprising an integrated radio transceiver and feed comprising an elongate housing enclosing a substrate, transceiver circuitry on the substrate, an antenna feed extending from the substrate, and a director extending from the substrate, and a sub-reflector.

20. The apparatus of claim 18, further wherein the distal opening of the shroud portion forms a plane at an angle of between 1 degree and 10 degrees relative to the plane perpendicular to the central axis of symmetry.

21. The apparatus of claim 18, wherein the coating within the inner chamber comprises a coating of a radio-frequency (RF) shielding material comprising a copper and nickel plating.

22. The apparatus of claim 18, further comprising a rim around the distal opening having an outer edge comprising two parallel straight regions on opposite sides of the distal opening; wherein the radome is configure to cover the distal opening by sliding over the distal opening and engaging the two parallel straight regions.

23. The apparatus of claim 18, further comprising a rim around the distal opening, wherein the rim comprises a scalloped outer edge.

24. The apparatus of claim 18, wherein the choke portion extends only partially around a perimeter of the side wall of the shroud portion.

25. The apparatus of claim 18, wherein the holder comprises a door on a side of the holder for passing a cord or cable from the integrated radio transceiver and feed out of the holder.

* * * * *